US012796823B2

(12) United States Patent
Nelson et al.

(10) Patent No.: US 12,796,823 B2
(45) **Date of Patent: *Nov. 17, 2026**

(54) MODULAR FURNITURE AND RECLINING ASSEMBLIES WITH DOCKING FEATURES

(71) Applicant: The Lovesac Company, Stamford, CT (US)

(72) Inventors: Shawn D. Nelson, Washington, UT (US); David M. Underwood, Hurricane, UT (US); Lynn Curtis Strong, St. George, UT (US); Stephen Ciccarelli, St. George, UT (US); Zach I. Gaarder, St. George, UT (US); Casey Lee Webb, Washington, UT (US); Jacob D. Forman, Washington City, UT (US); Braquel L. Urie, Cedar City, UT (US); Brian Kuchler, Hurricane, UT (US); Tyler Sanders, St. George, UT (US); Randall R. Bateman, Hurricane, UT (US); Joel H. Bennett, Morgan, UT (US)

(73) Assignee: The Lovesac Copany, Stamford, CT (US)

( * ) Notice: Subject to any disclaimer, the term of this patent is extended or adjusted under 35 U.S.C. 154(b) by 133 days.

This patent is subject to a terminal disclaimer.

(21) Appl. No.: 18/826,865

(22) Filed: Sep. 6, 2024

(65) Prior Publication Data

US 2024/0423374 A1 Dec. 26, 2024

Related U.S. Application Data

(63) Continuation-in-part of application No. 18/298,839, filed on Apr. 11, 2023, now Pat. No. 12,396,557.
(Continued)

(51) Int. Cl.
*A47C 1/028* (2006.01)
*A47C 1/024* (2006.01)
(Continued)

(52) U.S. Cl.
CPC ..... *A47C 7/5068* (2018.08); *A47C 1/024* (2013.01); *A47C 1/03* (2013.01); *A47C 13/005* (2013.01)

(58) Field of Classification Search
CPC ..... A47C 1/028; A47C 1/124; A47C 4/02; A47C 13/005; A47C 1/0342
(Continued)

(56) References Cited

U.S. PATENT DOCUMENTS 988,059 A 3/1911 Allen
2,480,552 A 8/1949 Colvez
(Continued)

FOREIGN PATENT DOCUMENTS

CN 2236262 Y 10/1996
CN 201341645 Y 11/2009
(Continued)

OTHER PUBLICATIONS

International Search Report and Written Opinion mailed Jan. 21, 2025 for PCT Application No. PCT/US2024/045817.
(Continued)

*Primary Examiner* — Rodney B White
(74) *Attorney, Agent, or Firm* — Workman Nydegger

(57) ABSTRACT

Disclosed are furniture systems including at least one reclining assembly. The reclining assembly is configured to seamlessly integrate and couple to a modular furniture assembly, having a footprint that substantially fits within the geometric specifications of the footprint of the modular furniture assembly. The reclining assembly has a general appearance that is substantially similar to the modular furniture assem-
(Continued)

bly when the reclining assembly is in the un-reclined position. The reclining assembly includes a reclining mechanism that permits transitioning the reclining assembly between a deep mode and a wide mode. The reclining assembly includes an adjustable frame and the reclining mechanism, wherein the reclining mechanism includes a fixed lower carriage portion and an upper carriage portion. An actuator drives the upper carriage portion relative to the lower carriage portion.

24 Claims, 56 Drawing Sheets

Related U.S. Application Data

(60) Provisional application No. 63/581,828, filed on Sep. 11, 2023, provisional application No. 63/362,809, filed on Apr. 11, 2022.

(51) Int. Cl.

| | |
|---|---|
| ***A47C 1/03*** | (2006.01) |
| ***A47C 1/034*** | (2006.01) |
| ***A47C 1/035*** | (2006.01) |
| ***A47C 1/124*** | (2006.01) |
| ***A47C 4/02*** | (2006.01) |
| ***A47C 7/50*** | (2006.01) |
| ***A47C 13/00*** | (2006.01) |

(58) Field of Classification Search
USPC ..... 297/1, 130, 283.1
See application file for complete search history.

(56) References Cited

U.S. PATENT DOCUMENTS

| | | | |
|---|---|---|---|
| 2,625,983 | A | 1/1953 | Slyter et al. |
| 2,653,648 | A | 9/1953 | Marshall |
| 3,113,633 | A | 12/1963 | Eberhardt et al. |
| 3,870,297 | A | 3/1975 | Elder |
| 3,893,731 | A | 7/1975 | Maggs |
| 3,972,559 | A | 8/1976 | Anacker |
| 4,124,249 | A | 11/1978 | Abbeloos |
| 4,321,717 | A | 3/1982 | Serra |
| 4,561,692 | A | 12/1985 | Yestadt et al. |
| 4,846,525 | A | 7/1989 | Manning |
| 5,064,244 | A | 11/1991 | Sproule |
| 5,106,153 | A | 4/1992 | Durling |
| 5,326,153 | A | 7/1994 | Muffi |
| 5,352,017 | A | 10/1994 | Berning |
| 5,362,296 | A | 11/1994 | Wang et al. |
| 5,368,359 | A | 11/1994 | Eakin |
| 5,544,938 | A | 8/1996 | Saul et al. |
| 5,683,139 | A | 11/1997 | Golynsky et al. |
| 5,735,573 | A | 4/1998 | Vredevoogd |
| 5,740,564 | A | 4/1998 | Hankins et al. |
| 5,790,993 | A | 8/1998 | Roma et al. |
| 5,895,365 | A | 4/1999 | Tomlinson |
| 5,967,820 | A | 10/1999 | Siegal et al. |
| 5,995,634 | A | 11/1999 | Zwolski |
| 6,000,353 | A | 12/1999 | De Leu |
| 6,000,758 | A | 12/1999 | Schaffner et al. |
| 6,322,146 | B1 | 11/2001 | Fisher |
| 6,814,709 | B2 | 11/2004 | Schwartz et al. |
| 6,981,747 | B2 | 1/2006 | Wieland et al. |
| 7,090,297 | B2 | 8/2006 | Mohn et al. |
| 7,172,196 | B2 | 2/2007 | Randall |
| 7,213,885 | B2 | 5/2007 | White, III et al. |
| D547,087 | S | 7/2007 | Natuzzi |
| 7,312,393 | B2 | 12/2007 | McCarthy |
| 7,317,176 | B2 | 1/2008 | Boucher |
| 7,421,608 | B2 | 9/2008 | Schron |
| 7,448,689 | B2 | 11/2008 | Carter et al. |
| 7,547,073 | B2 | 6/2009 | White, III et al. |
| 7,553,288 | B2 | 6/2009 | Cohen |
| 7,575,279 | B2 | 8/2009 | Robertson |
| 7,631,937 | B2 | 12/2009 | Robertson |
| 7,699,389 | B2 | 4/2010 | Robertson |
| 7,735,912 | B2 | 6/2010 | Robertson |
| 7,766,421 | B2 | 8/2010 | Lawson |
| 7,871,280 | B2 | 1/2011 | Henriott |
| 7,918,308 | B2 | 4/2011 | Cohen |
| 7,963,612 | B2 | 6/2011 | Nelson |
| 7,982,436 | B2 | 7/2011 | Randall |
| 8,061,864 | B2 | 11/2011 | Metcalf et al. |
| 8,132,856 | B2 | 3/2012 | Wilson et al. |
| 8,228,026 | B2 | 7/2012 | Johnson et al. |
| 8,421,407 | B2 | 4/2013 | Johnson |
| 8,668,045 | B2 | 3/2014 | Cohen |
| 8,783,778 | B2 | 7/2014 | Nelson et al. |
| 8,935,985 | B2 | 1/2015 | Hjelm |
| 9,004,585 | B1 | 4/2015 | Pidgornyy |
| 9,010,851 | B2 | 4/2015 | LaPointe |
| 9,095,209 | B2 | 8/2015 | Mirth et al. |
| 9,124,308 | B2 | 9/2015 | Metcalf |
| 9,277,826 | B2 | 3/2016 | Nelson et al. |
| 10,123,621 | B2 | 11/2018 | Nelson et al. |
| 10,143,307 | B2 * | 12/2018 | Nelson ..... A47C 13/005 |
| 12,089,744 | B2 * | 9/2024 | Zhao ..... A47C 13/005 |
| 12,396,557 | B2 * | 8/2025 | Nelson ..... A47C 1/028 |
| 2001/0020810 | A1 | 9/2001 | Kennedy |
| 2002/0158492 | A1 | 10/2002 | Ko et al. |
| 2003/0025366 | A1 | 2/2003 | Armando |
| 2003/0139693 | A1 | 7/2003 | Swift |
| 2004/0004383 | A1 | 1/2004 | Laurent |
| 2004/0026998 | A1 | 2/2004 | Henriott et al. |
| 2004/0041452 | A1 | 3/2004 | Williams |
| 2004/0061943 | A1 | 4/2004 | Bosch et al. |
| 2004/0095000 | A1 | 5/2004 | Durling |
| 2005/0053252 | A1 | 3/2005 | Cohen |
| 2005/0146179 | A1 | 7/2005 | Murphy |
| 2005/0253430 | A1 | 11/2005 | George et al. |
| 2006/0036201 | A1 | 2/2006 | Cohen |
| 2006/0061148 | A1 | 3/2006 | Pollard et al. |
| 2006/0076813 | A1 | 4/2006 | Mohn et al. |
| 2008/0012404 | A1 | 1/2008 | Dewert |
| 2008/0150329 | A1 | 6/2008 | Lawson |
| 2008/0231089 | A1 | 9/2008 | Lapointe et al. |
| 2008/0262657 | A1 | 10/2008 | Howell et al. |
| 2009/0072782 | A1 | 3/2009 | Randall |
| 2009/0096255 | A1 | 4/2009 | Robertson |
| 2009/0212638 | A1 | 8/2009 | Johnson |
| 2009/0212639 | A1 | 8/2009 | Johnson |
| 2009/0212737 | A1 | 8/2009 | Johnson et al. |
| 2009/0250982 | A1 | 10/2009 | Cohen |
| 2010/0290215 | A1 | 11/2010 | Metcalf et al. |
| 2010/0320819 | A1 | 12/2010 | Cohen et al. |
| 2011/0012403 | A1 | 1/2011 | Wilson et al. |
| 2011/0109211 | A1 | 5/2011 | Kirkeby et al. |
| 2011/0110075 | A1 | 5/2011 | Smith |
| 2011/0298340 | A1 | 12/2011 | Nelson et al. |
| 2012/0026724 | A1 | 2/2012 | Metcalf et al. |
| 2012/0051579 | A1 | 3/2012 | Cohen |
| 2012/0200129 | A1 | 8/2012 | Wilson, Jr. |
| 2012/0286557 | A1 | 11/2012 | Hoffman et al. |
| 2013/0199421 | A1 | 8/2013 | Hjelm |
| 2013/0207478 | A1 | 8/2013 | Metcalf et al. |
| 2013/0234481 | A1 | 9/2013 | Johnson |
| 2014/0010387 | A1 | 1/2014 | Cohen |
| 2014/0197666 | A1 | 7/2014 | Koch |
| 2014/0285140 | A1 | 9/2014 | Jung |
| 2015/0069965 | A1 | 3/2015 | Verschueren |
| 2015/0076881 | A1 | 3/2015 | LaPointe |
| 2015/0076891 | A1 | 3/2015 | Lapointe et al. |
| 2016/0174715 | A1 | 6/2016 | Nelson et al. |
| 2017/0143122 | A1 * | 5/2017 | Nelson ..... A47C 1/0352 |
| 2017/0149181 | A1 | 5/2017 | Nelson et al. |
| 2017/0150264 | A1 | 5/2017 | Nelson et al. |
| 2018/0000244 | A1 | 1/2018 | Nelson et al. |
| 2018/0041354 | A1 | 2/2018 | Nelson et al. |
| 2020/0323352 | A1 | 10/2020 | Rach |
| 2021/0289941 | A1 | 9/2021 | Brandtner et al. |

(56) References Cited

U.S. PATENT DOCUMENTS

| | | | | |
|---|---|---|---|---|
| 2022/0078555 | A1 | 3/2022 | Nelson et al. | |
| 2023/0066786 | A1* | 3/2023 | Zhao | A47C 17/04 |
| 2023/0209262 | A1 | 6/2023 | Nelson et al. | |
| 2023/0217170 | A1 | 7/2023 | Nelson et al. | |
| 2024/0415284 | A1 | 12/2024 | Nelson et al. | |
| 2025/0351963 | A1* | 11/2025 | Nelson | A47C 1/028 |

FOREIGN PATENT DOCUMENTS

| | | | |
|---|---|---|---|
| CN | 202553058 | U | 11/2012 |
| CN | 202698449 | U | 1/2013 |
| CN | 201452358 | U | 4/2013 |
| CN | 202907151 | U | 4/2013 |
| CN | 202981088 | U | 6/2013 |
| CN | 203563950 | U | 4/2014 |
| CN | 203609079 | U | 5/2014 |
| CN | 206306893 | U | 7/2017 |
| GB | 2582213 | A | 9/2020 |
| WO | 2009/113319 | A1 | 9/2009 |
| WO | 2012/093398 | A2 | 7/2012 |
| WO | 2014/072975 | A1 | 5/2014 |
| WO | 2017/087224 | A1 | 5/2017 |
| WO | 2017/087266 | A1 | 5/2017 |
| WO | 2017/087268 | A1 | 5/2017 |

OTHER PUBLICATIONS

Requirement for Restriction/Election received for U.S. Appl. No. 18/298,839, mailed on Jan. 16, 2025, 7 pages.
Notice of Allowance received for U.S. Appl. No. 18/298,839, mailed on May 2, 2025, 10 pages.
http://homefurniturecomponents.com, A foundation of comfort, printed on Oct. 21, 2016, 12 pages.
http://homefurniturecomponents.com, A foundation of comfort, printed on Oct. 4, 2016, 1 page.
http://homefurniturecomponents.com, EasyCliner+, printed on Oct. 21, 2016, 1 page.
http://homefurniturecomponents.com, InSpira Lounging Ingenuity video link Features and Benefits of InSpira, printed on Oct. 21, 2016, 1 page. (Best Just Got Better).
http://homefurniturecomponents.com, Omega Wall Hugger, printed on Oct. 21, 2016, 1 page.
Page from archive. org for www.romag.com available, on information and belief, at least as early as Jan. 31, 2016, 1 page.
Page from archive. org for www.romag.com available, on information and belief, at least as early as Jun. 10, 2016, 1 page.
Page from archive. org for www.romag.com available, on information and belief, at least as early as Oct. 17, 2015, 1 page.
Pages from http://www.recliner-handles.com, available, on information and belief, at least as early as Nov. 1, 2016, 3 pages.
Pages from https://web.archive.org/web/20160604194805/http://www.recliner-handles.com , available, on information and belief, at least as early as Jun. 4, 2016, 6 pages.
Pictures of Recliner Mechanism, dated Oct. 12, 2016, 3 pages.
The Wall Street Journal newspaper article entitled, "Wireless Charging Everywhere," dated Dec. 30, 2015.
U.S. Appl. No. 13/869,600, Dec. 15, 2015, Office Action.
U.S. Appl. No. 15/342,800, Aug. 1, 2018, Notice of Allowance.
U.S. Appl. No. 15/342,800, Aug. 6, 2018, Corrected Notice of Allowability.
U.S. Appl. No. 15/342,800, Mar. 16, 2018, Office Action.
U.S. Appl. No. 15/342,800, Nov. 14, 2018, Issue Notification.
U.S. Appl. No. 15/667,967, Jul. 10, 2018, Notice of Allowance.
U.S. Appl. No. 15/667,967, Mar. 30, 2018, Notice of Allowance.
U.S. Appl. No. 15/667,967, Oct. 24, 2018, Issue Notification.
U.S. Appl. No. 60/778,761, entitled Power Delivery Surface Power Supply Safety, dated Mar. 3, 2006 (59 pages).
www.HomeFurnitureComponents.com, 300ez One-Motor Lift Mechanism, printed on Oct. 21, 2016, 1 page.
www.HomeFurnitureComponents.com, 350ez Series Recliner Mechanism, printed on Oct. 21, 2016, 1 page.
www.HomeFurnitureComponents.com, InSpira Lounging Ingenuity video screen shots, printed on Oct. 21, 2016, 10 pages.
www.HomeFurnitureComponents.com, InSpira Lounging Ingenuity, printed on Oct. 20, 2016, 1 page.

* cited by examiner

MODULAR FURNITURE AND RECLINING ASSEMBLIES WITH DOCKING FEATURES

CROSS REFERENCE TO RELATED APPLICATIONS

This application claims the benefit of and priority to U.S. Patent Application No. 63/581,828, filed Sep. 11, 2023, entitled MODULAR FURNITURE AND RECLINING ASSEMBLIES. The present application is also a continuation in part of U.S. patent application Ser. No. 18/298,839, filed Apr. 11, 2023, now U.S. Pat. No. 12,396,557 B2, entitled MODULAR FURNITURE AND RECLINING ASSEMBLIES, which claims priority to and the benefit of U.S. Provisional Patent Application No. 63/362,809, filed on Apr. 11, 2022, entitled MODULAR FURNITURE AND RECLINING ASSEMBLIES. Each of the foregoing patent applications is incorporated herein by reference.

BACKGROUND

Technical Field

This disclosure generally relates to furniture systems, modular furniture and reclining assemblies.

Related Technology

Modular furniture is advantageous in part because it enables a variety of different furniture configurations to be created using a limited number of parts and because in manufacturing and design, only a limited number of designs are needed, simplifying the manufacturing and supply process. Modular furniture is therefore both efficient, convenient and valuable. It is also important that modular furniture be comfortable so that users will want to sit and remain seated in a sofa configuration, for example, or in a chair or other furniture system.

Traditional furniture has evolved into a variety of different furniture configurations that enable the user to sit comfortably in a variety of different seated positions. For example, traditional furniture features extensive numbers of pieces in order to create a large couch, or a sectional seating configuration in which a number of people can enjoy sitting together to engage in an activity or to watch television or a movie together as a group or family, for example. Recliners, for example, can be used to move from a sitting position to a reclining position in order to further relax the muscles of the back and/or neck. Typical recliners, however, often have a bulky, mechanized appearance that is not aesthetically pleasing or contiguous with the appearance of neighboring furniture pieces. It is often possible to immediately identify which piece is a recliner, often yielding an unpleasant and non-unified appearance.

Furthermore, many traditional recliners included in sectional couches cannot be positioned closely against a back wall because the backrest of the recliner section will often need space behind it in order to recline. This requires the placement of the entire sectional couch system to be sufficiently far away from such a wall to allow for the recliner section to recline. This can reduce the usable space within a room and/or otherwise leave an undesired space between the furniture and such a wall.

Many traditional recliners included in sectional couches only provide support to the calves or legs of a user and do not allow a user to comfortably place the soles of their feet on the footrest, where the footrest would provide an appropriately inclined surface to comfortably accommodate such placement of the soles of the user's feet.

For those consumers who do not have the space to accommodate or cannot afford many pieces of furniture, it is also desirable to have furniture which can provide multiple functions, or which can be reconfigured. For example, a couch with a relatively deep seating surface can be desirable when lounging, watching television, or listening to music. In contrast, a couch with a relatively shallow seating surface is often more desirable when sitting upright while in conversation with others. Further, different shapes, sizes, and footprint configurations of furniture can be desired depending on the space which the furniture is to fill, such as a large living room, a small office space, or a home theater setting.

It would be an advantage in the art to provide improved recliner systems, compatible for use with modular furniture systems.

SUMMARY

Disclosed are modular reclining furniture assemblies including a reclining mechanism configured to be selectively docked into an adjustable frame of the modular reclining furniture assembly. The modular reclining assembly includes a fixed lower carriage portion and an upper carriage portion that is selectively movable relative to the fixed lower carriage portion. The adjustable frame is reconfigurable, e.g., between a wide seating mode and a deep seating mode, and the reclining mechanism can be selectively docked into and connected to the adjustable frame in either the wide mode or the deep mode, as selected by a user. The upper carriage portion includes a footplate reclining arm attached to a footplate, and one or more actuators are provided for selectively moving (reclining) the upper carriage portion relative to the fixed lower carriage portion, and/or moving (reclining) the footplate reclining arm and footplate relative to a frame of the upper carriage portion. In an embodiment, the footplate can be selectively rotatable relative to the footplate reclining arm, e.g., so as to allow a user to position the footplate in a desired orientation relative to a desired portion of the user's body (e.g., to place the soles of their feet on the footplate, to rest their calves on the footplate, or otherwise), while rotating the footplate clockwise or counterclockwise, as desired, to achieve a desired interaction between a desired portion of the user's body and the footplate.

While principally described in the context of a modular reclining assembly that allows the user to select between a wide mode and a deep mode, based on a configuration where the seat associated with such a furniture assembly is a non-square rectangle, it will be appreciated that such adjustment between a wide and deep mode is not required. For example, the seat could have a square geometry, or could have a rectangular (non-square) geometry without providing such adjustability, but while providing other features and reclining features as described herein or in Applicant's earlier applications, already herein incorporated by reference. Such embodiments are within the scope of the present disclosure.

In some embodiments, the modular reclining assembly is compatible and connectable with Applicant's existing modular furniture systems, that do not necessarily provide a reclining functionality. Examples of such are described in U.S. Pat. Nos. 7,213,885; 7,419,220; 7,547,073; 7,963,612; 8,783,778; 9,277,826; 10,143,307; 10,154,733; 10,806,261; 10,123,621; 10,123,623; and 11,253,073, each herein incorporated by reference in its entirety. In an embodiment, such furniture systems include (i) a base member for providing a seating surface for a user; and (ii) an upright member configured to be used as a backrest and/or an armrest. Such modular furniture assemblies are highly advantageous, particularly in the dimensions which have a ratio of x=x'=y+z wherein x is the length of the base, x' is the length of a upright member and wherein y is the width of the base and z is the width (thickness) of the upright member. This x=x'=y+z relationship enables a variety of different furniture configurations to be formed, using only the components of the base and the upright member, as described in the above referenced U.S. patents owned by applicant.

In an embodiment, the presently disclosed modular reclining assemblies are configured to recline with "zero-wall clearance," meaning the reclining assembly can be placed up against, or in close proximity to, a back wall or other support and still allow a user to experience a full range of reclining.

An exemplary modular reclining assembly includes an adjustable frame, the adjustable frame having a wide mode and a deep mode. A reclining mechanism is also provided, having a fixed lower carriage portion to which a first actuator can be attached. An upper carriage portion can be linked to the first actuator, the upper carriage portion being selectively movable relative to the fixed lower carriage portion. A lifting member can be pivotally attached to the upper carriage portion. The reclining mechanism can advantageously be selectively docked into and connected to the adjustable frame in either the wide mode or the deep mode, as selected by the user. The upper carriage portion can include a footplate reclining arm attached to a footplate, and a second actuator can be attached to a frame of the upper carriage portion, where the second actuator is configured to selectively move the footplate reclining arm and footplate with respect to the frame of the upper carriage portion. The fixed lower carriage portion can include a ramp member on which the lifting member and the attached upper carriage portion ride, as driven by the first actuator. A lid defining a seat pan can be mounted on the lifting member and/or housing of the reclining mechanism. In operation, the first actuator moves the upper carriage portion (and lifting member) with respect to the fixed lower carriage portion, and the second actuator moves the footplate reclining arm and footplate with respect to the frame of the upper carriage portion. The movements provided by the actuators can be such that an initial movement of the first actuator causes a front portion of the lifting member to pivotally lift, away from the upper carriage portion, causing the front portion of the lifting member to lift above the footplate, allowing the footplate reclining arm to push the footplate towards an extended reclined position without interference from the lifting member (e.g., where such motion of the footplate reclining arm can be realized by actuation of the second actuator).

Another embodiment of the modular reclining assembly includes an adjustable frame, the adjustable frame having a wide mode and a deep mode, and a reclining mechanism having a fixed lower carriage portion to which a first actuator can be attached. An upper carriage portion can be linked to the first actuator, the upper carriage portion being selectively movable relative to the fixed lower carriage portion, the reclining mechanism being selectively docked into and connected to the adjustable frame, in either the wide mode or the deep mode. The upper carriage portion can include a footplate reclining arm attached to a footplate, and a second actuator can be attached to a frame of the upper carriage portion. The second actuator can be configured to selectively move the footplate reclining arm and footplate with respect to the frame of the upper carriage portion. A lid defining a seat pan can be mounted on the reclining mechanism. In operation, the first actuator can move the upper carriage portion with respect to the fixed lower carriage portion, and the second actuator can move the footplate reclining arm and footplate with respect to the frame of the upper carriage portion. Such movement can be such that an initial movement of the second actuator causes the footplate to move downward, towards the floor, allowing the footplate reclining arm to push the footplate towards an extended reclined position without interference from the lid or a cushion placed thereon.

In any of the described embodiments, the footplate can be spring-loaded with respect to the footplate reclining arm to which it is attached. For example, this can allow the footplate to assume a default neutral orientation (e.g., generally horizontal, such as generally parallel to a seating surface provided by the modular reclining assembly), but also allow a user to rotate the footplate either clockwise or counterclockwise, to orient the top surface of the footplate in a desired orientation, to accommodate the user. For example, a user can wish to rotate the footplate counterclockwise, and rest the soles of their feet on the footplate when using the reclining assembly, or simply rest their calves or legs on the footplate, with the footplate in its normal default orientation, or rotate the footplate clockwise, while resting their calves or another portion of their body on the footplate. A lock could be provided to hold the footplate in any desired orientation.

In an embodiment, the footplate can be spring-loaded in two different directions with respect to the recliner arm (e.g., so as to default to one orientation, but be spring-loaded to oppose movement in either rotational direction, away from such default orientation).

In any of the described embodiments, the footplate can assume or default to a substantially horizontal orientation when the reclining arm is in an extended position (e.g., absent any applied force to oppose such orientation). When the footplate is in a non-extended position, the footplate can assume a substantially vertical orientation (e.g., due to application of an applied force as the backside of the footplate contacts the adjustable frame, as it retracts to its "home" position).

In at least some of the described embodiments, a free front end of the lifting member can lift away from the footplate before or substantially simultaneous with the footplate being moved away from the frame of the upper carriage portion.

In at least some of the described embodiments, a ramp member of the fixed lower carriage portion can have an initial angled or ramped portion that enables a free front end of the lifting member to move away from the footplate (e.g., as a roller attached to the lifting member rolls up such a ramped surface).

In at least some of the described embodiments, the ramp member can include a substantially horizontal portion adjacent the initial angled portion.

In at least some of the described embodiments, a bracket can be provided, which attaches the lifting member to the fixed lower carriage portion. The bracket can be substantially T-shaped. A lower portion of the bracket can include a roller that rolls on an upper surface of the ramp member, and the ramp member can include a slot. The bracket can include a pin that rides within the slot of the ramp member. Such a configuration can cause the front end of the lifting member to lift up relative to the upper carriage portion (which can be sandwiched between the lower fixed carriage portion and the lifting member), as the first actuator pushes the upper carriage portion forward, causing the roller of the bracket attached to the lifting member to roll up the ramp. The inclusion of the pin associated with the bracket and the slot in the ramp can maintain the lifting member in a coupled relationship to the ramp of the fixed lower carriage portion, ensuring that a user lifting up on the ramp does not cause the lifting member to lift off the ramp.

In at least some of the described embodiments, the adjustable frame of the modular reclining assembly has one or more wheels attached thereto. For example, a pair of wheels can be provided along the rear end of the modular reclining assembly (e.g., attached to an underside of the fixed lower carriage portion), to allow a user to easily roll the modular reclining assembly into and out of the adjustable housing. Such can be accomplished without requiring the user to fully lift the modular reclining assembly off the floor, during docking and undocking from the adjustable frame. For example, a user can simply lift the front end up somewhat, allowing the rear end of the modular reclining assembly to rest on the floor (through such wheels), and then roll the modular reclining assembly either into or out of the adjustable frame, during docking or undocking. While wheels are principally shown, skids or a similar alternative could also be used.

In any of the described embodiments, the adjustable frame can include two sides connected by a rear portion, forming a generally U-shaped frame open at a front end (e.g., into which the reclining mechanism can be docked).

In any of the described embodiments, each of the sides and the rear portion can include first and second frame members that are selectively movable with respect to one another. The frame members can selectively form a first length corresponding to the wide mode, or a second length corresponding to the deep mode, depending on how the first and second frame members of each side (or rear portion) are adjusted relative to one another. By way of example, such frame members can have an overlapping arrangement, where when adjusted to provide more overlap, the rear or side assumes an overall shorter length, and where less overlap is provided, the rear or side assumes an overall longer length. In an embodiment, the first length corresponding to the wide mode is shorter than the second length corresponding to the deep mode. In an embodiment, frame members can be shared between a given side, and the rear portion. For example, a corner frame member can serve as both a frame member of the rear portion, and either the right or left side. The length of the rear portion and side portions can be adjusted by adjusting how much overlap is provided between the corner frame member, and the other frame member making up the rear portion or the sides.

In at least some of the described embodiments, a backrest can be provided that is selectively mountable into the lid, the backrest being insertable into the lid at a short end of the lid, or a wide end of the lid, depending on whether a user desired to use the deep mode or the wide mode.

In any of the described embodiments, the modular reclining assembly can be selectively coupleable to a non-reclining base member of a modular furniture system, either in a wide mode or a deep mode (e.g., selectively coupled to any of various modular furniture systems, such as those described in Applicant's earlier patents).

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals can be utilized to designate corresponding or similar parts in the various Figures, and the various elements depicted are not necessarily drawn to scale.

FIG. 17D shows that a person sitting in the reclined position can move the spring-loaded footplate such that the user can bend the user's knees toward the user, such that the user can place a laptop computer, for example, on the user's knees while reclining (which is also possible in the deep mode).

DETAILED DESCRIPTION

I. Introduction

Disclosed are modular reclining furniture assemblies including a reclining mechanism configured to be selectively docked into an adjustable frame of the modular reclining furniture assembly. The modular reclining assembly includes a fixed lower carriage portion and an upper carriage portion that is selectively movable relative to the fixed lower carriage portion. The adjustable frame is reconfigurable, e.g., between a wide seating mode and a deep seating mode, and the reclining mechanism can be selectively docked into and connected to the adjustable frame in either the wide mode or the deep mode, as selected by a user. The upper carriage portion includes a footplate reclining arm attached to a footplate, and one or more actuators are provided for selectively moving (reclining) the upper carriage portion relative to the fixed lower carriage portion, and/or moving (reclining) the footplate reclining arm and footplate relative to the fixed lower carriage portion and/or a frame of the upper carriage portion.

In an embodiment, the footplate can be selectively rotatable relative to the footplate reclining arm, e.g., so as to allow a user to position the footplate in any of several desired orientations relative to a desired portion of the user's body (e.g., to place the soles of the user's feet on the footplate, to rest the user's calves on the footplate, or arrangement, by rotating the footplate clockwise or counterclockwise relative to the footplate reclining arm, to achieve a desired interaction and orientation between a desired portion of the user's body and the top surface of the footplate.

While principally described in the context of a modular reclining assembly that allows the user to select between a wide mode and a deep mode, based on a configuration where the seat associated with such a furniture assembly is a rectangle that is non-square, it will be appreciated that the ability to adjust between a wide mode and deep mode is not required. For example, the seat could have a square geometry, or could have a rectangular (non-square) geometry (or even some other shape) without providing such adjustability, but while providing one or more reclining or other features as described herein or in Applicant's earlier applications, already herein incorporated by reference. Such embodiments are within the scope of the present disclosure.

II. Exemplary Modular Reclining Assemblies

Figure 1:
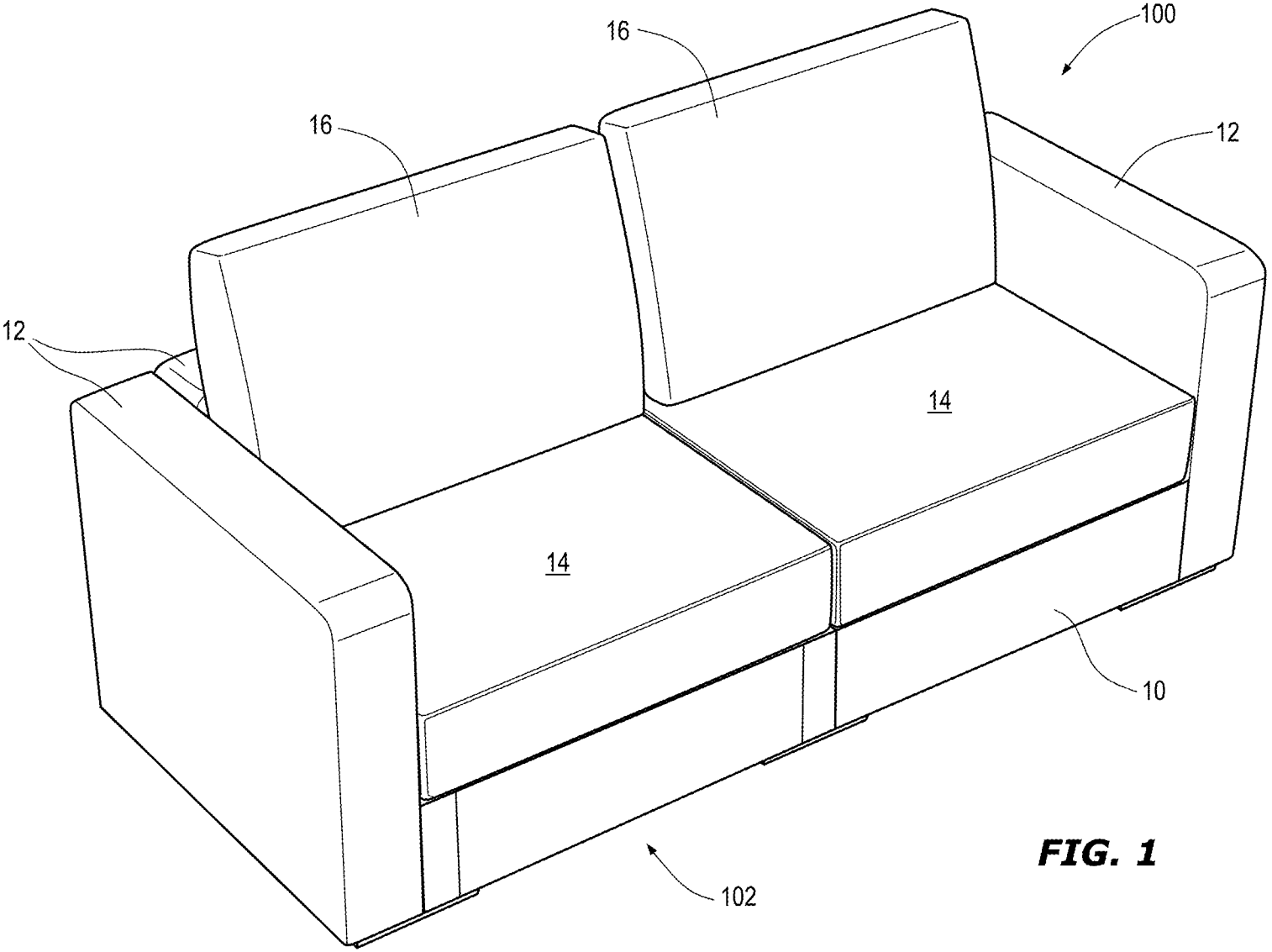
FIG. 1 is a perspective view of a modular furniture system of the present invention in a wide mode with a reclining assembly in a non-reclined position.

FIG. 1 is a perspective view of a modular furniture system 100 of the present invention in a wide mode with a reclining assembly 102 in a non-reclined position. The illustrated furniture system includes a non-reclining base 10, a plurality of upright members 12 serving as armrest and backrest members, coupled to the reclining assembly 102. Each seating position associated with base 10 and reclining assembly 102 is also provided with a seat cushion 14 and a backrest cushion 16. Such reclining assembly 102 is illustrated as having the same dimensions and footprint, and overall appearance as the adjacent non-reclining base 10, so as to provide a seamless integrated appearance, making it difficult if not impossible to tell which seat is capable of reclining, versus which seat is not. Of course, any number of seats (or all seats) in a given furniture system 100 could be provided by the described reclining assemblies, so as to provide a reclining functionality. Interchangeability of such a reclining assembly 102 with a standard base 10 is an advantage provided by at least some embodiments of the present invention.

Figure 2:
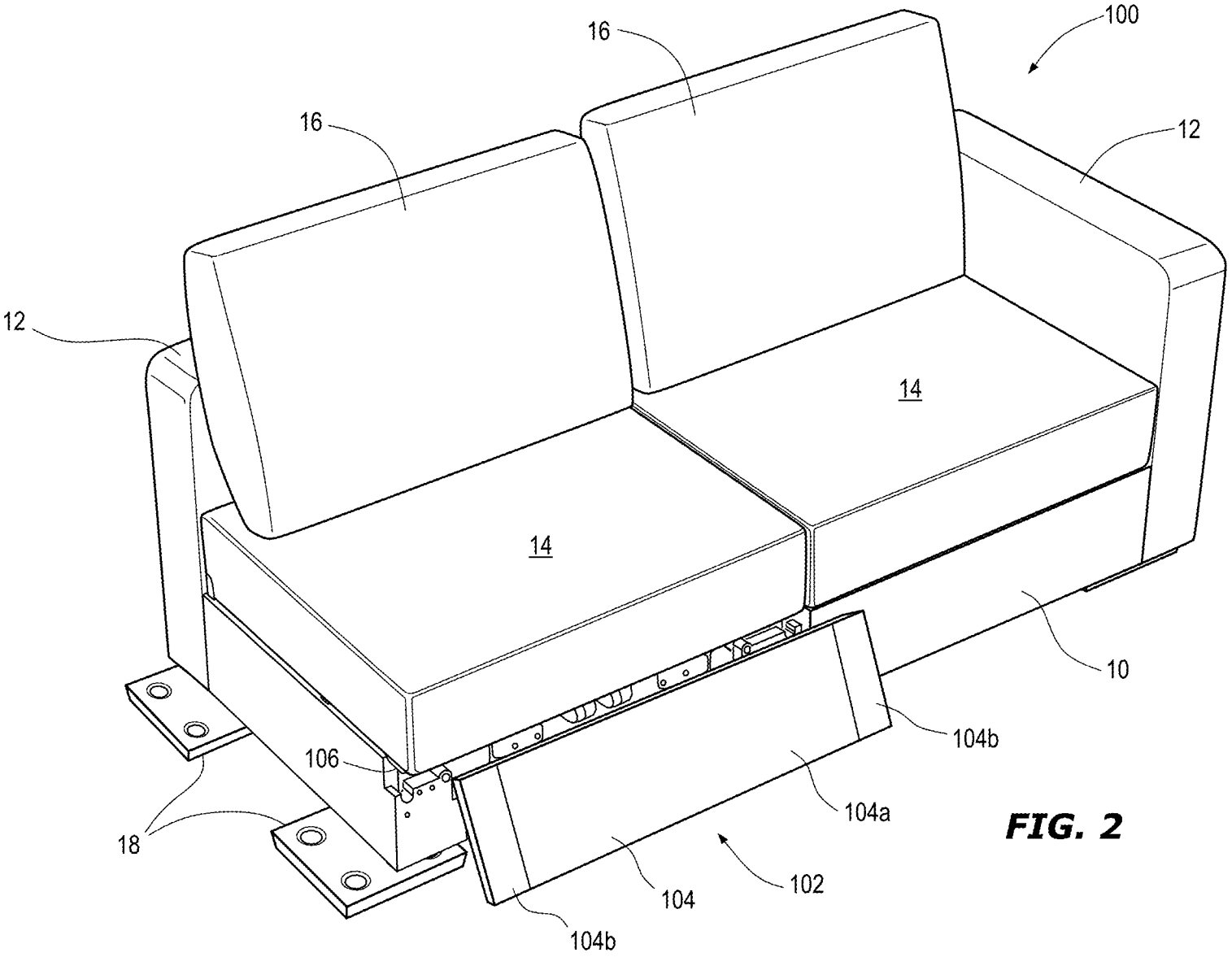
FIG. 2 is a perspective view of the modular furniture system of FIG. 1 in a wide mode with the reclining assembly in a partially reclined position.

FIG. 2 is a perspective view of the modular furniture system 100 of FIG. 1 in a wide mode with the reclining assembly 102 in a partially reclined position. As shown, the footplate 104 is shown partially extended. As is apparent from FIG. 2, in the illustrated wide mode, the footplate 104 can include two or more segments, attachable together, as when converting from the wide mode to the deep mode, the length of the footplate is shortened. Such can be accomplished by providing multiple segments (e.g., 104*a* and 104*b*), to allow a user to adjust the length of the footplate 104, depending on the selected mode (wide mode versus deep mode, which has a shorter footplate length). In the illustrated configuration, two segments 104*b* are shown, attachable on both ends of the main footplate segment 104*a*, giving the overall footplate 104 a length that is substantially equal to the length of adjacent base 10, also oriented in the wide mode. As will be shown in later Figures, when converting to the deep mode, segments 104*b* can simply be detached from main segment 104*a*, resulting in a footplate that has a length substantially equal to the width of a base 10 oriented in the deep mode. While not limited to such, in an embodiment, the base 10 can have dimensions of 29 inches by 35 inches. It will be appreciated that a wide variety of other dimensions are possible. In some embodiments, as described in Applicant's patents already incorporated by reference, the base and upright member can have a dimensional relationship where $x=x'=y+z$ wherein x is the length of the base 10, x' is the length of the upright member 12, y is the width of the base 10 and z is the width (thickness) of the upright member 12. Of course, other dimensional relationships can also be used, that are not necessarily limited to $x=x'=y+z$.

While an adjustable footplate 104 is shown (e.g., including segments that can be selectively attached or detached to provide the desired footplate length), it will be apparent that a single footplate of a given length, or multiple footplates of different lengths can alternatively be provided, allowing the user to interchange any of a variety of provided footplates.

FIG. 2 also illustrates shoes 18 which can be used to couple feet of the bases or reclining assemblies to corresponding feet of the upright members. Such coupling arrangements can be such as those described in applicant's earlier patents, already incorporated by reference. While coupling shoes are shown, it will be appreciated that no such coupling is required, although can certainly be included, where desired.

Figure 3:
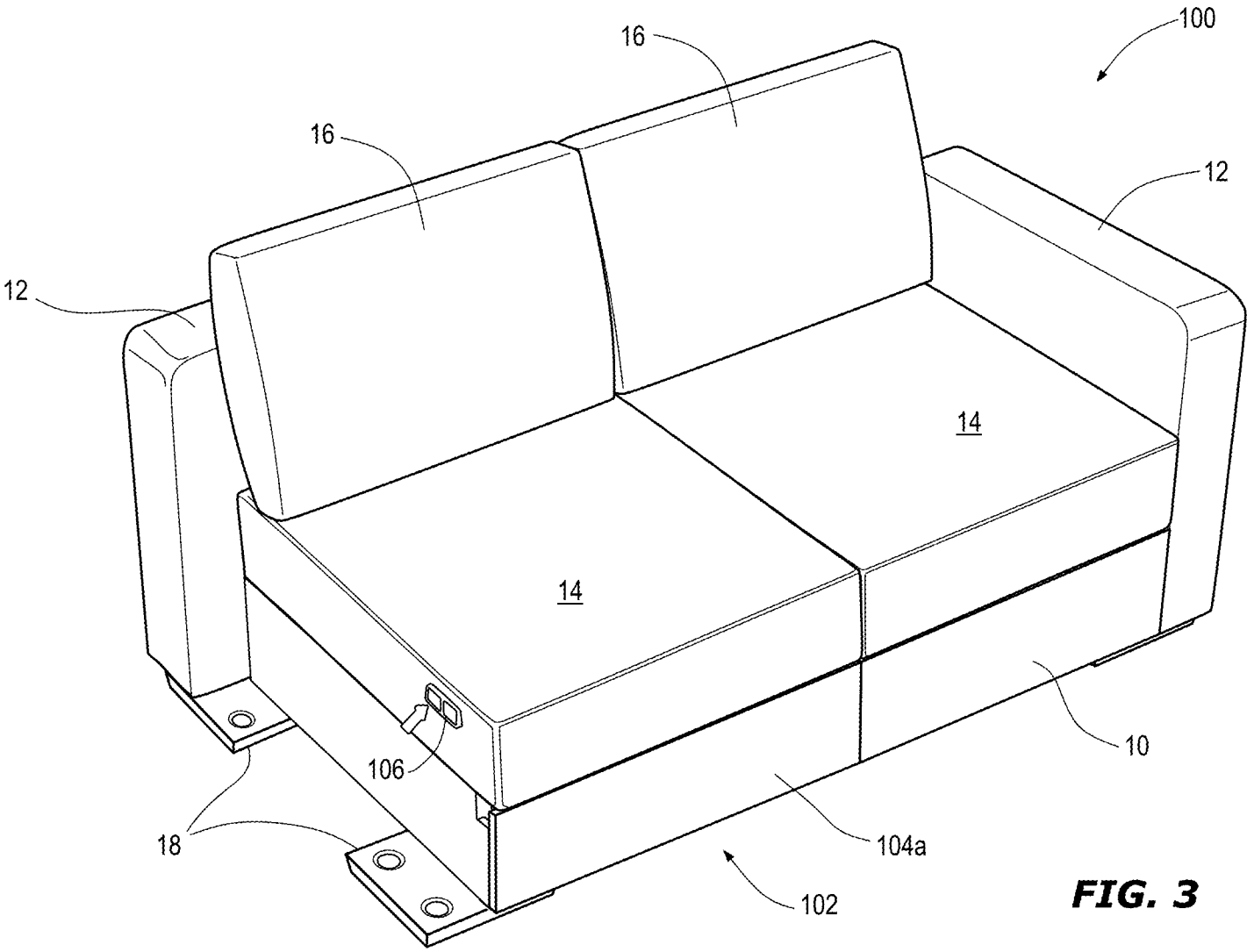
FIG. 3 is a perspective view of the modular furniture system of FIGS. 1 and 2 having been moved into a deep mode with the reclining assembly in a non-reclined position.

FIG. 3 is a perspective view of the modular furniture system 100 of FIGS. 1 and 2 having been moved into a deep mode with the reclining assembly 102 in a non-reclined position. Also visible in FIG. 3, is a remote control 106 that can be coupleable (e.g., using magnets) to seat cushion 14, for controlling movement of the reclining mechanism within reclining assembly 102. For example, magnets in or on the cover or the materials forming the cushioning material of the seat cushion can be used to couple the remote control 106 to the seat cushion 14 or other portion of a furniture system. As seen in FIG. 3, the footplate is now narrower than footplate 104 of FIGS. 1-2, because of the adjustment from wide to deep mode. In particular, in the illustrated embodiment, footplate 104 has a length equal to segment 104*a* (e.g., segments 104*b* on either side have been removed). It will be apparent that the footplate in either configuration forms and covers the bottom front portion of the adjustable frame of the reclining assembly 102, providing an appearance that is similar if not identical to the bottom front portion of adjacent non-reclining base 10, when the reclining assembly is in a non-reclined position.

Figure 4:
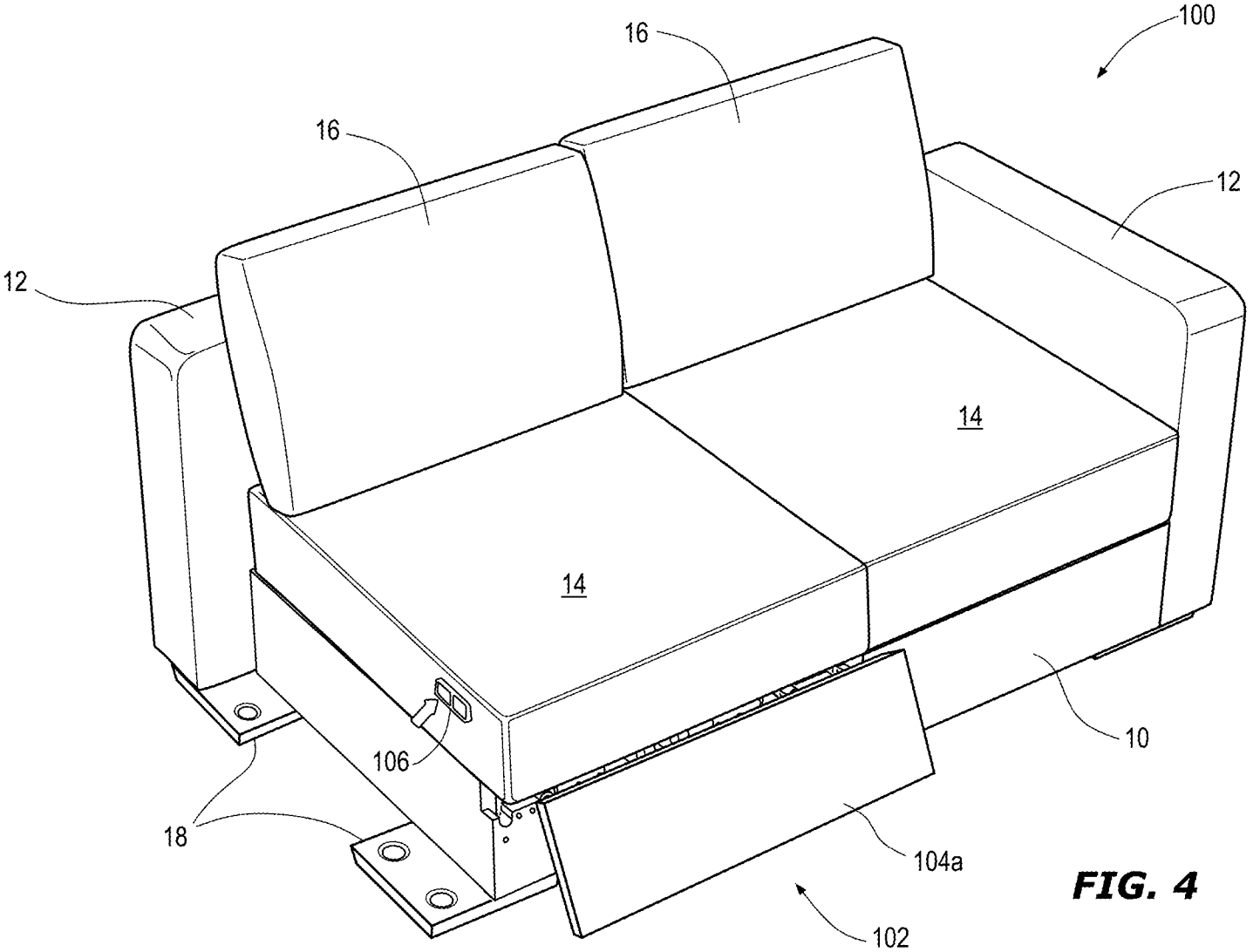
FIG. 4 is a perspective view of the modular furniture system of FIG. 3 in a deep mode with the reclining assembly in a partially-reclined position.

FIG. 4 is a perspective view of the modular furniture system of FIG. 3 in a deep mode with the reclining assembly in a partially-reclined position. This figure shows how the footplate 104*a* can be extended forward and upward, relative to the reclining mechanism included within reclining assembly 102. The ability to convert the reclining assembly, from the wide mode shown in FIG. 1-2, to the deep mode shown in FIGS. 2-3, and have the reclining functionality available in either configuration, is particularly advantageous, providing increased flexibility to a user of modular furniture, allowing them to reconfigure their modular furniture system, and include one or more seats providing reclining functionality, without regard to how such seats are oriented in the modular furniture system (e.g., deep versus wide).

Figure 5B:
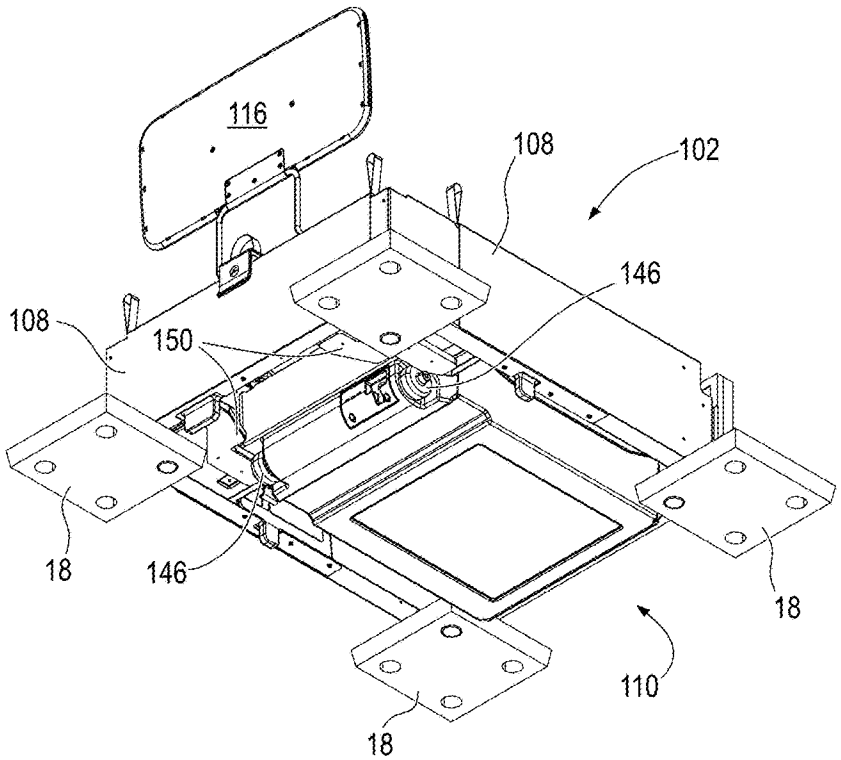
FIGS. 5A-5B show the reclining assembly of FIGS. 1-4, with the seat cushions removed, from top and bottom perspective views, respectively.
Figure 5A:
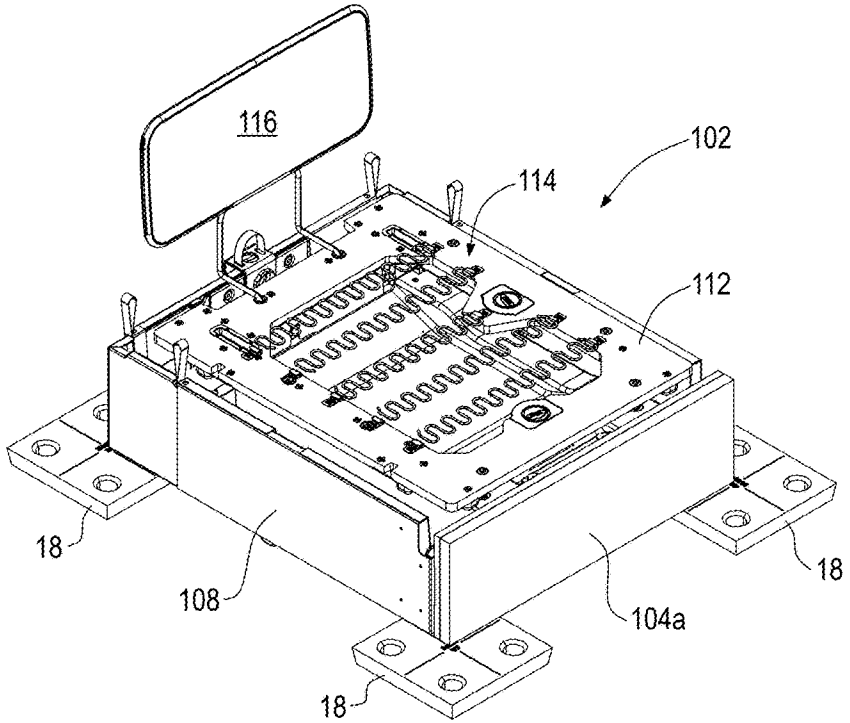

FIGS. 5A-5B show the reclining assembly 102 of FIGS. 1-4, with the seat cushions removed, from top and bottom perspective views, respectively, shown in the deep mode of FIGS. 3-4. Modular reclining assembly 102 is shown as including an adjustable frame 108, a reclining mechanism 110, and a lid 112 that defines a seat pan 114, with a backrest 116 received into the short end of the lid 112. Reclining mechanism 110 is movably received (e.g., rolls) into an open front end of adjustable frame 108.

As will be explained and shown in further detail in following figures, reclining mechanism 110 includes a fixed lower carriage portion, an upper carriage portion, and a lifting member pivotally attached to a frame of the upper carriage portion. The reclining mechanism 110 is selectively dockable into the adjustable frame 108, in either the wide mode, or the deep mode.

Figure 6A:
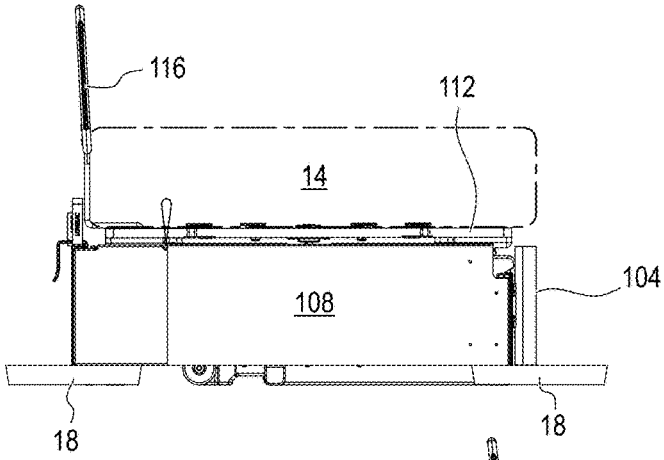
FIGS. 6A-6D illustrate a progression of the reclining assembly of FIGS. 5A-5B, showing a progression of the reclining assembly from non-reclined (FIG. 6A), to preparing to recline by lifting the seat lid and cushion (FIG. 6B), to partially reclined (FIG. 6C), to fully reclined (FIG. 6D).
Figure 6B:
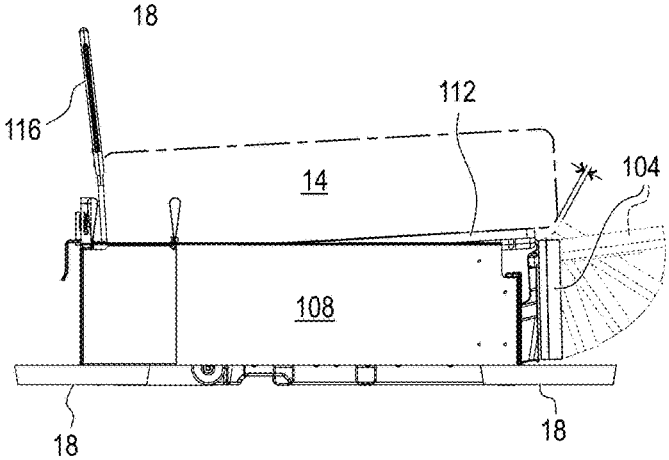
Figure 6C:
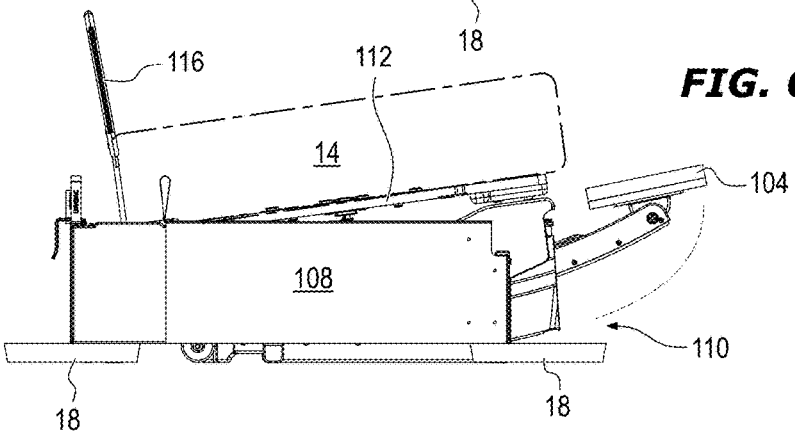
Figure 6D:
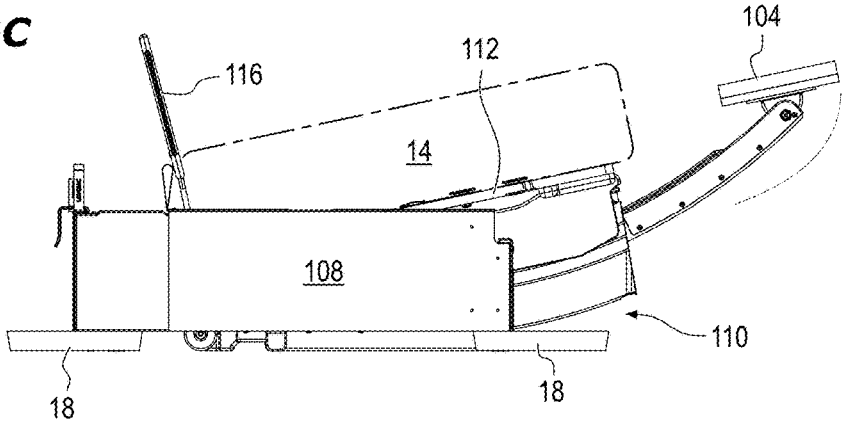

FIGS. 6A-6D illustrate a progression of the reclining assembly 102 of FIGS. 5A-5B, showing a progression of the reclining assembly from non-reclined (FIG. 6A), to preparing to recline by lifting the seat lid 112 and cushion 14 (FIG. 6B), to partially reclined (FIG. 6C), to fully reclined (FIG. 6D). The lifting of the seat lid 112 and cushion 14, prior to moving the footplate 104 from its non-reclined home position can be beneficial, as there can otherwise be interfering contact between the footplate 104, as it leaves its docked home position, and begins to extend outward. This can particularly be so given the oversized nature of many cushions 14, as well as downward compression of such cushion 14, due to a user being seated thereon. A slight inclined movement upward of the seat lid 112 as shown, before allowing the footplate to begin its extension movement can be helpful to minimize or prevent wear that can otherwise result, due to interfering contact that can otherwise occur.

Such a sequence of movement can also be important where the footplate 104 is configured and intended to provide a seamless appearance, identical or substantially identical to a non-reclining adjacent seat base, when in the non-reclined position. In other words, when desiring to achieve such an appearance, it can be undesirable to size the footplate to be smaller, to allow for clearance during movement of the footplate during its extension movement. The relatively larger, full size footplate provides an esthetic appearance substantially identical to an adjacent otherwise similar, non-reclining seat.

Also apparent in FIGS. 6A-6D is how the footplate 104 can be in a vertical orientation when in the "home" non-reclined position (FIG. 6A), but once the footplate clears the front portion of the upper carriage portion of reclining mechanism 110, it can automatically assume a generally horizontal position, e.g., defining a top surface that is generally parallel to that provided by the top seat surface of cushion 14. As will be explained in further detail below, footplate 104 can be spring-loaded, to default to the illustrated generally horizontal, neutral orientation. Application of force to the footplate 104 (e.g., as applied by contact of the upper carriage portion, the lower carriage portion of reclining mechanism 110, or frame 108 with the rear face of footplate 104) can cause the footplate to deviate from such default orientation.

Figure 7A:
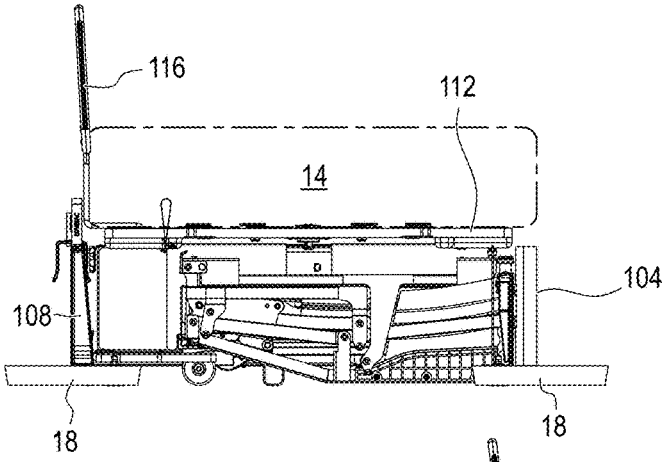
FIGS. 7A-7D illustrate another view of the progression of the reclining assembly of FIGS. 5A-6D with portions of the adjustable frame removed for illustrative purposes, showing a progression of the reclining assembly from non-reclined (FIG. 7A), to preparing to recline by lifting the seat lid and cushion (FIG. 7B), to partially reclined (FIG. 7C), to fully reclined (FIG. 7D).
Figure 7B:
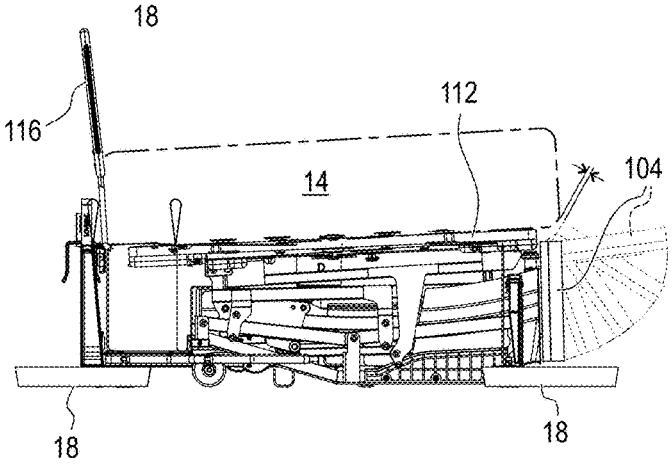
Figure 7C:
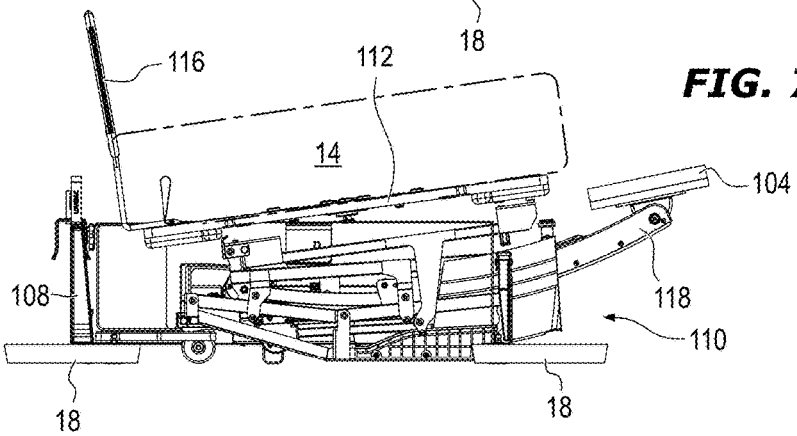
Figure 7D:
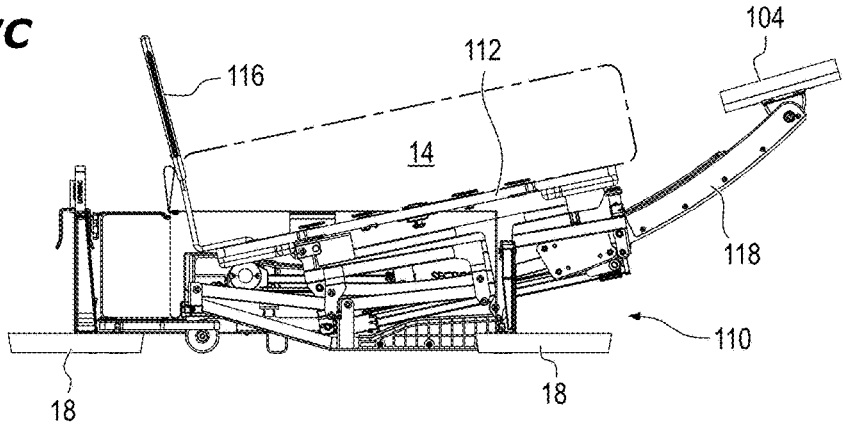

FIGS. 7A-7D illustrate another view of the progression of the reclining assembly of FIGS. 5A-6D with portions of the adjustable frame 108 removed for illustrative purposes, showing a progression of the reclining assembly 102 from non-reclined (FIG. 7A), to preparing to recline by lifting the seat lid 112 and cushion 14 (FIG. 7B), to partially reclined (FIG. 7C), to fully reclined (FIG. 7D).

Figure 8B:
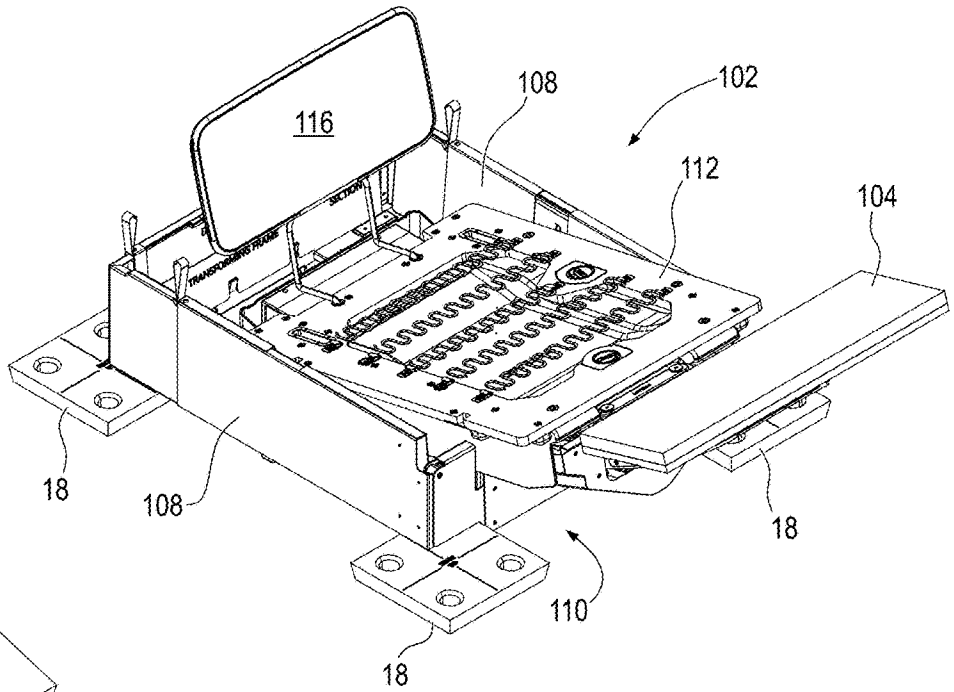
FIGS. 8A-8B further show the reclining assembly of FIGS. 5A-7D, showing a partially reclined and a fully reclined view, respectively.
Figure 8A:
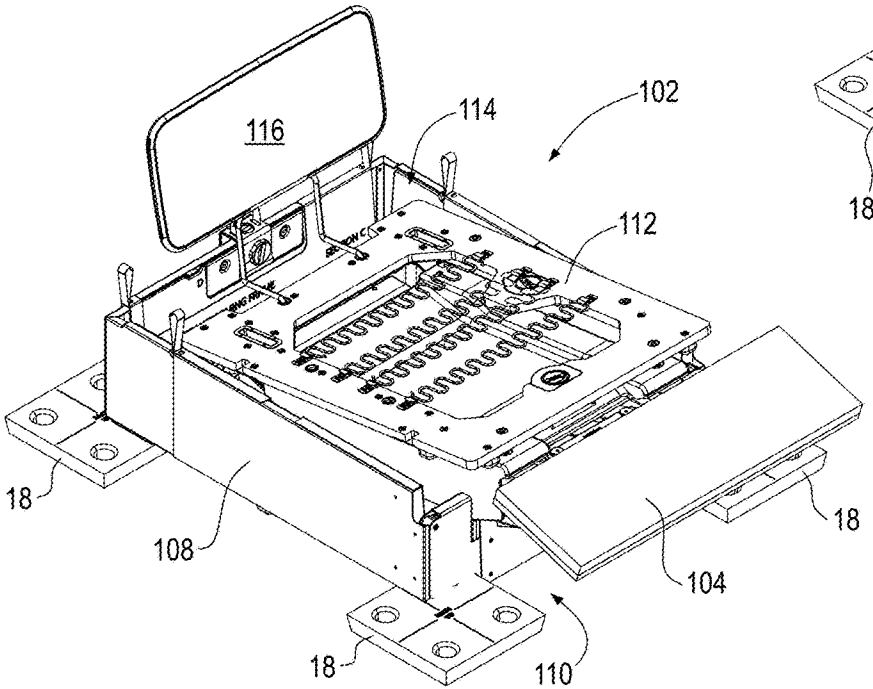

The illustrated progression of movement can be such that the seat lid 112 is first raised up at the front end, so as to provide the desired clearance relative to footplate 104, and once sufficient clearance is provided, a footplate reclining arm 118 associated with the upper carriage of the reclining mechanism can begin to drive forward, extending footplate 104 outward as shown. FIGS. 8A-8B further show the reclining assembly of FIGS. 5A-7D, showing a partially reclined and a fully reclined view, respectively.

Figure 9B:
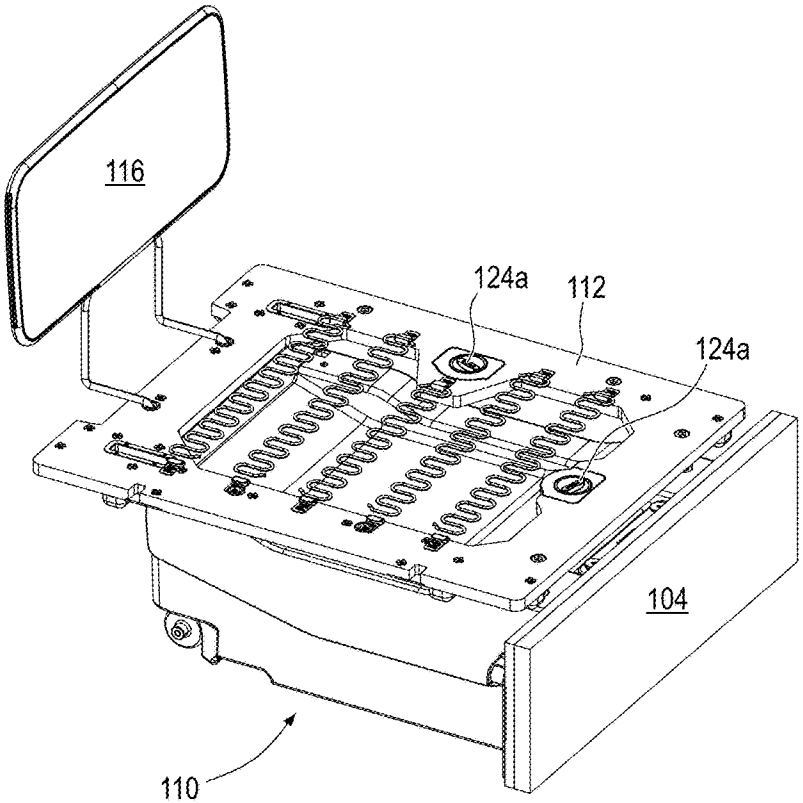
FIGS. 9A-9B show, respectively, the seat lid and backrest exploded above, then mounted on, the reclining mechanism of the reclining assembly of FIGS. 5A-8B.
Figure 9A:
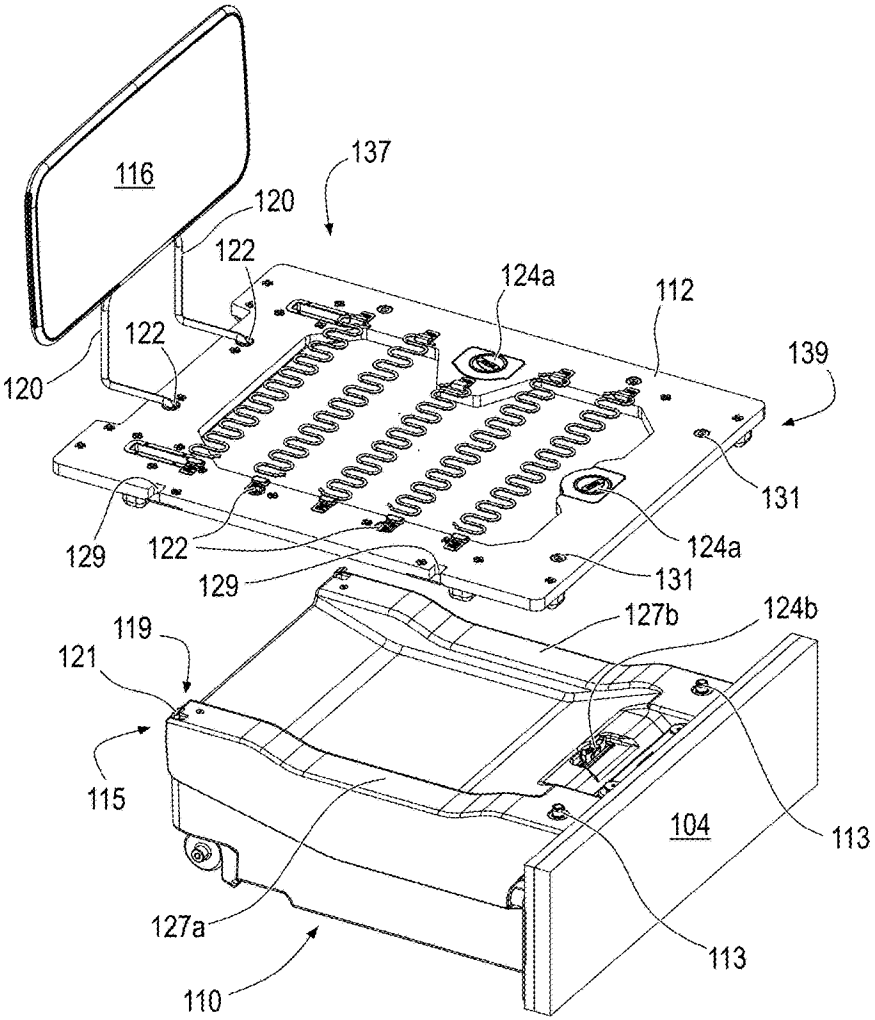

FIGS. 9A-9B show, respectively, the seat lid 112 and backrest 116 exploded above, then mounted on, the reclining mechanism 110 of the reclining assembly 102 of FIGS. 5A-8B. As shown, backrest 116 can include one or more mounting rods 120 which are selectively received into corresponding holes 122 in either a short end (for deep mode) or a long end (for wide mode) of lid 112. Lid 112 is also shown as including a connection mechanism 124*a*, which couples into a corresponding connection mechanism 124*b* provided in reclining mechanism 110, in order to secure lid 112 to reclining mechanism 110. Additionally, a rear connecting mechanism 115 and a forward connecting mechanism 113 aid with coupling the lid 112 to an exterior housing 126 of the reclining mechanism 110. As shown, lid 112 can include two such connection mechanisms 124*a*, one for use when orienting the lid 112 over reclining mechanism 110 for use of the deep mode, and the other for use when orienting the lid 112 over reclining mechanism 110 for use in the wide mode.

The ability to provide a single reclining mechanism 110, as well as a single lid providing the seat pan, that can convert, and be used within both a deep mode and a wide mode is advantageous.

Figure 10B:
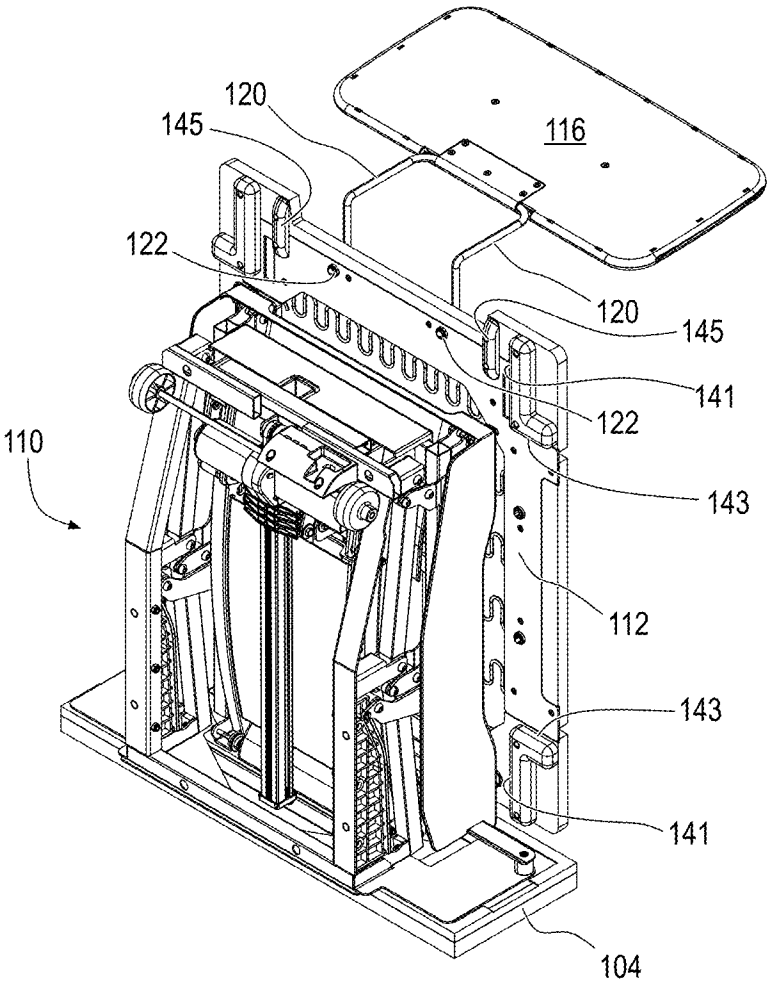
FIGS. 10A-10B show a bottom perspective view showing the seat lid mounted on the reclining mechanism of the reclining assembly of FIGS. 5A-9B with FIG. 10A showing an exterior housing and further showing in FIG. 10B a view with the bottom housing removed.
Figure 10A:
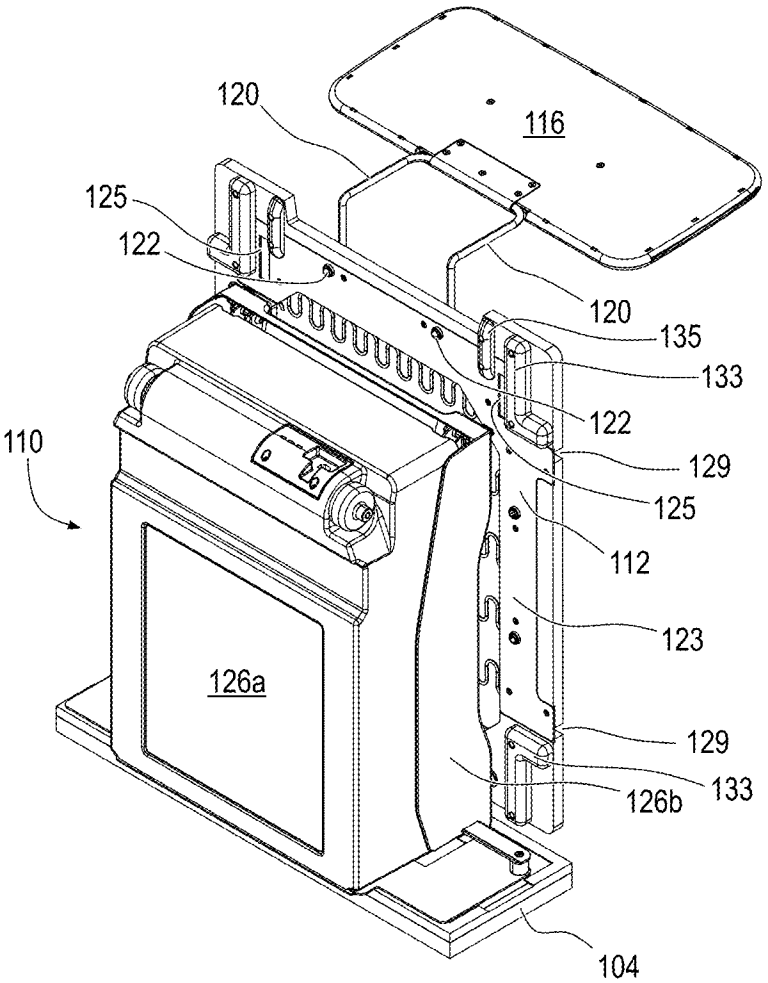

FIGS. 10A-10B show a bottom perspective view showing the seat lid 112 mounted on the reclining mechanism 110 of the reclining assembly 102 of FIGS. 5A-9B with FIG. 10A showing an exterior housing 126 of reclining mechanism and further showing in FIG. 10B a view with the bottom exterior housing 126*a* removed. Exterior housing 126 can include two portions, a lower and upper portion 126*a* and 126*b* respectively, to accommodate the lifting movement that occurs within the reclining mechanism 110, associated with the initial lifting movement of the lifting member 156 and seat lid 112 as described herein.

With reference to FIGS. 9A-10B, the exterior housing 126 includes raised portions 127*a*, 127*b* which accommodate interior mechanisms and structures of the reclining mechanism 110. The lid 112 can slide along the raised portions 127*a*, 127*b* so that the lid 112 can be received by the rear connecting mechanism 115 and then the forward connecting mechanism 113. Once in place, the connection mechanism 124*a* can be used to secure the lid 112 to the connection mechanism 124*b* provided in the reclining mechanism 110.

The rear connecting mechanism 115 can anchor a portion of the lid 112 within a gap 119 formed between a hook-like member 121 and the exterior housing 126. For instance, the lid 112 includes a securing plate 123 that has a recess 125 and that extends and overlaps a notch 129 in a side of the lid 112. The rear connecting mechanism 115 can be received in the recess 125 in deep mode and in the notch 129 to couple with the securing plate 123 in wide mode. The hook-like member 121 limits upward vertical movement and also aids with positioning the lid 112 in relation to the reclining mechanism 110 and adjustable frame 108. For instance, the rear connecting mechanism 115 can function as a stop to the placement of the lid 112 in relation to the adjustable frame 108.

The lid 112 also includes holes 131 that receive the forward connecting mechanism 113, such as posts or other structures complementary to the holes 131 so that a frictional or interference fit between an interior bore of the holes 131 and the posts of the forward connecting mechanism 113 creates a releasable connection between lid 112 and exterior housing 126. It will be understood that the holes and post connection can be reversed so that the holes 113 or other anchoring structure, can be formed in the exterior housing 126 and the posts (e.g., forward connecting mechanism 113).

To also aid with placement of the lid 112 on the exterior housing 126, the lid 112 includes a first guide 133 and a second guide 135. The first guide 133 aids with aligning the lids 112 on the exterior housing 126 so that the lid 112 cooperates with the forward connecting mechanism 113, the rear connecting mechanism 115, and the connection mechanism 124*a*, 124*b*. For instance, 127*a*, 127*b* can slide along surfaces of the first guide 133 to position the lid 112 to engage with the rear connecting mechanism 115 in both the wide mode and the deep mode. When positioning the lid 112 in deep mode, the second guide 135 raises a leading edge of the lid 112 to prevent inadvertent catching on the forward connecting mechanism 113 and aids with positioning the rear connecting mechanism 115 within the recess 125. As illustrated in FIGS. 10A, for instance, the second guide 135 has a length shorter than the first guide 133 and has a terminal end positioned near a beginning of the recess 125 so that as the second guides 135 ride or slide along top surface of the raised portions 127*a*, 127*b* the second guides 135 prevent the rear connecting mechanism 115 entering the recesses 125. Once an end of the raised portions 127*a*, 127*b*, and more generally the exterior housing 126, pass an end of the second guides 135, the lid 112 can drop towards the raised portions 127*a*, 127*b* so that the rear connecting mechanism 115 can be received within the recesses 125. This simplifies the user experience with attaching the lid 112 to the exterior housing 126 through the first and second guides 133, 135 aiding with positioning the lid 112 in a desired position in relation to the overall system.

As illustrated, a first end 137 of the lid 112 having the recess 125 to receive the rear connecting mechanism 115 includes both the first guide 133 and the second guide 135, while a second end 139 of the lid 112 having holes 131 to receive the forward connecting mechanism 113 includes the first guide 133. The first guide 133 has a generally L-shaped body with a first height, a first sliding surface 141, and a second sliding surface 143, while the second guide 135 has a second height less than the first height and has a third sliding surface 145 that can slide along the top surface of the raised portions 127*a*, 127*b* as mentioned above. A distance between the first sliding surfaces 141 of two first guides 133 at the first end 137 and a distance between the first sliding surfaces 141 of two first guides 133 at the second end 139 each approximates a distance between outer surface of the raised portions 127*a*, 127*b* to aid with the movement described above. For instance, the first sliding surfaces 141 of the two first guides 133 at the first end 137 are separated by a distance approximating the distance between outer surface of the raised portions 127*a*, 127*b*. This allows the exterior housing 126 to be disposed between the first guides 133 in the deep mode. Similarly, a distance between the second sliding surfaces 143 of one of the first guides 133 at the first end 137 and one of the first guides 133 at the second end 139 approximate the distance between outer surfaces of the raised portions 127*a*, 127*b*. This allows the exterior housing 126 to be disposed between the first guides 133 and have the raised portions 127*a*, 127*b* contact the second sliding surfaces 143 in the wide mode.

Figure 11:
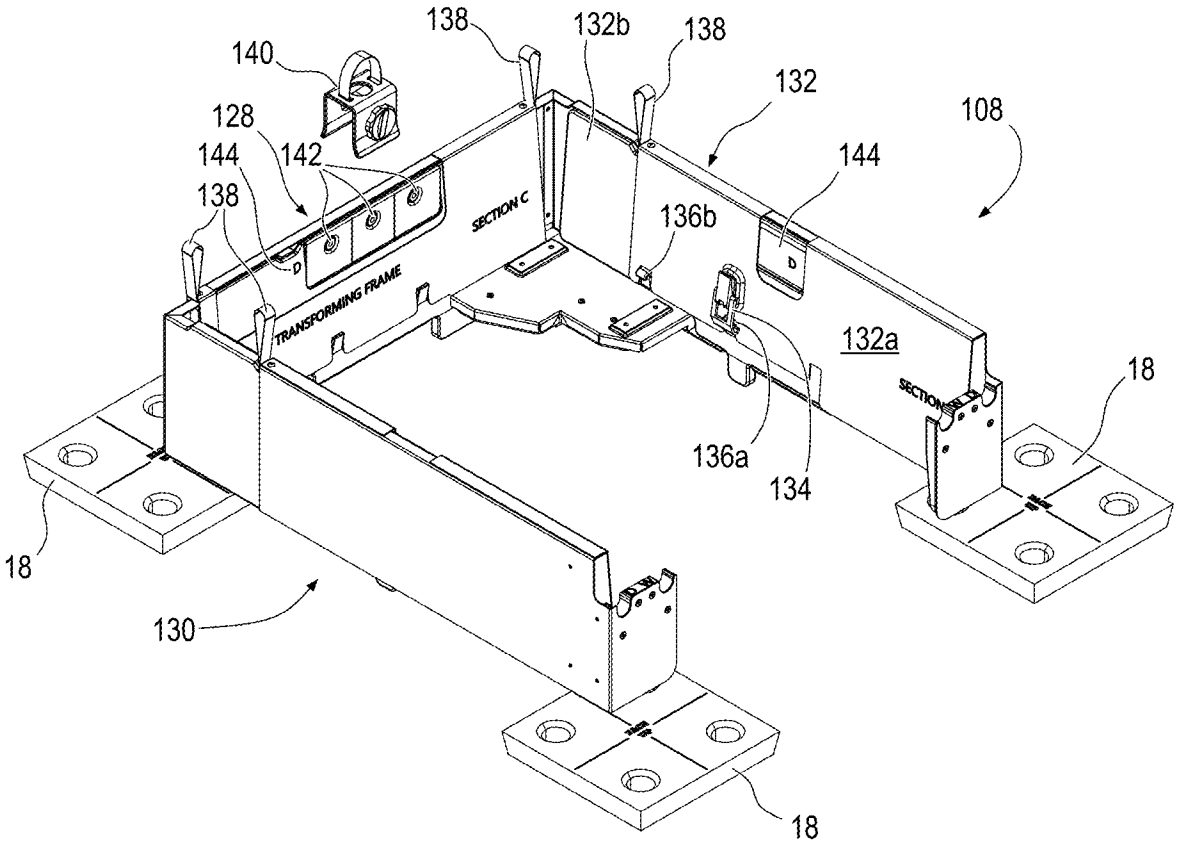
FIG. 11 shows an adjustable frame of the reclining assembly of FIGS. 5A-10B, the adjustable frame being shown in the deep mode.

FIG. 11 shows the adjustable frame 108 of the reclining assembly of FIGS. 5A-10B, the adjustable frame 108 being shown in the deep mode. As shown, adjustable frame 108 can include a rear portion 128 and two side portions 130, 132. The rear portion 128 and side portions 130, 132 can be adjusted in length. In the deep mode shown, the rear portion has been adjusted to assume a relatively shorter length, while the side portions 130, 132 have been adjusted to assume a relatively longer length. When converting from the deep mode to the wide mode, the rear portion can be lengthened, and the side portions can be shortened, to achieve the desired dimensions. Any of a wide variety of mechanisms can be used to achieve such. In an embodiment, the side portions and rear portions are formed from first and second frame members, which are selectively movable with respect to one another, to form a length that corresponds to the desired mode (e.g., wide or deep). In an embodiment, the first and second frame members have an overlapping arrangement, where more overlap can be provided, to assume a configuration with a relatively shorter length for the given side or rear portion, and where less overlap is provided, a relatively longer length for the given side or rear portion is provided.

Clasps or other securing mechanisms can be provided for holding the first and second frame members associated with any given side or rear portion in the desired arrangement. In the illustrated configuration, clasp 134 is engaged with a corresponding hook 136*a*. When desiring to change the seat mode from deep to wide, the overlapping frame member 132*a* can be unclasped from hook 136*a* of frame member 132*b*, and slid rearward, shortening side 132 (to have the length for a wide configuration seat), and clasp 134 can be engaged with hook 136*b*. Side 130 can operate similarly, to adjust the length of side 130. Handles 138 can be provided with each frame member, to facilitate easy adjustment, from one seating mode to another.

Rear frame portion 128 could be similarly configured as described relative to the side frame portions, although FIG. 11 shows a configuration where the latching mechanism is somewhat different. Rear frame portion similarly includes overlapping frame portions, but once the desired degree of overlap between the rear frame members is achieved, a clamp 140 is pressed downward, pinching and holding the two frame members of frame 108 together, with frame 108 clamped against an upright member (e.g., a backrest as shown in FIGS. 3-4) or other furniture member of a modular furniture assembly. The illustrated clamp 140 is further illustrated as including a threaded member, e.g., a thumb screw, which engages into a threaded bore 142 in frame 108, to hold the rear frame members of frame 108 in place. Such an added threaded member ensures that the clamp 140 is not prone to loosening over time, e.g., after repeated reclining movements. The threaded member of clamp 140 thus also assists in retaining a backrest, such as illustrated in FIGS. 3-4 for example, against frame 108. The threaded thumb screw of clamp 140 threads through a leg of clamp 140 into frame 108.

The adjustable frame 108 can include indicia 144, which indicate to the user what mode a given positioning of frame members corresponds to (e.g., D for Deep, W for Wide, or the like). Such indicia can be visible when a given mode is selected, and hidden when not selected, making the experience of achieving such adjustments more intuitive for the user.

Figure 12:
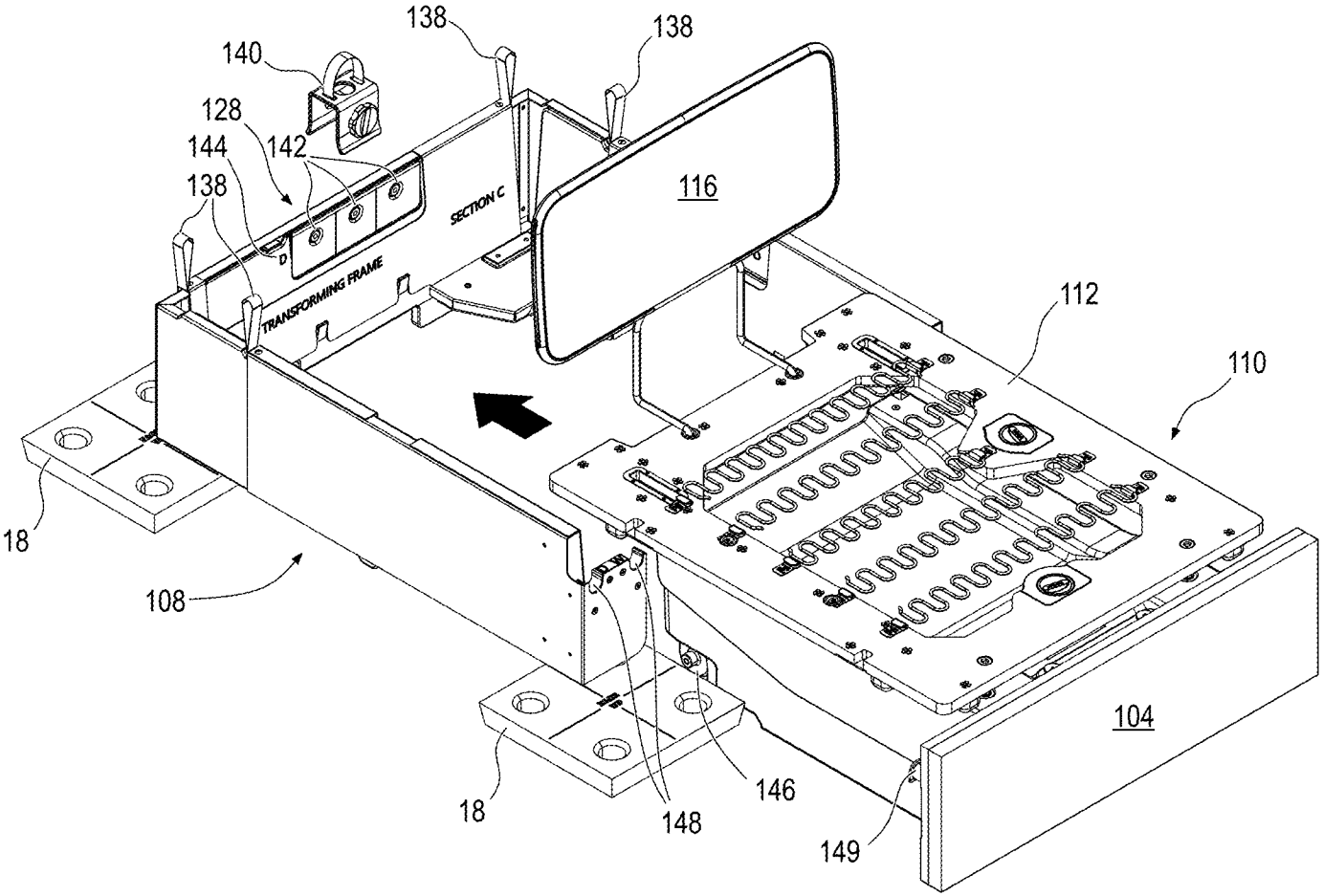
FIG. 12 shows the adjustable frame of the reclining assembly of FIGS. 5A-11 with the reclining mechanism being selectively moved, e.g., rolled into the frame to form a deep mode reclining assembly.

FIG. 12 shows the adjustable frame 108 of the reclining assembly 102 of FIGS. 5A-11 with the reclining mechanism 110 being selectively moved, e.g., rolled into the frame 108 to form a deep mode reclining assembly 102. Such docking can be very simple, without requiring the user to fully lift the reclining mechanism off the floor, e.g., a user can simply elevate a front end of the reclining mechanism 110 somewhat upwards, off the floor, with the wheels 146 of mechanism 110 at the rear of the reclining mechanism 110 contacting the floor, and simply roll the reclining mechanism rearward, into the open front of generally U-shaped adjustable frame 108.

Simple docking mechanisms can be provided, to secure reclining mechanism 110 within adjustable frame 108. For example, protrusions 149 on reclining mechanism 110 can be received within illustrated grooves 148. A rear end of lid 112 can similarly engage in a docking relationship with a portion of frame 108, adjacent rear portion 128, or the like. It will be apparent that various docking mechanisms are possible, to hold the stationary portion of reclining mechanism 110 securely in place, coupled to frame 108, once docked.

Figures 13A, 13B:
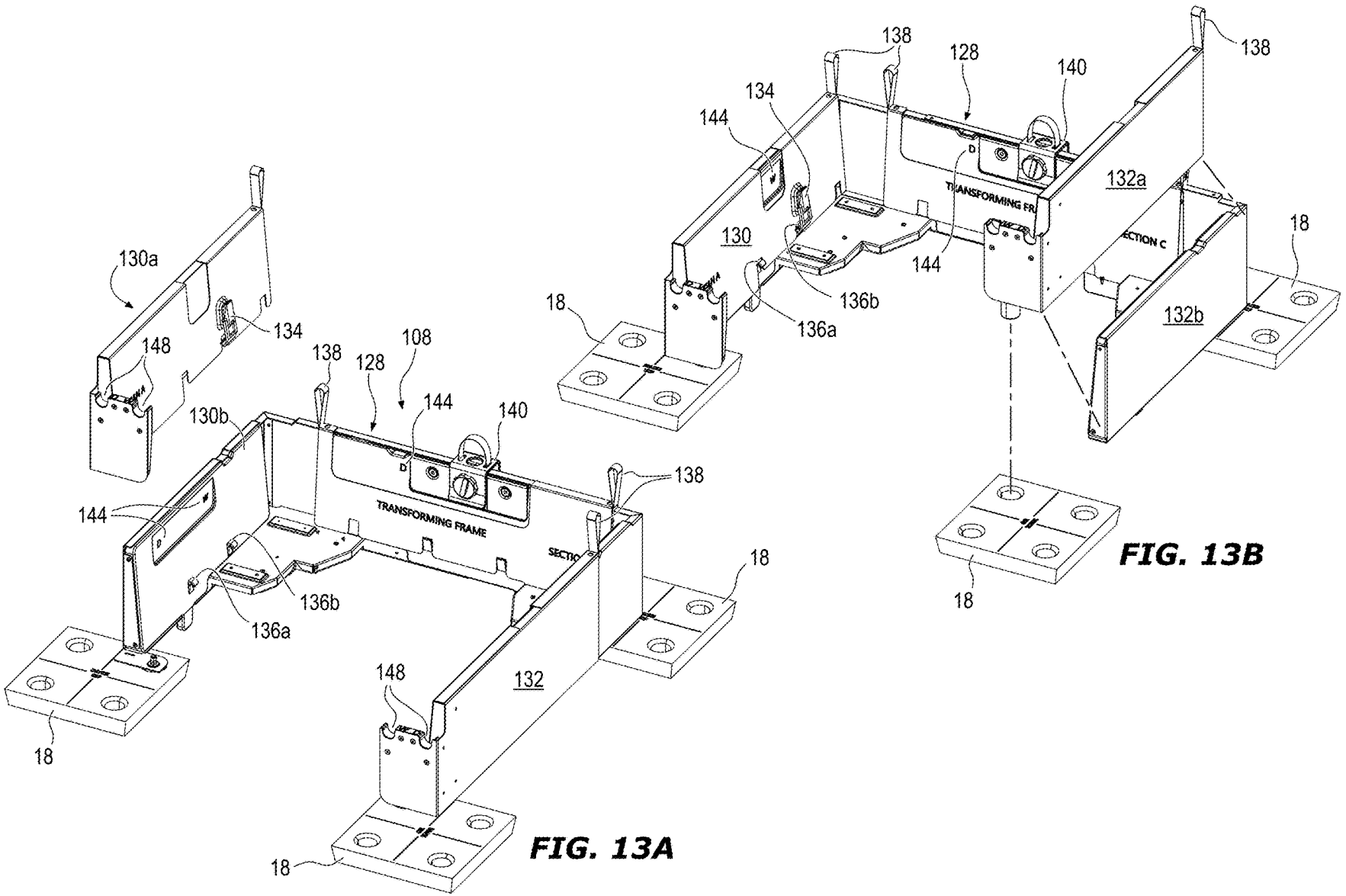
FIGS. 13A-13B show the adjustable frame of the reclining assembly of FIGS. 5A-12 being converted from the deep mode reflected in FIG. 11 to the wide mode reflected in FIG. 14.
Figure 14:
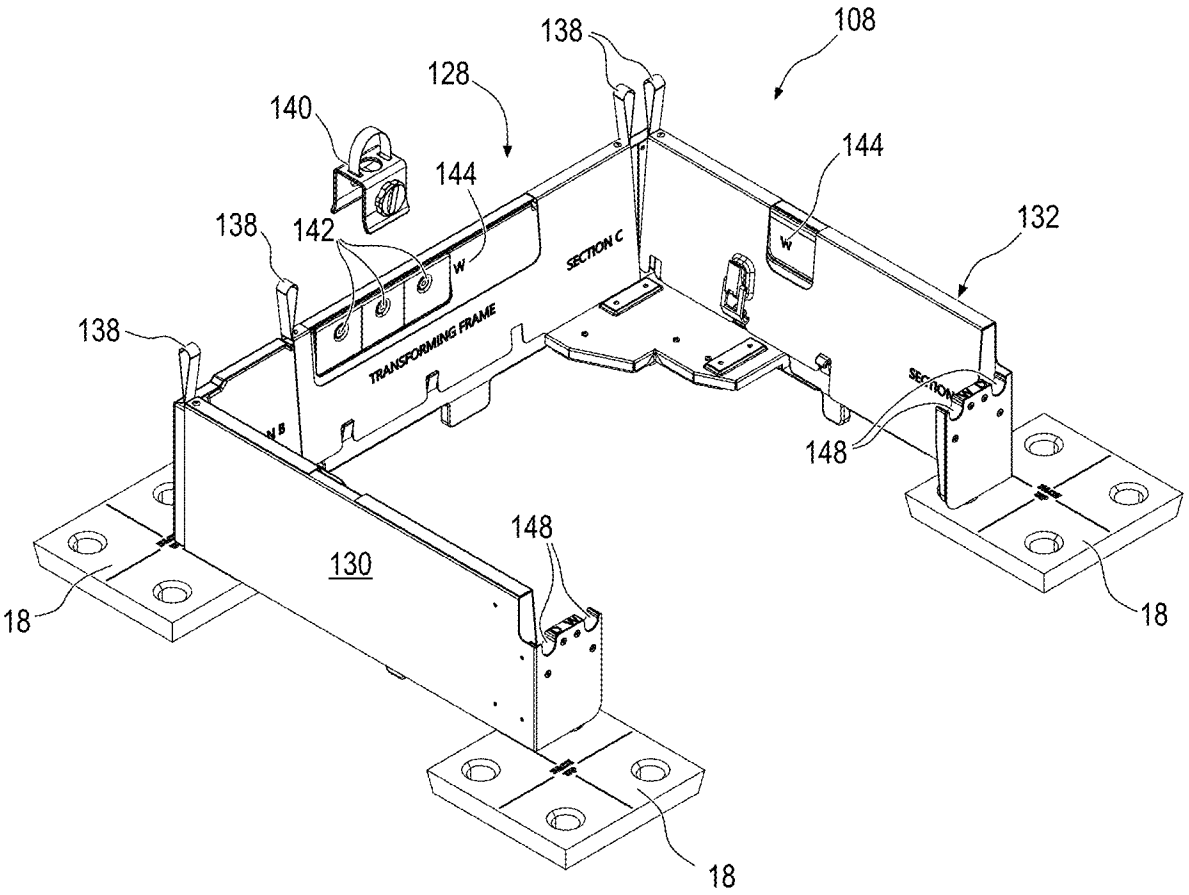
FIG. 14 shows the adjustable frame of the reclining assembly of FIGS. 5-13, shown in FIGS. 11-13 in a wide mode.

FIGS. 13A-13B show the adjustable frame of the reclining assembly of FIGS. 5A-12 being converted from the deep mode reflected in FIG. 11 to the wide mode reflected in FIG. 14. As illustrated, the rear portion 128 of frame 108 is lengthened, by adjusting the overlap between the two frame members making up the rear frame portion 128, and the side frame portions 130 and 132 are shortened, by providing greater overlap between side frame portions 132*a* and 132*b*, and between 130*a*, and 130*b*. FIG. 14 shows the finished result, with the adjustable frame 108 of the reclining assembly of FIGS. 5-13, shown in a wide mode.

Figure 15:
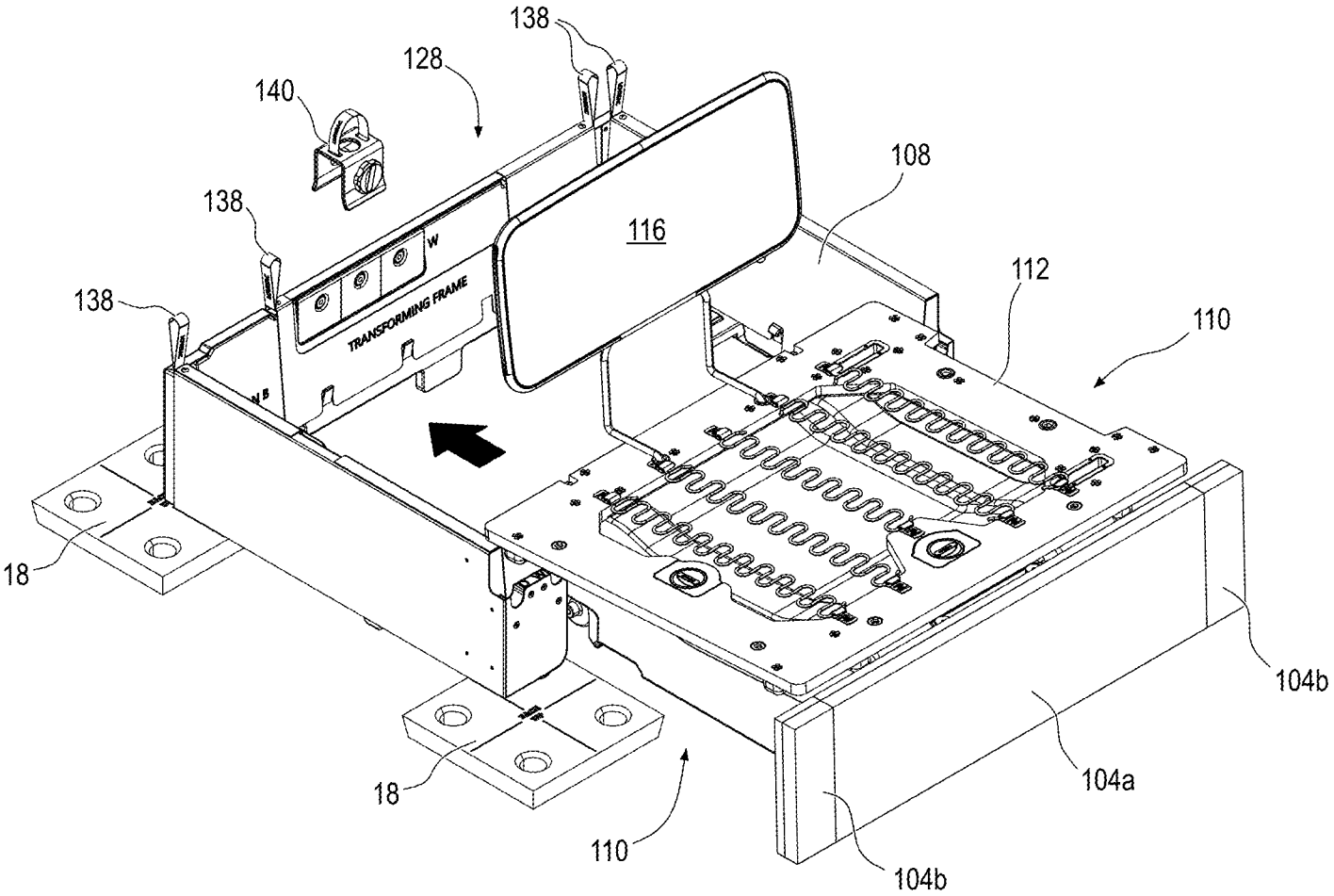
FIG. 15 shows the adjustable frame of the reclining assembly of FIGS. 5-14 with the reclining mechanism being selectively moved, e.g., rolled into the frame to form a wide mode reclining assembly.
Figure 16B:
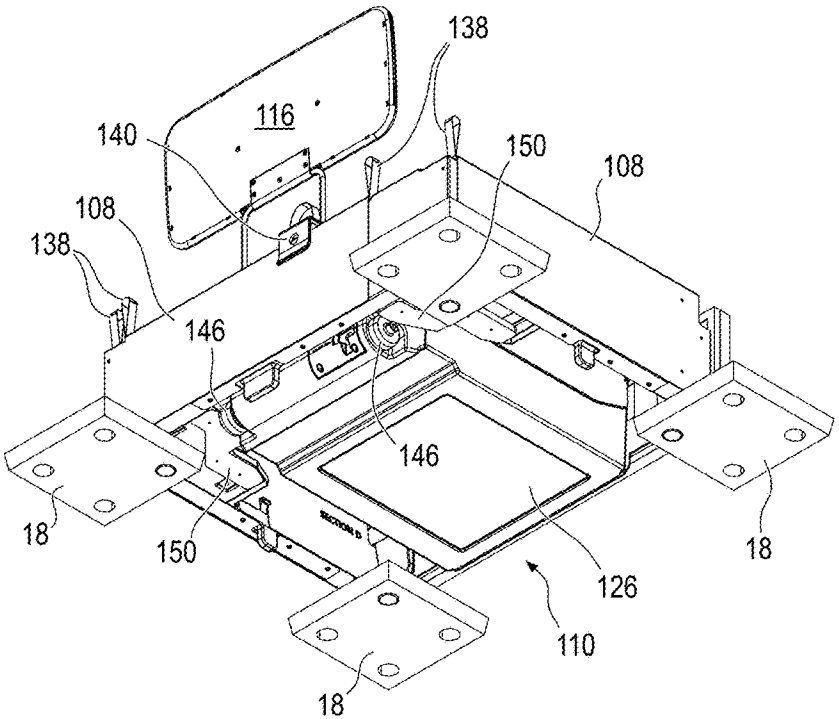
FIGS. 16A-16B show top and bottom views, respectively, of the reclining assembly of FIGS. 5-15, shown in the wide mode, with an exterior housing shown in FIG. 16B.
Figure 16A:
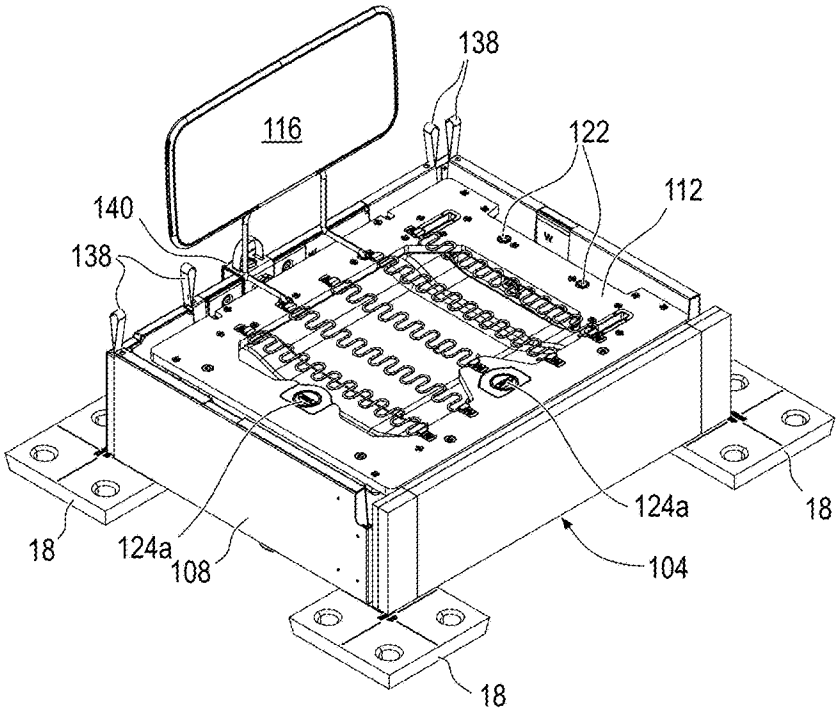

FIG. 15 shows the adjustable frame 108 of the reclining assembly 102 of FIGS. 5-14 with the reclining mechanism 110 being selectively moved, e.g., rolled into the frame 108 to form a wide mode reclining assembly 102. FIGS. 16A-16B show top and bottom views, respectively, of the reclining assembly of FIGS. 5-15, shown in the wide mode, with the exterior housing 126 of reclining mechanism 110 visible in FIG. 16B. As shown, the reclining mechanism 110 rolls into the adjustable frame 108 in a similar manner, whether the frame is configured for the deep mode or the wide mode, with some difference in where the wheels 146 of mechanism 110 are positioned within adjustable frame 108, depending on whether the wide or deep mode is selected. For example, a comparison of FIG. 16B (wide mode) and 5B (deep mode) illustrate the differences, wherein either case, the front of the reclining mechanism and footplate 104 is at the front, adjacent front of adjustable frame 108. In the deep mode, there is a larger gap behind the reclining mechanism 110 and wheels 146 with respect to corner plates 150 illustrated in the back corner of adjustable frame 108. Wheels 146 can be mounted on housing 126, or optionally, wheels 146 can be mounted to a frame of reclining mechanism 110, e.g., to a frame of the lower carriage portion of mechanism 110.

Figure 17A:
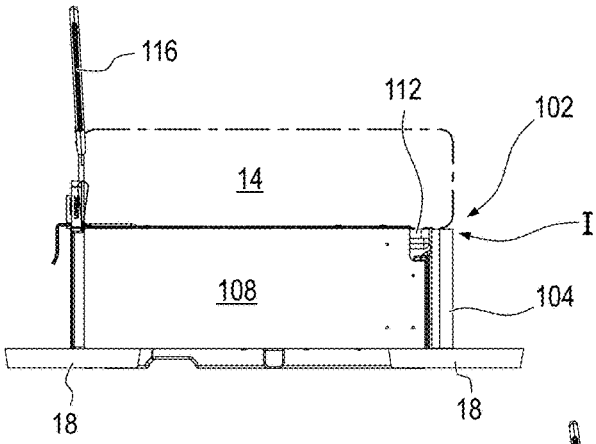
FIGS. 17A-17D illustrate a progression of the reclining assembly of FIGS. 5-16 in the wide mode, showing a progression of the reclining assembly from non-reclined (FIG. 17A), to preparing to recline by lifting the seat lid and cushion (FIG. 17B), to partially reclined (FIG. 17C), to fully reclined (FIG. 17D).
Figure 17B:
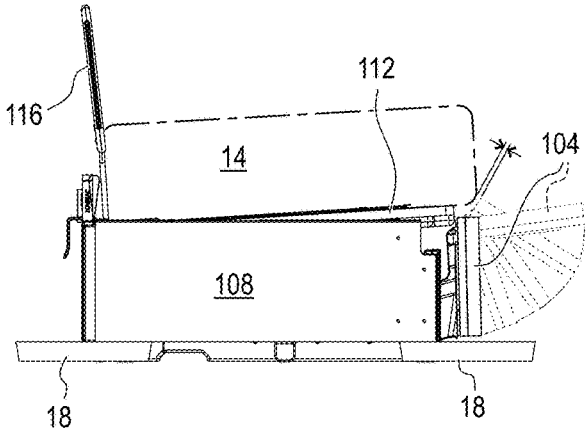
Figure 17C:
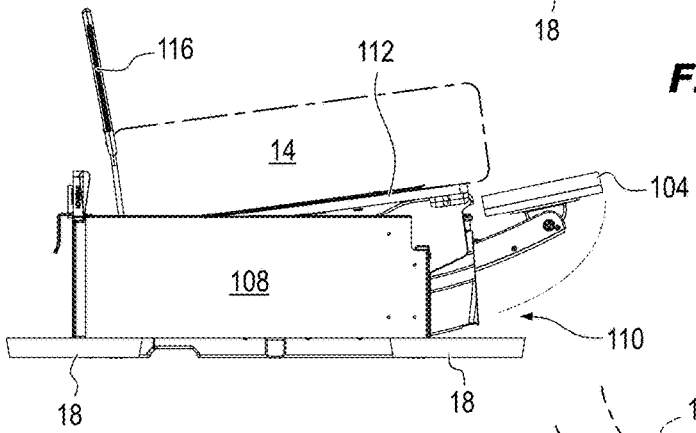
Figure 17D:
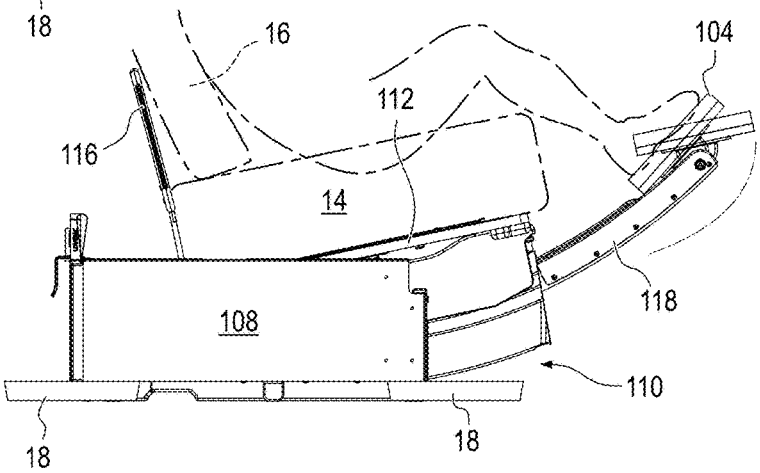
Figure 18A:
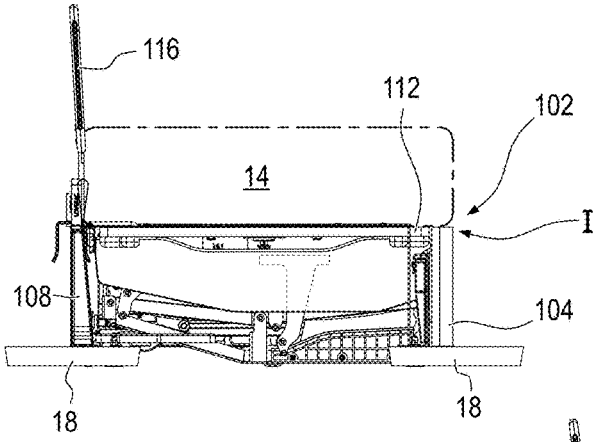
FIGS. 18A-18D illustrate a progression of the reclining mechanism of FIGS. 5-17 in the wide mode, showing a progression of the reclining mechanism from non-reclined with an exterior panel shown (FIG. 18A), to preparing to recline by lifting the seat lid and cushion—with the exterior panel removed (FIG. 18B), to partially reclined with the exterior panel shown (FIG. 18C), to fully reclined—with the exterior panel removed (FIG. 18D).
Figure 18B:
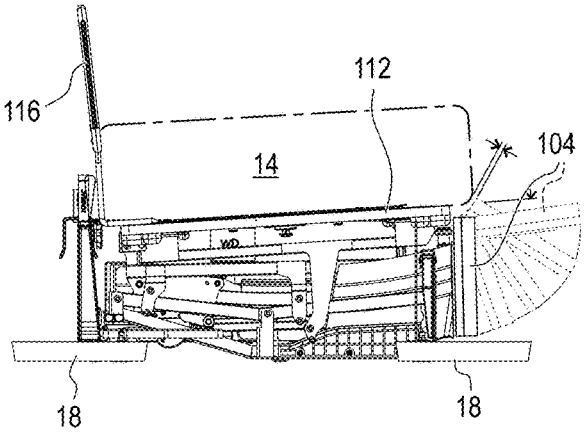
Figure 18C:
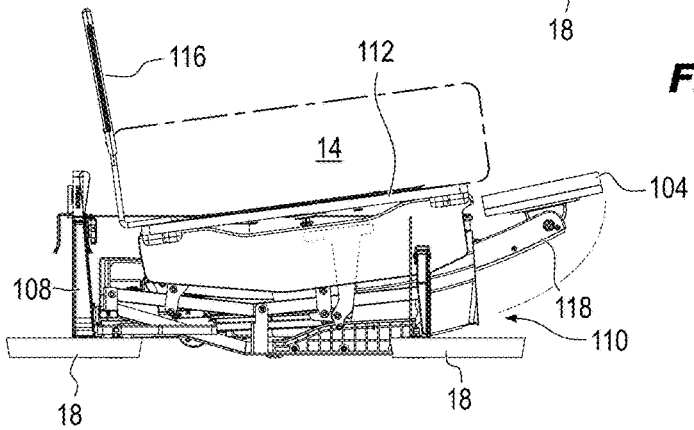
Figure 18D:
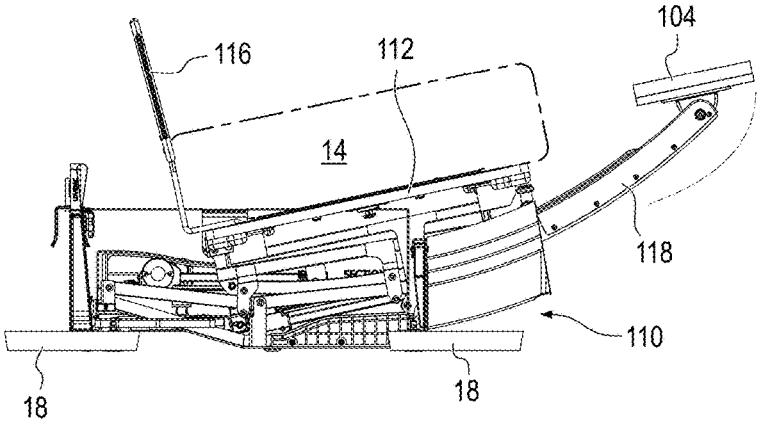

FIGS. 17A-17D illustrate a progression of the reclining assembly 102 of FIGS. 5-16 in the wide mode, showing a progression of the reclining assembly from non-reclined (FIG. 17A), to preparing to recline by lifting the seat lid 112 and cushion 14 (FIG. 17B), to partially reclined (FIG. 17C), to fully reclined (FIG. 17D). FIG. 17D also shows that a person sitting on cushion 14 in the reclined position can move the spring-loaded footplate 104 such that the user can bend the user's knees toward the user, such that the user can place a laptop computer, for example, on the user's knees while reclining. Such functionality is also possible in the deep mode, as well as with any other embodiments described herein.

As shown in FIG. 17A, the footplate 104 can dock when in a non-reclined position, so as to provide a flush, clean appearance around the base of the furniture assembly, similar or substantially identical to that exhibited by an adjacent coupled base 10, that can not have any recline functionality (see FIG. 1). In order to provide such an esthetic appearance, there can be little if any clearance between the top of the movable footplate 104, and cushion 14, as shown in FIG. 17A, noted at "I". In other words, particularly when a user is sitting on such cushion 14, and compressing the cushion 14 there can even be a tendency for the cushion 14 to overhang or interfere with outward movement of the footplate 104. Given this relationship, it can be important in at least some embodiments of the present invention to ensure that such interference is accommodated, and adjusted for, in the movement of the reclining assembly. For example, in the embodiment shown in FIGS. 17A-17D, as shown in FIG. 17B, in order to remove such interference before the footplate 104 actually moves to any significant degree (or at all), an initial movement provided by the reclining assembly 102 can be to lift the front end of cushion 14 and seat lid 112 before moving footplate 104 from its docked home position. With the front end of cushion 14 and lid 112 lifted out of interference contact with footplate 104, the footplate can then advance, e.g., as illustrated in phantom in FIG. 17B. Because of the spring biased nature of footplate 104, footplate 104 can begin in a substantially vertical orientation as shown, and as the footplate advances outward (as pushed by reclining arm 118), the footplate 104 can begin to rotate towards a substantially horizontal position, as shown in phantom. Once the footplate 104 extends sufficiently to be free from contacting the frame of the upper carriage portion 154, it can rotate to a default generally horizontal orientation.

It is this same spring biased configuration of the footplate 104 that allows a user to rotate the footplate either clockwise or counterclockwise, as viewed in FIG. 17D, to position the footplate 104 as desired relative to the soles of the feet of a user, or any other body part a user wishes to use to apply a biasing force, to rotate the footplate 104. In the orientation illustrated in FIG. 17D, the user has used the soles of their feet to rotate the footplate 104 counterclockwise from the default generally horizontal orientation, to rotate the footplate back towards the user, providing a comfortable angled platform on which to rest the user's soles of their feet.

In one embodiment, when the footplate 104 is retracted from the position of FIG. 17C back to the position of FIG. 17B, the footplate 104 contacts a frame portion of upper carriage portion 154, causing footplate 104 to move to the substantially vertical position of FIG. 17B.

FIGS. 18A-18D are similar to FIGS. 17A-17D, but are shown with a portion of the adjustable frame cut away, to better see the interior of the reclining mechanism 110.

Figure 19B:
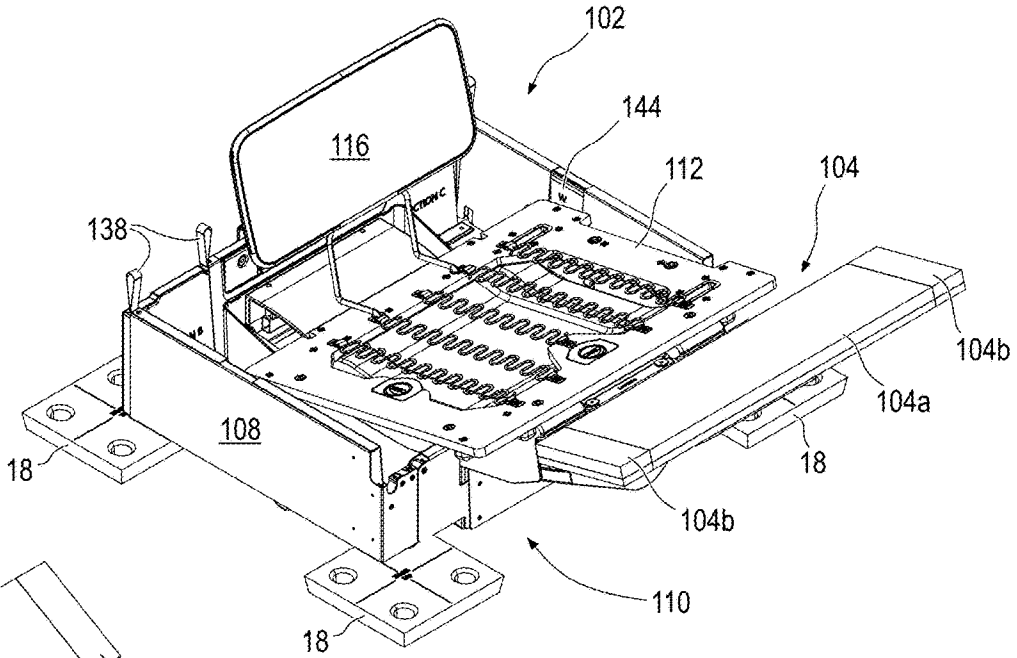
FIGS. 19A-19B show the reclining assembly of FIGS. 5-18 in the wide mode in a partially reclined position and in a fully reclined position, respectively.
Figure 19A:
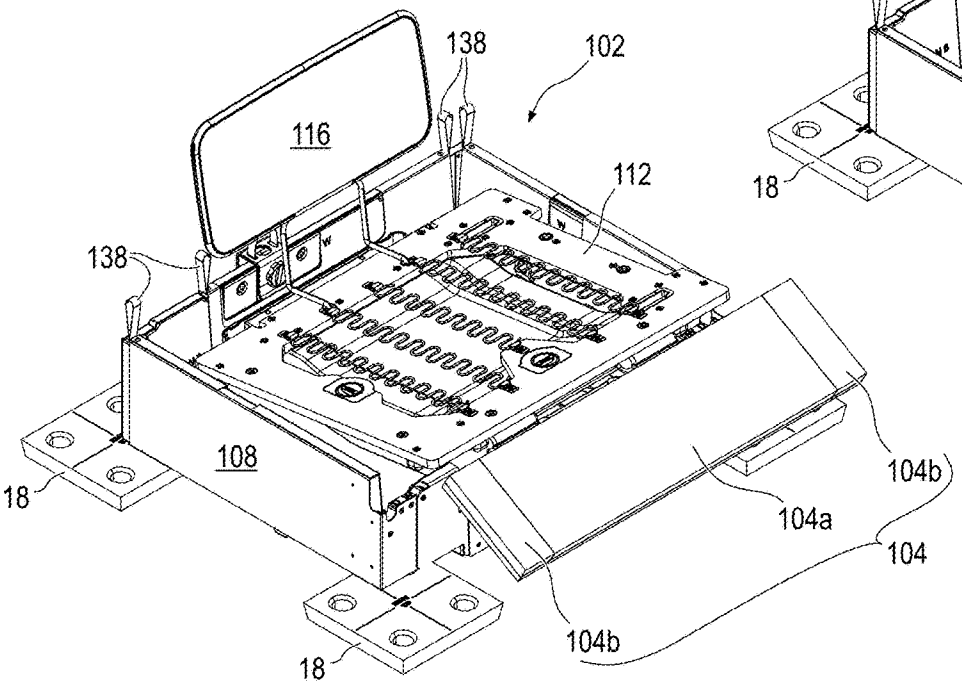

FIGS. 19A-19B show the reclining assembly 102 of FIGS. 5-18 in the wide mode in a partially reclined position and in a fully reclined position, respectively. FIGS. 19A-19B are otherwise similar to FIGS. 8A-8B, but show the reclining assembly 102 in a wide mode, rather than the deep mode shown in FIGS. 8A-8B.

Figure 20B:
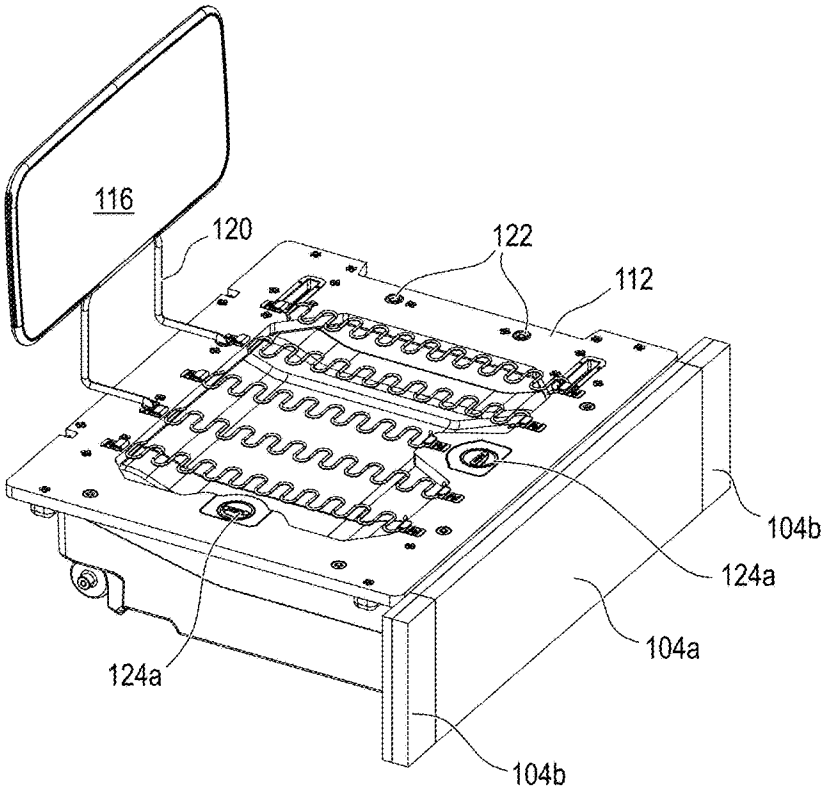
FIGS. 20A-20B show, in a wide mode, the seat lid and backrest exploded above, then mounted on, the reclining mechanism of the reclining assembly of FIGS. 5-19, respectively.
Figure 20A:
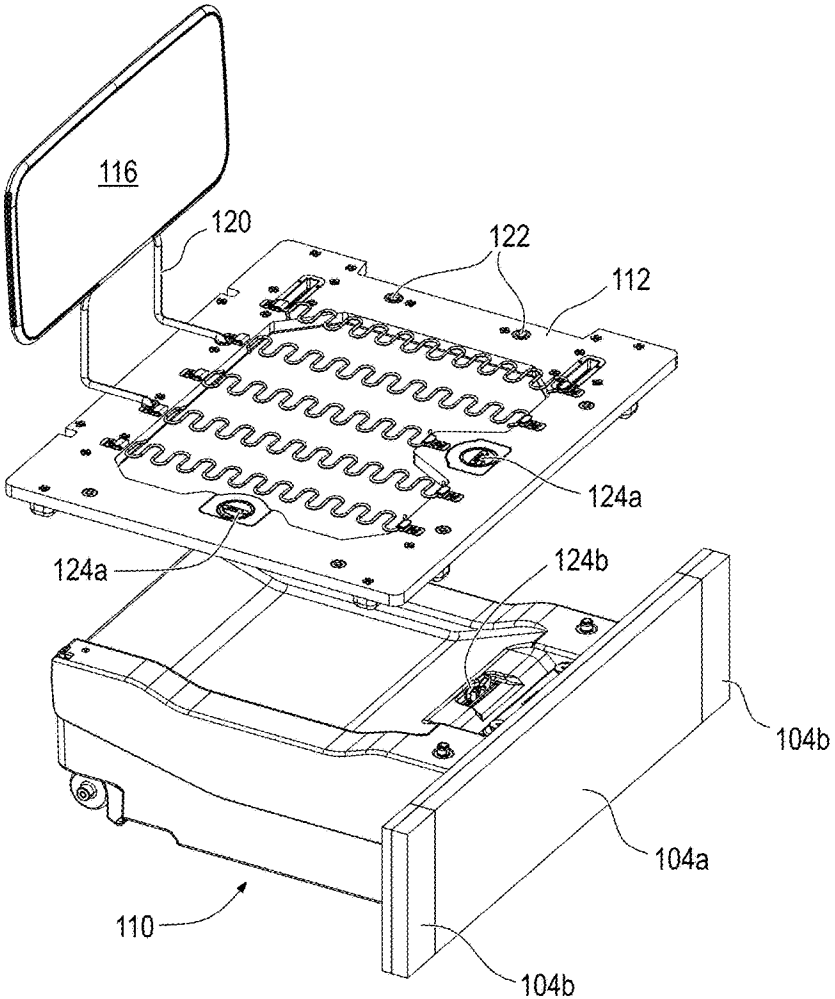

FIGS. 20A-20B show, in a wide mode, the seat lid 112 and backrest 116 exploded above (FIG. 20A), then mounted on (FIG. 20B) the reclining mechanism 110 of the reclining assembly of FIGS. 5-19, respectively. FIGS. 20A-20B are otherwise similar to FIGS. 9A-9B, but shown in the wide mode, rather than the deep mode. As is apparent, the backrest 116 is attached to mounting rods 120, which selectively mount into corresponding mounting holes 122 of seat lid 112. In FIGS. 20A-20B, the mounting rods 120 are selectively inserted into holes 122 adjacent the longer (wider) end of the seat lid 112, while in FIGS. 9A-9B, the mounting rods 120 are selectively inserted into holes 122 that are adjacent the shorter end of the seat lid 112. In this way, the seat lid is simply rotatable for either use, depending on whether the user wishes to use the wide mode or the deep mode.

Figure 21:
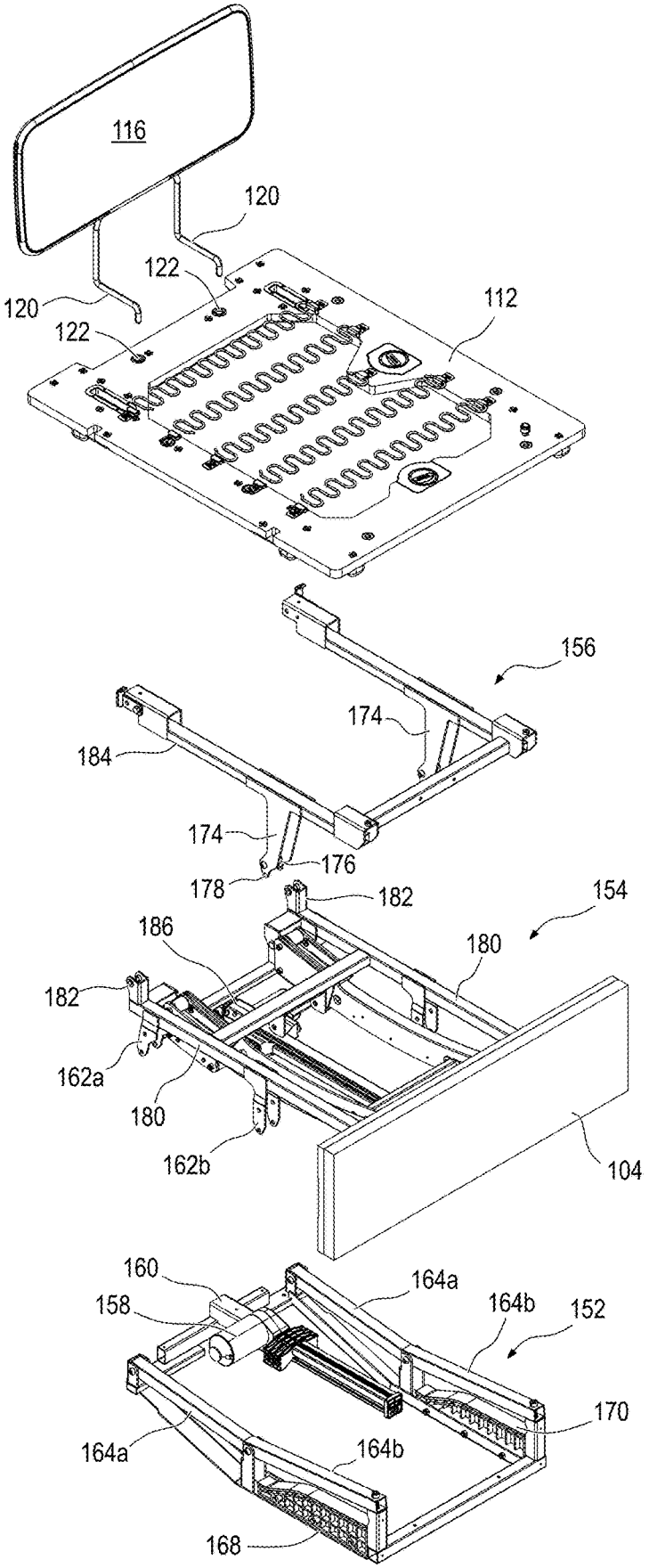
FIG. 21 shows an exploded view of respective parts of the reclining assembly of FIGS. 1-20 of the present invention that mount into the adjustable frame of FIGS. 1-20.

FIG. 21 shows an exploded view of respective parts of the reclining system (reclining mechanism 110 plus seat lid 112 and backrest 116) of FIGS. 1-20 of the present invention that mount into the adjustable frame of FIGS. 1-20. Additional view of various parts are shown in FIGS. 21-25. The reclining mechanism 110 includes a fixed lower carriage portion 152, an upper carriage portion 154 and a lifting member 156. Fixed lower carriage portion docks into adjustable frame 108, but otherwise is stationary, and does not move during the reclining motion of the remainder of the reclining mechanism. Fixed lower carriage portion 152 is shown as including a first actuator 158. First actuator 158 is anchored to the frame 160 of fixed lower carriage portion 152. Fixed lower carriage portion 152 includes angled forwardly extending track members 164*a*, 164*b*, which engage with and provide a track along which the upper carriage portion 154 is configured to ride, relative to fixed lower carriage portion 152. For example, upper carriage portion 154 includes rear and forward brackets 162*a*, 162*b*, each of which brackets hold a pair of rollers 166 which engage with track members 164*a* and 164*b* of fixed lower carriage portion 152. Such an arrangement of brackets, rollers, and angled frame members is provided on both left and right sides of the reclining assembly 102.

First actuator 158 drives upper carriage portion 154 forward (and rearward), with rollers 166 rolling against angled track members 164*a* and 164*b*. In particular, angled track members 164*a* and 164*b* are connected to one another, with rear angled track member 164*a* being angled downward, and forward angled track member 164*b* being angled upward. The decline and incline of such angled track members can be of any desired angle, depending on how much angular recline is desired within the seat. In an embodiment, the decline and incline can vary from horizontal by about 1° to about 30°, e.g., from about 3° to about 20°, or from about 5° to about 15°, or from about 5° to about 10°. Such a configuration is one embodiment for achieving the described recline movement of the seat. It will be appreciated that other configurations are of course also possible.

Lower carriage portion further includes first and second ramps 168, e.g., under inclined track member 164*b*. Ramp 168 provides a ramp surface 170 that is initially relatively steeply inclined, followed by a later (more forward) surface that is less inclined, e.g., substantially horizontal. Generally parallel with ramp surface 170 is a slot 172 within ramp member 168. Lifting member 156 includes a bracket 174 that includes a roller 176 and a pin 178. Roller 176 is configured to ride along ramp surface 170, while pin 178 is configured to be received within slot 172 of ramp 168. Lifting member is pivotally connected to upper carriage portion 154, e.g., at the rear of lifting member and carriage portion 156, 154. For example, the upper carriage portion 154 includes left and right upper frame members 180, with a bracket 182 at the rear, which attaches to the left and right frame members 184 of lifting member 156. Upper carriage portion 154 is shown as also including a front crossmember 194 and a rear crossmember 196, extending between the left and right upper frame members 180.

Figure 22A:
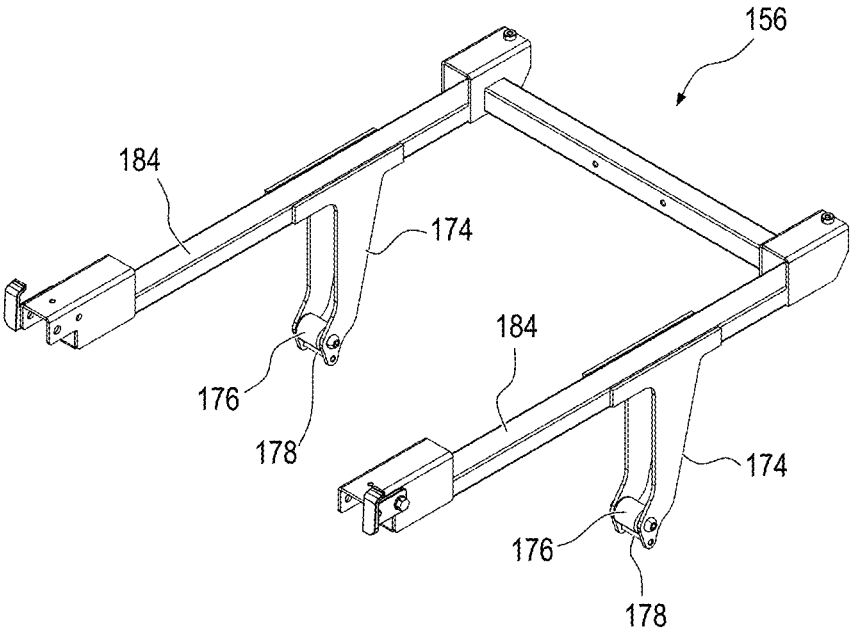
FIGS. 22A-22B show the lifting member of the reclining mechanism of FIGS. 1-21 (which is configured to be rotatably connected to the upper carriage portion of the reclining mechanism such that it lifts the seat lid and cushion when the reclining mechanism is first activated, allowing the footplate to move away from the seat lid and cushion upon initial movement of the footplate).
Figure 22B:
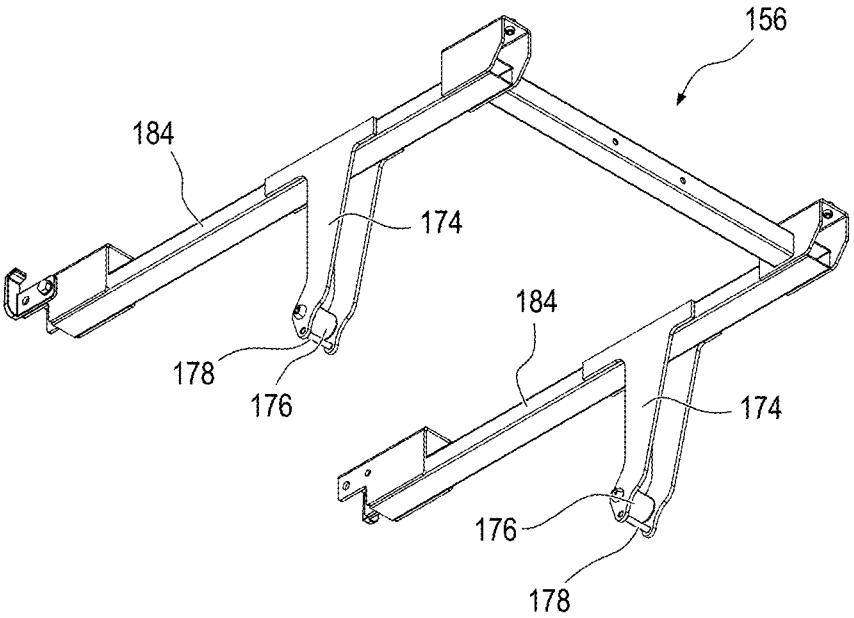

FIGS. 22A-22B show the lifting member of the reclining mechanism of FIGS. 1-21 in greater detail. Lifting member 156 is configured to be rotatably connected to the upper carriage portion 154 of the reclining mechanism 110 such that it lifts the seat lid 112 and cushion 14 when the reclining mechanism 110 is first activated, allowing the footplate 104 to move away from the seat lid 112 and cushion 14 upon initial movement of the footplate 104. This lifting movement is provided by the pivoting connection at the rear of lifting member 156, e.g., through bracket 182 and frame member 184, in combination with brackets 174 and rollers and pins 176, 178, which ride on and engage with ramp 168. As the actuator drives the upper carriage portion 154 forward, engagement between brackets 174 and ramp 168 force the front end of lifting member 156 to lift up relative to the front of upper carriage portion 154, pushing the seat lid 112 and cushion 14 away from footplate 104, providing the needed clearance.

Figure 23A:
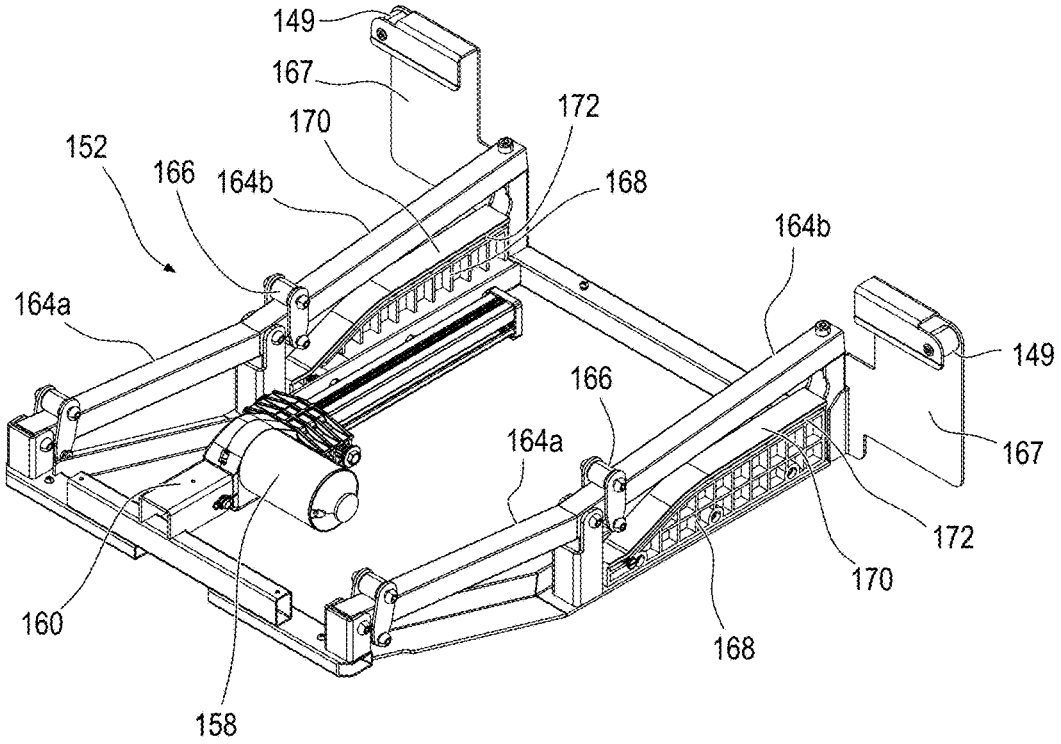
FIGS. 23A-23B show the lower carriage portion of the reclining mechanism of FIGS. 1-22 (which is configured to be connected to the adjustable frame).
Figure 23B:
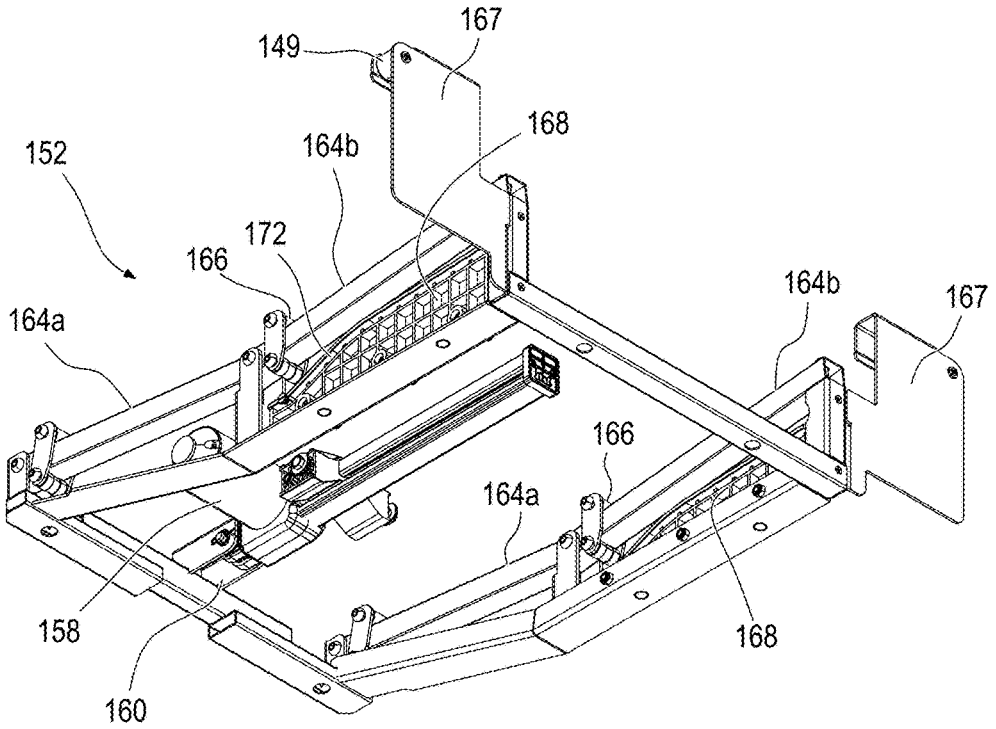

FIGS. 23A-23B show the lower carriage portion 152 of the reclining mechanism 110 of FIGS. 1-22. As noted, the lower carriage portion is coupled to the upper carriage portion 154 and seat lid 112, and the entire reclining mechanism is configured to be selectively docked into the adjustable frame 108. FIGS. 23A-B further show an embodiment in which right and left side plates 167 are coupled to a framework of lower carriage portion 152, plates 167 having respective protrusions 149 for docking into frame 108.

Figure 24A:
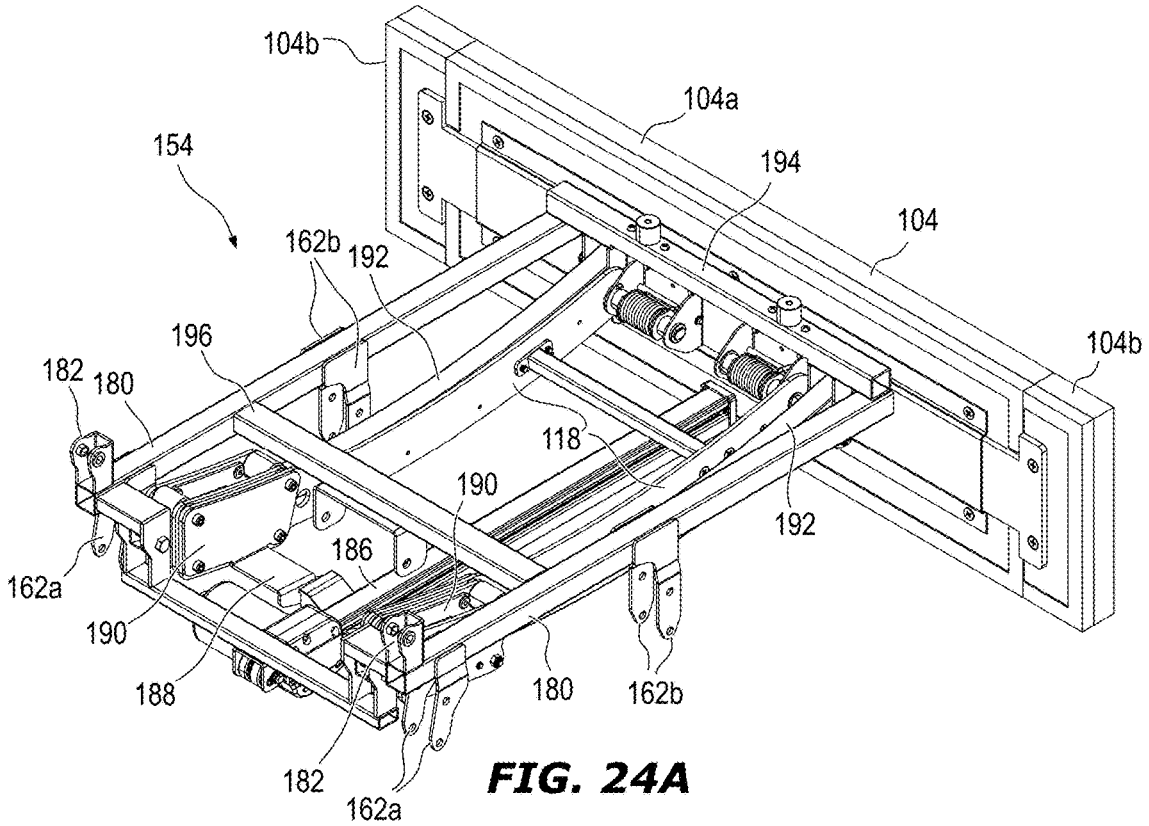
FIGS. 24A-24B show the upper carriage portion of the reclining mechanism of FIGS. 1-23 (which is configured to be movably connected to the lower carriage portion of the reclining mechanism).
Figure 24B:
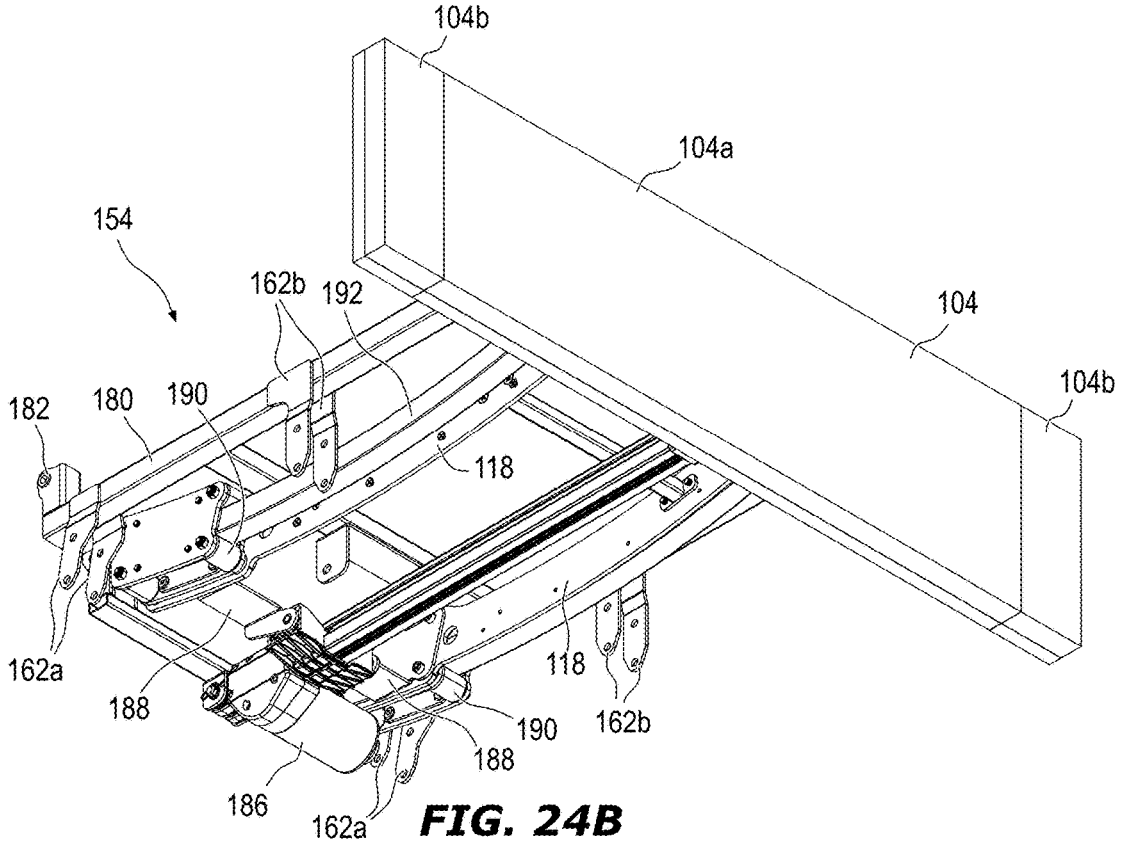
Figure 25A:
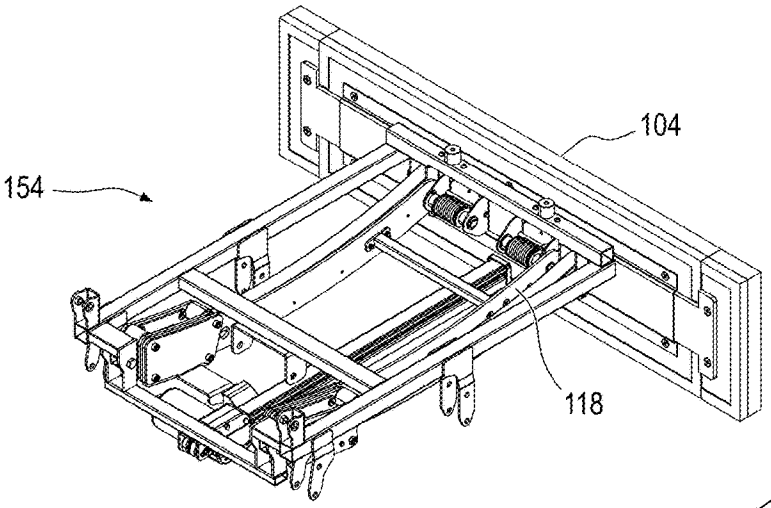
FIGS. 25A-25C show a progression of the upper carriage portion of the reclining mechanism of FIGS. 1-24 from the non-reclined mode (FIG. 25A) to the partially reclined mode (FIG. 25B) to the fully reclined mode (FIG. 25C).
Figure 25B:
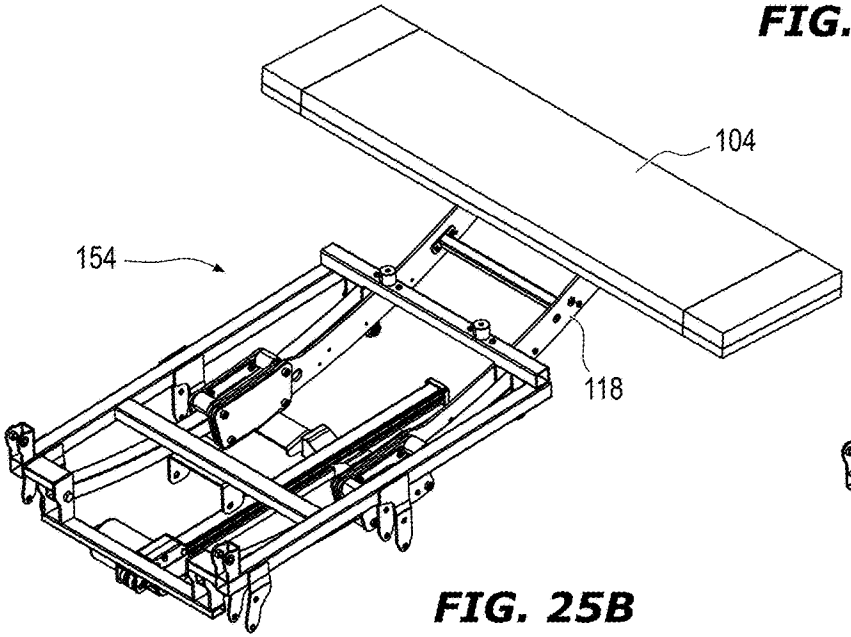
Figure 25C:
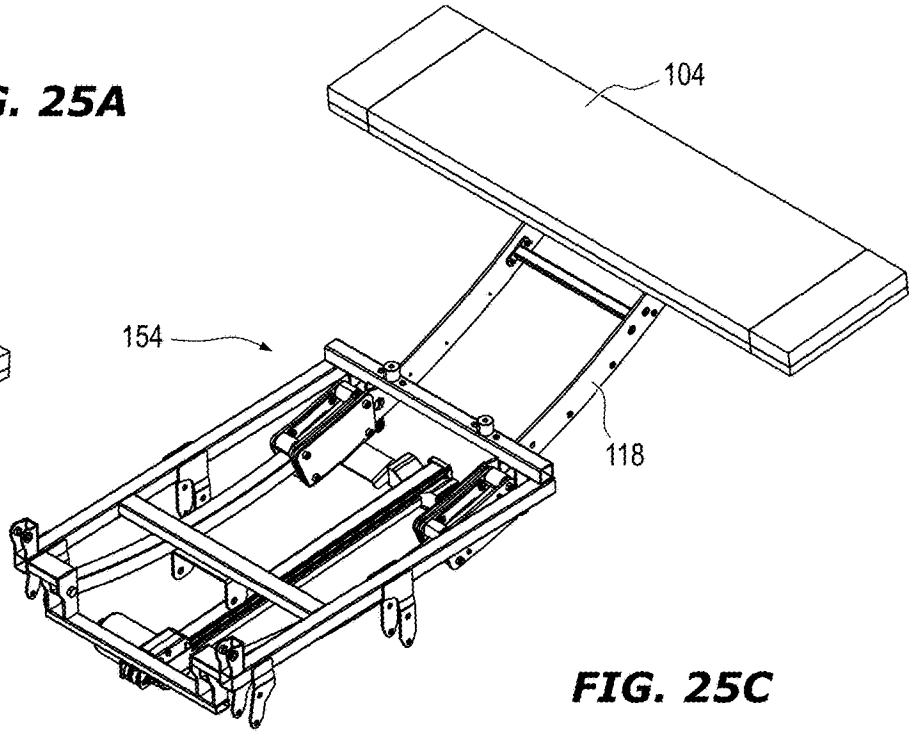

FIGS. 24A-24B show the upper carriage portion of the reclining mechanism 110 of FIGS. 1-23, which is configured to be movably connected to the fixed lower carriage portion of the reclining mechanism. FIGS. 25A-25C show a progression from the non-reclined mode (FIG. 25A) to the partially reclined mode (FIG. 25B) to the fully reclined mode (FIG. 25C).

As perhaps best seen in FIGS. 24A-24B, upper carriage portion 154 includes a second actuator 186 (e.g., a linear actuator) connected through brackets 188 to bearing assemblies 190 which include rollers or bearings that engage with curved rails 192. Connected to bearing assemblies 190 are the footplate reclining arms 118, which arms 118 are attached at their distal end to footplate 104. Actuator 186 is configured to drive bearing assemblies 190 forward (or rearward) along curved rails 192, extending footplate reclining arms 118 (and attached footplate 104) forward, to achieve the desired reclined footplate orientation.

Figure 26A:
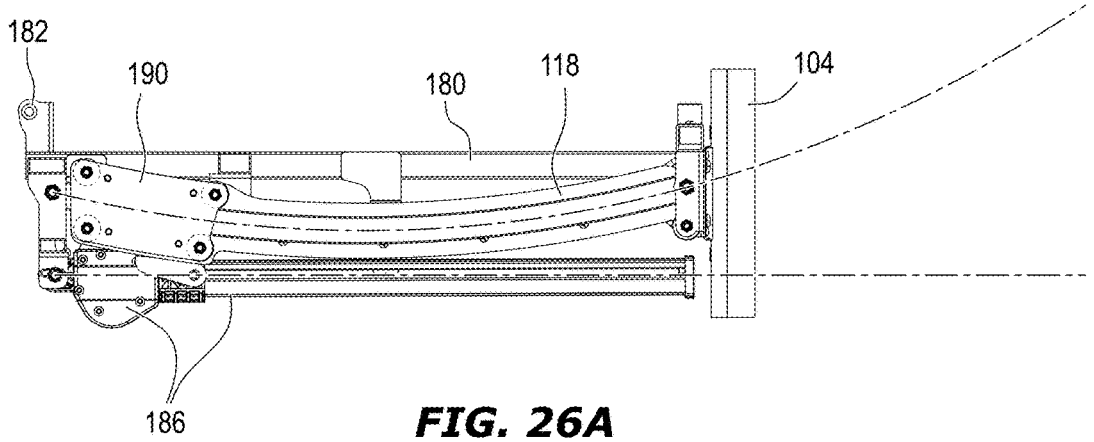
FIGS. 26A-26C further illustrate the progression of the upper carriage portion of the reclining mechanism of FIGS. 1-25 from the non-reclined mode (FIG. 26A) to the partially reclined mode (FIG. 26B) to the fully reclined mode (FIG. 26C).
Figure 26B:
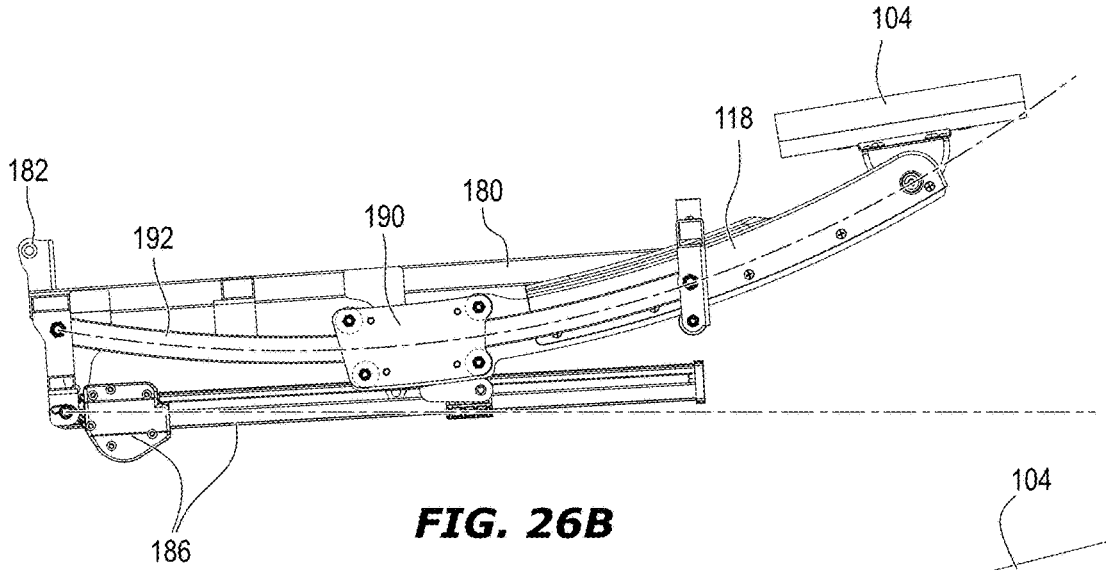
Figure 26C:
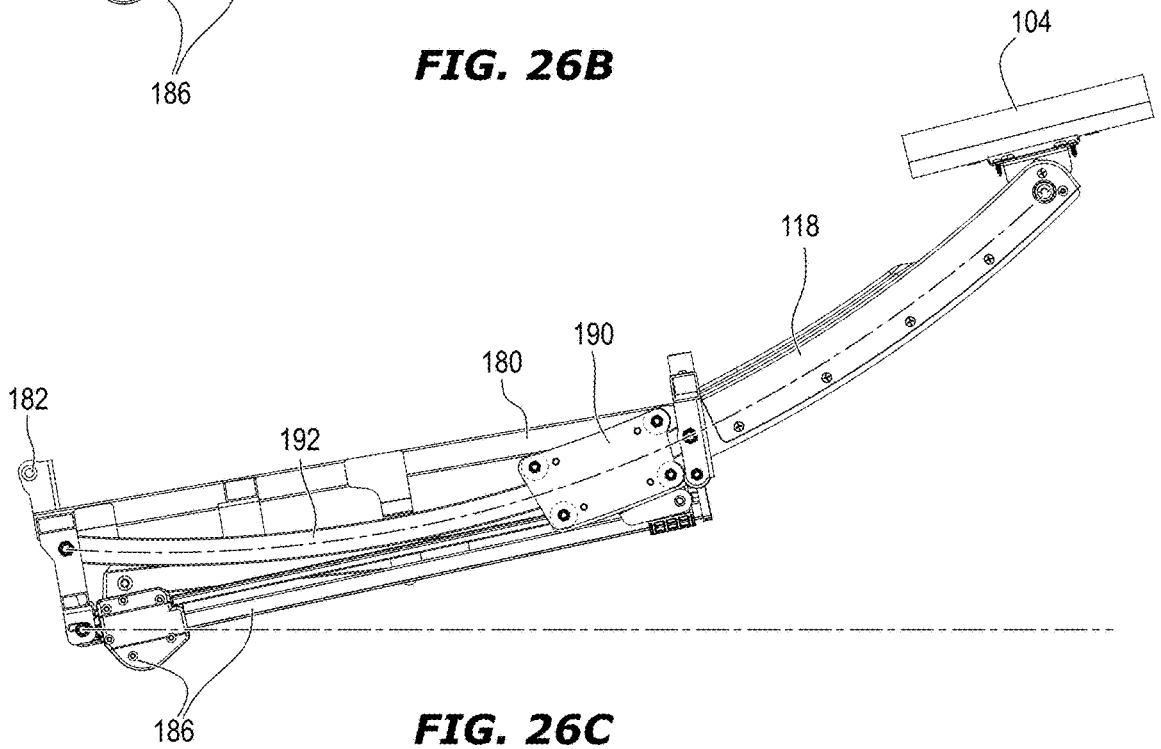

FIGS. 26A-26C further illustrate the progression of the reclining mechanism of FIGS. 1-24 from the non-reclined mode (FIG. 26A) to a partially reclined mode (FIG. 26B) to the fully reclined mode (FIG. 26C) from a side view. These Figures illustrate well the progressive movement of bearing assembly 190 along curved rails 192, progressively driving footplate reclining arms 118 and footplate 104 forward, and up, along a curved pathway that tracks that provided by curved rails 192.

Figure 27A:
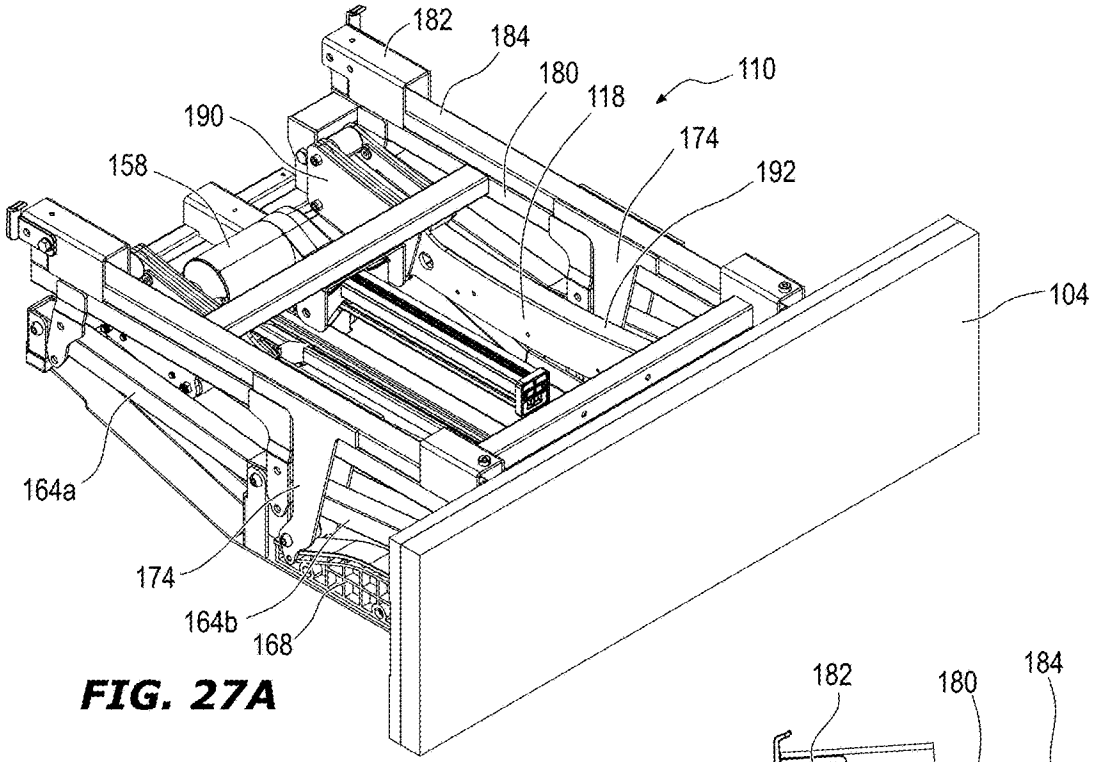
FIGS. 27A-30B show perspective and side views of the reclining mechanism of FIGS. 1-26 progressing from the non-reclined mode to the reclined mode.
Figure 27B:
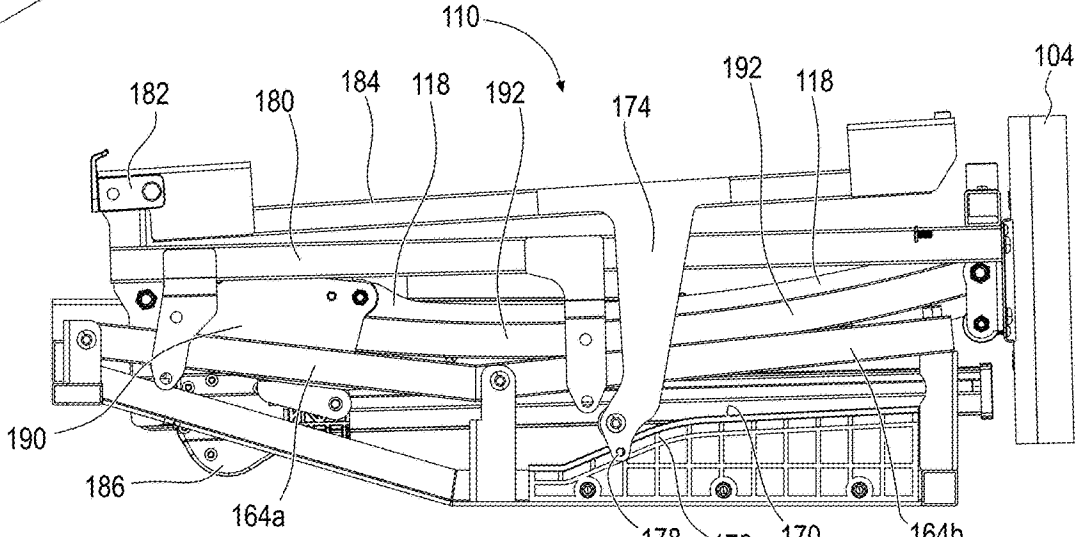
Figure 28A:
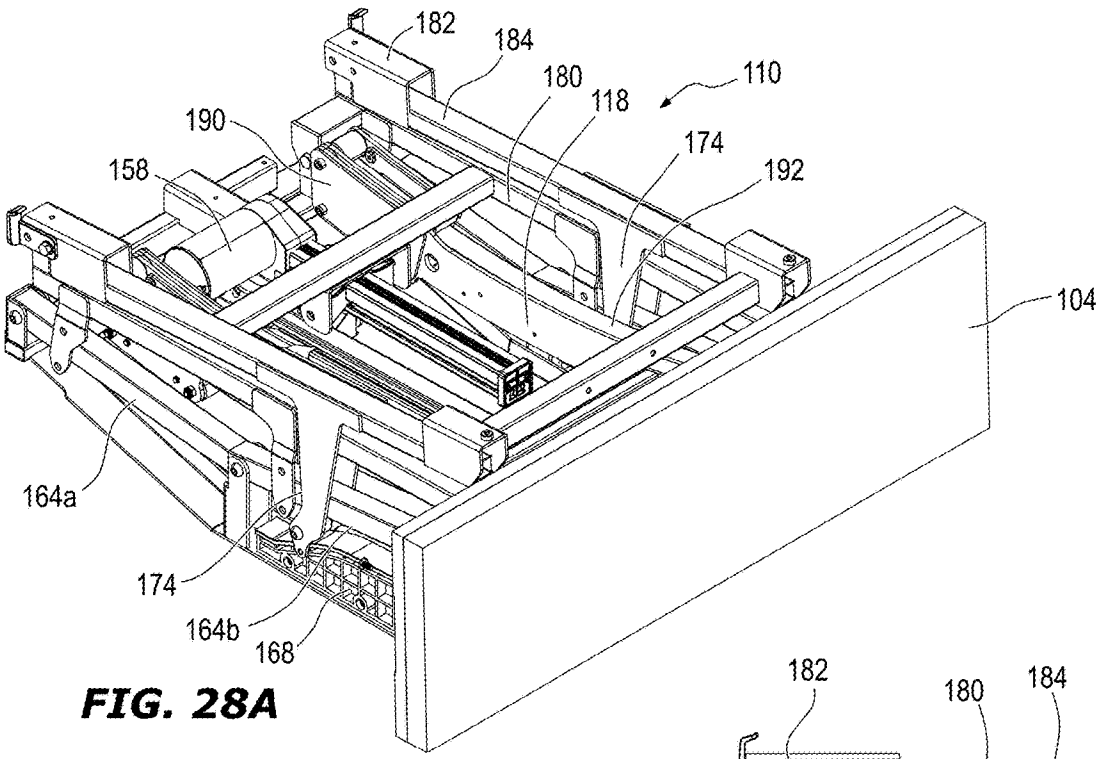
Figure 28B:
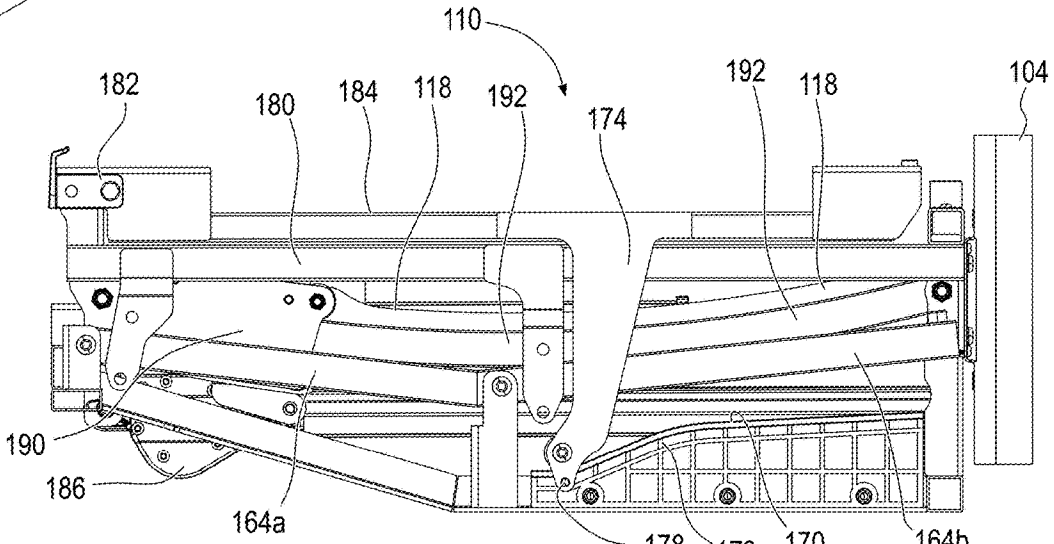

FIGS. 27A-30B show perspective and side views of the reclining mechanism of FIGS. 1-25 progressing from the non-reclined mode to the reclined mode. FIGS. 27A-27B illustrate the reclining mechanism 110 with roller 176 at or near the bottom of the initially inclined portion of ramp surface 170. FIGS. 28A-28B illustrate the same configuration, but in which the roller 176 has been advanced partially up the inclined portion of ramp surface 170, lifting the front end of frame member 184 of lifting member 156 above and out of contact with the front end of upper frame member 180 of upper carriage portion 154. Because seat lid 112 is attached to lifting member 156, this accordingly pushes the front end of seat lid 112 upward, creating a clearance space so that footplate 104 can advance outward, without interference.

Figure 29A:
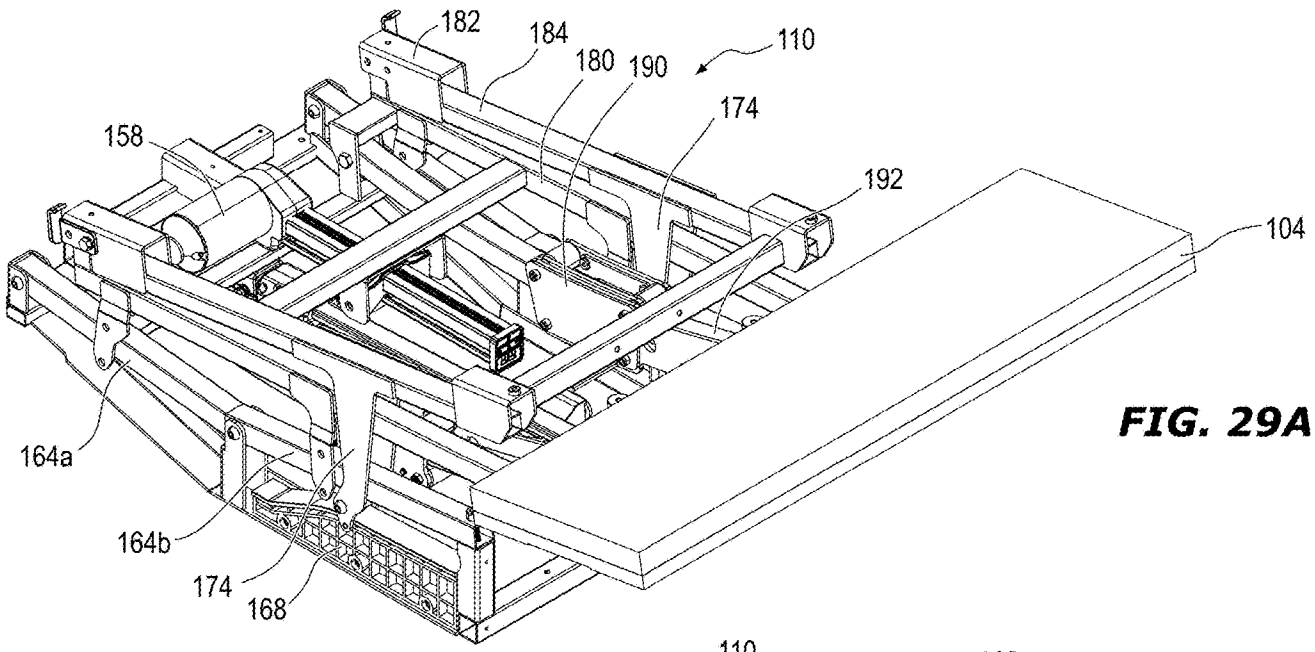
Figure 29B:
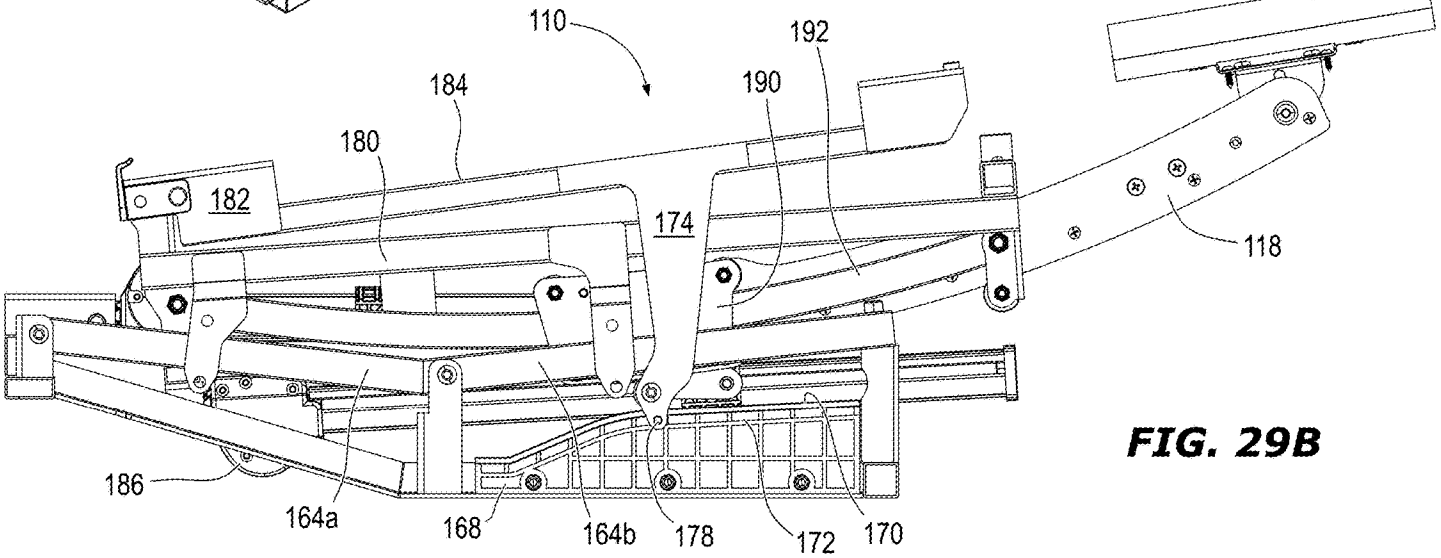

FIGS. 29A-29B are similar views as those described above, but in which roller 176 has been advanced to the top of the inclined portion of the ramp surface 170 of ramp 168, so that roller is now on the substantially horizontal portion of ramp surface 170. In addition, actuator 186 of upper carriage portion 154 has also been partially actuated, pushing bearing assemblies 190 about half way along the length of curved rail 192, resulting in significant extension of footplate reclining arms 118 out from the frame of upper carriage portion 154, pushing footplate 104 out in front of the seat, as well.

Figure 30A:
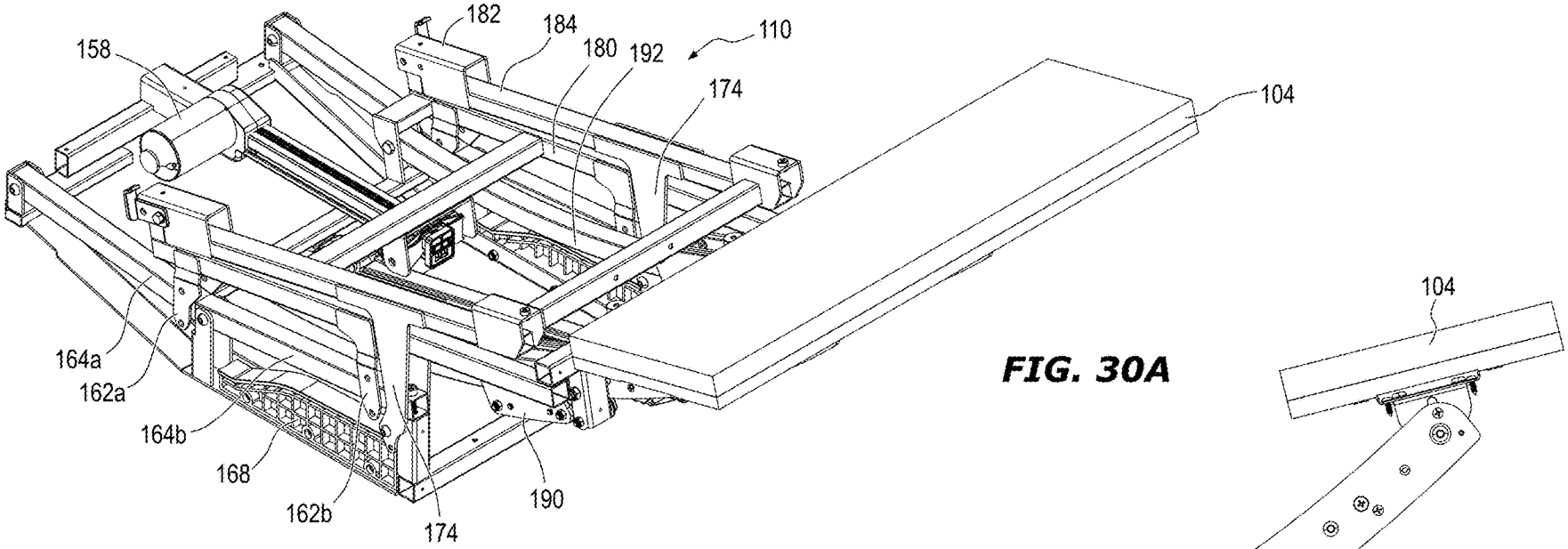
Figure 30B:
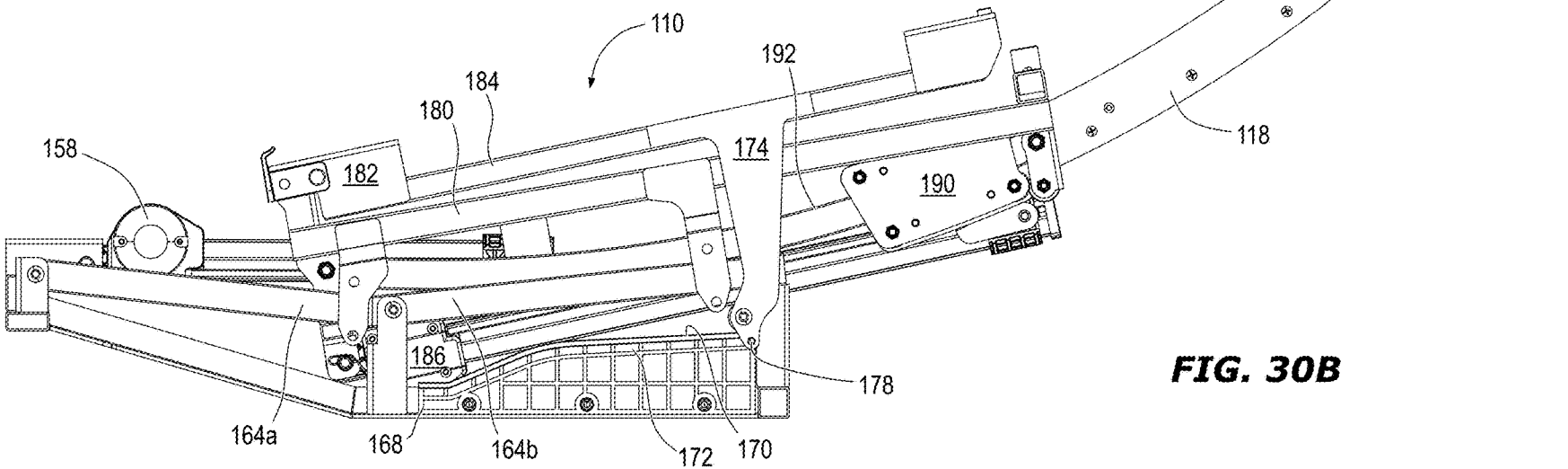

FIGS. 30A-30B are similar views, but in which roller 176 has been advanced to the end of ramp surface 170, and actuator 186 has been fully actuated, pushing footplate reclining arms 118 out from the frame of the upper carriage portion to the maximum extension (bearing assemblies 190 are shown as at the end of the curved rail 192).

In one embodiment, actuation of first actuator 158 moves the upper carriage portion 154, causing the lifting member 156 to lift the cushion away from the footplate 104. The second actuator 186 then moves the reclining arms and footplate 104 to an extended position. The first actuator 158 then moves the upper carriage portion 154 further away into a reclined position.

However, it will be appreciated that the controls of the reclining assembly can be configured to perform any such movements in any desired order. By way of example, in an embodiment, an initial movement (i) is provided by moving rollers 176 up the inclined portion of ramp surface 170, so as to cause lifting member 156 to raise the front portion of seat lid 112 and cushion 14 out of any interfering contact with the top of footplate 104. Once this is accomplished, (ii) the bearing assemblies 190 can be advanced, pushing reclining arms 118 and footplate 104 out, and/or (iii) the actuator 158 can be further advanced, further advancing roller 176 along the substantially horizontal portion of ramp surface 170. In one embodiment, steps (i) and (ii) can be performed simultaneously. In an embodiment, step (ii) can be performed prior to, simultaneous, or after step (iii). Both steps (ii) and (iii) can be performed after step (i). It will be appreciated that alternative movement profiles can be employed. The reverse order can apply when going from a reclined configuration, to the home position. Any desired movement profile can be programmed into the reclining assembly, as desired, for automatic performance upon pressing buttons of a remote control, or other control interface. For example, such a remote control can include a relatively simple user interface, including one button for reclining, and another button for reversing the recline, back towards the home position.

Figure 31A:
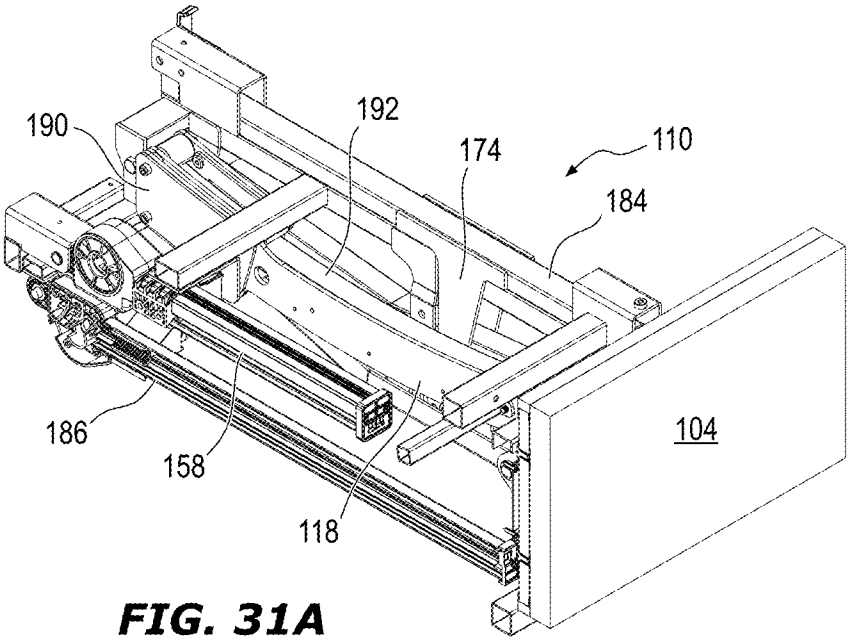
FIGS. 31A-31D show perspective, cutaways views of the reclining mechanism of FIGS. 1-30 progressing from the non-reclined mode to the reclined mode.
Figure 31B:
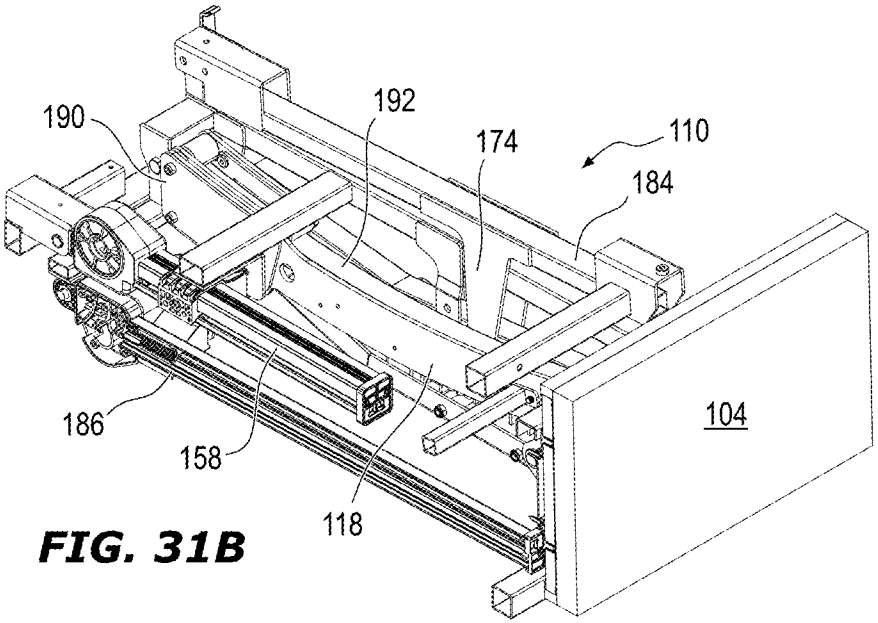
Figure 31C:
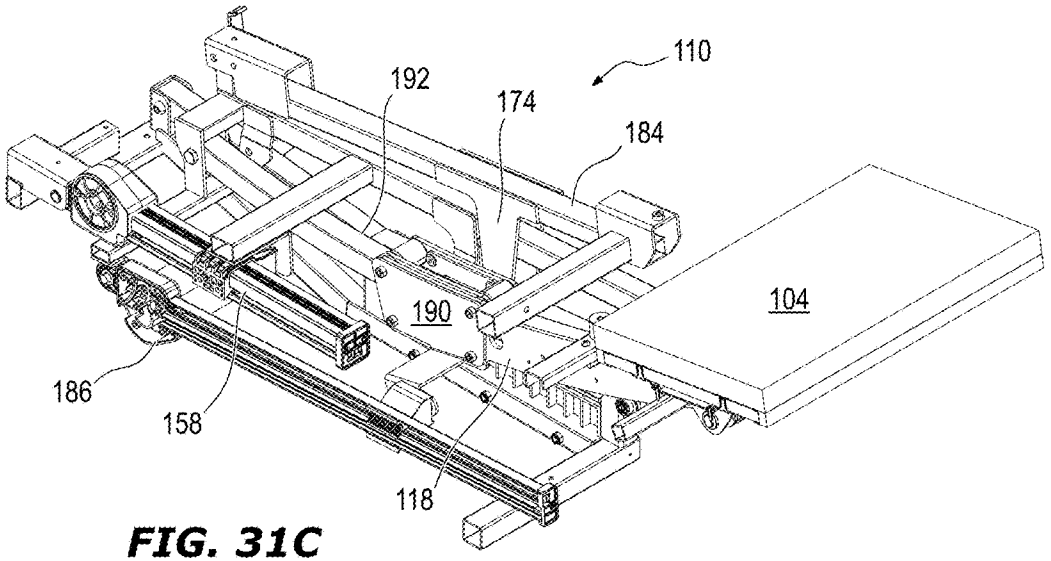
Figure 31D:
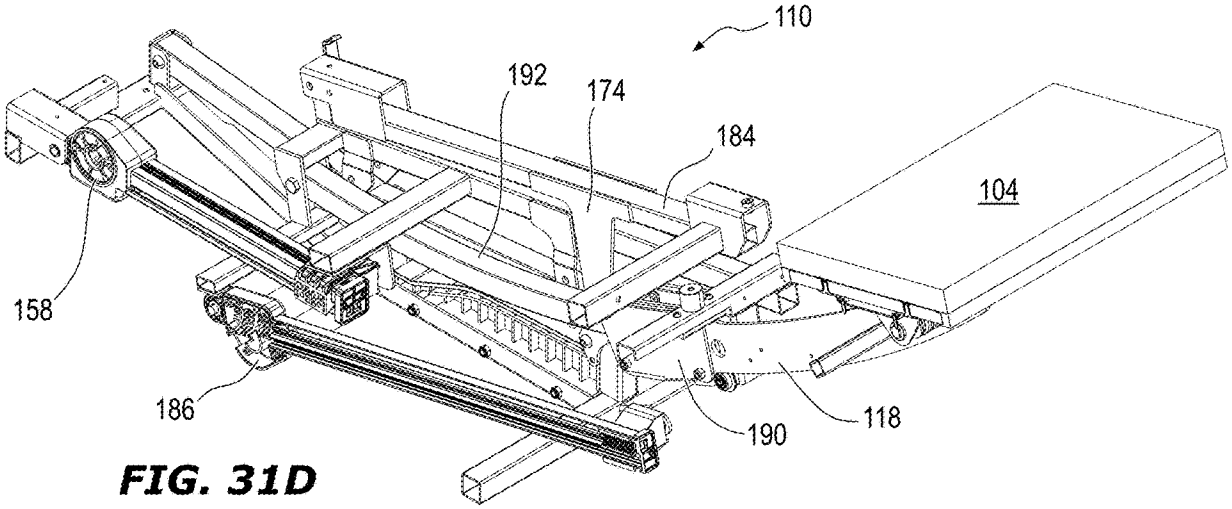

FIGS. 31A-31D show perspective, cutaways views of the reclining mechanism of FIGS. 27A-30B progressing from the non-reclined mode to the reclined mode. FIG. 31A shows the reclining mechanism 110 in the home, non-reclined position, e.g., corresponding to FIGS. 27A-27B. FIG. 31B shows the reclining mechanism with actuator 158 in a slightly advanced position, corresponding to FIGS. 28A-28B. FIG. 31C shows the reclining mechanism 110 further advanced, e.g., corresponding to FIGS. 29A-29B. FIG. 31D shows the reclining mechanism 110 fully with both actuators being advanced to their limits, e.g., corresponding to FIGS. 30A-30B.

Figure 32B:
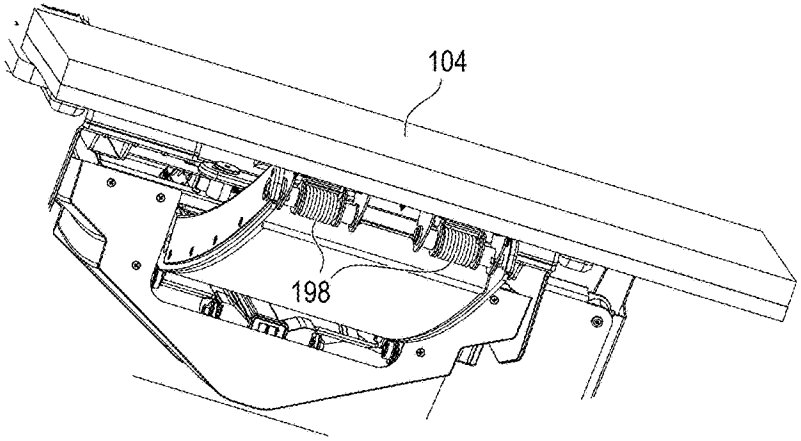
FIGS. 32A-32C show perspective views of the spring-loaded footplate of the reclining assembly of FIGS. 1-31 in the home, non-reclined position (FIG. 32A), fully reclined position (FIG. 32B), and fully reclined position tilted by a user's foot pressure on the footplate (FIG. 32C).
Figure 32A:
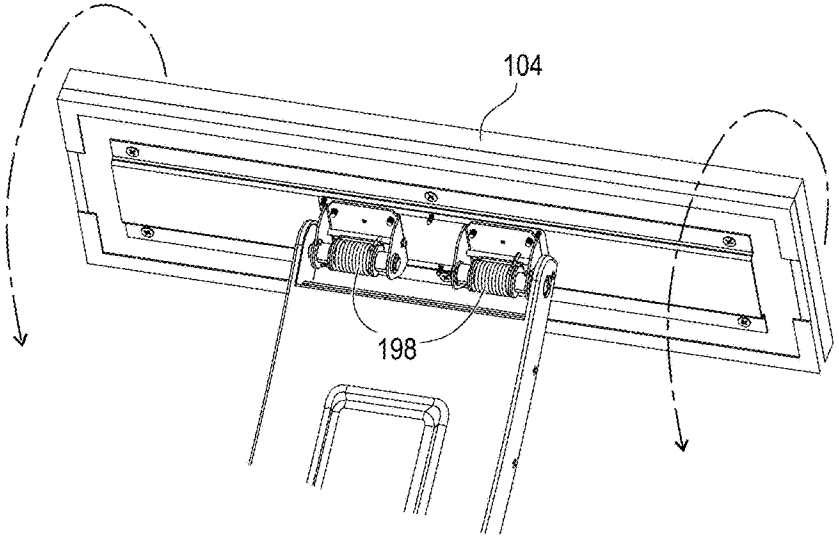
Figure 32C:
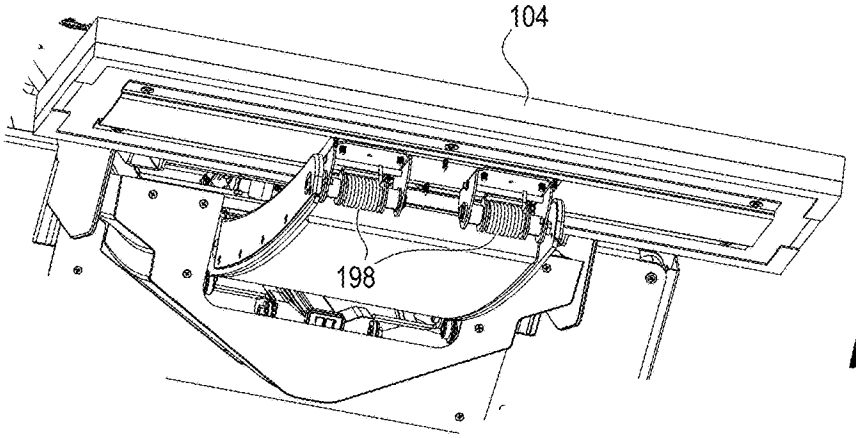

FIGS. 32A-32C show perspective views of the spring-loaded footplate of the reclining assembly 110 of FIGS. 1-31 in the home, non-reclined position (FIG. 32A), fully reclined position (FIG. 32B), and fully reclined position tilted by a user's foot pressure on the footplate (FIG. 32C). As shown, footplate 104 can include one or more biasing springs 198, which can cause the footplate 104 to default to a given orientation. In an embodiment, the springs 198 are configured to cause the footplate to default to a generally horizontal, neutral orientation (e.g., seen in FIG. 32B) absent application of some opposing force, to cause it to assume a different orientation. In the orientation seen in FIG. 32A, this can result from contact between the rear of the footplate 104 against the frame of upper carriage portion 154, forcing the footplate to a substantially vertical orientation. In the orientation seen in FIG. 32C, this can result from contact between the soles of a user's feet against the large planar face of the footplate 104, forcing the footplate to rotate counterclockwise back towards the user, providing an inclined surface on which to rest the feet.

Figure 33:
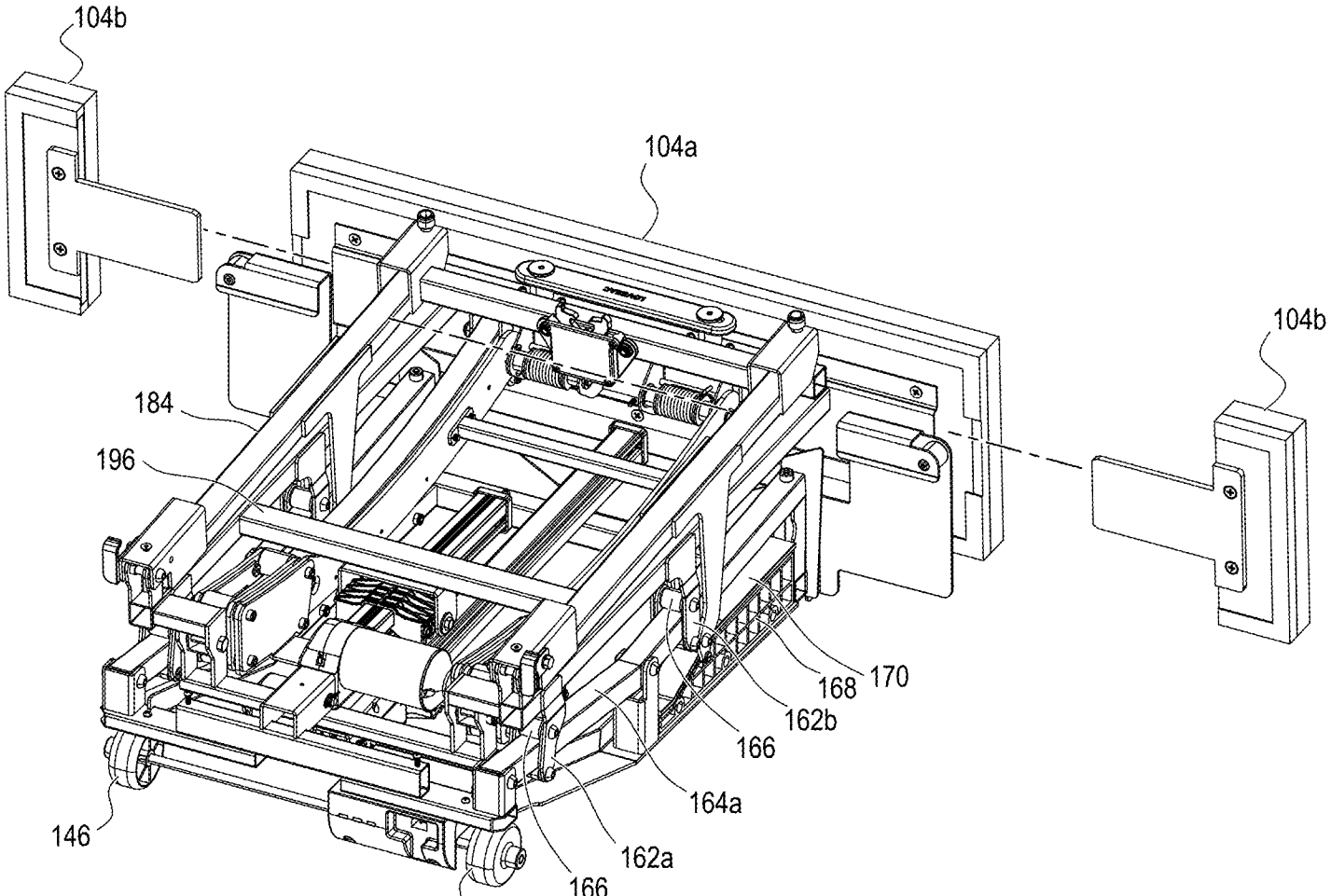
FIG. 33 illustrates how the footplate can be adjustable in length, e.g., with a greater length in the wide mode than in the deep mode.

FIG. 33 illustrates how the footplate 104 can be adjustable in length, e.g., with a greater length in the wide mode than in the deep mode. By way of example, the footplate can include a main segment 104*a* for the deep mode, and selectively attachable segments 104*b*, that can be slide into and lock with main segment 104*a*, when the wide mode is desired. This gives the overall footplate a length that is substantially equal to the length or width of an adjacent non-reclining base 10, allowing a user to easily select between, and change between, wide and deep modes, while at the same time providing a clean appearance without gaps that a footplate that would be too short in the wide mode (but correct in the deep mode) might alternatively provide. Optionally, different sized foot plates can be employed for the deep or wide modes. A wider foot plate can be used for the wide mode and a narrower foot plate can be used for the deep mode, for example.

Figure 34B:
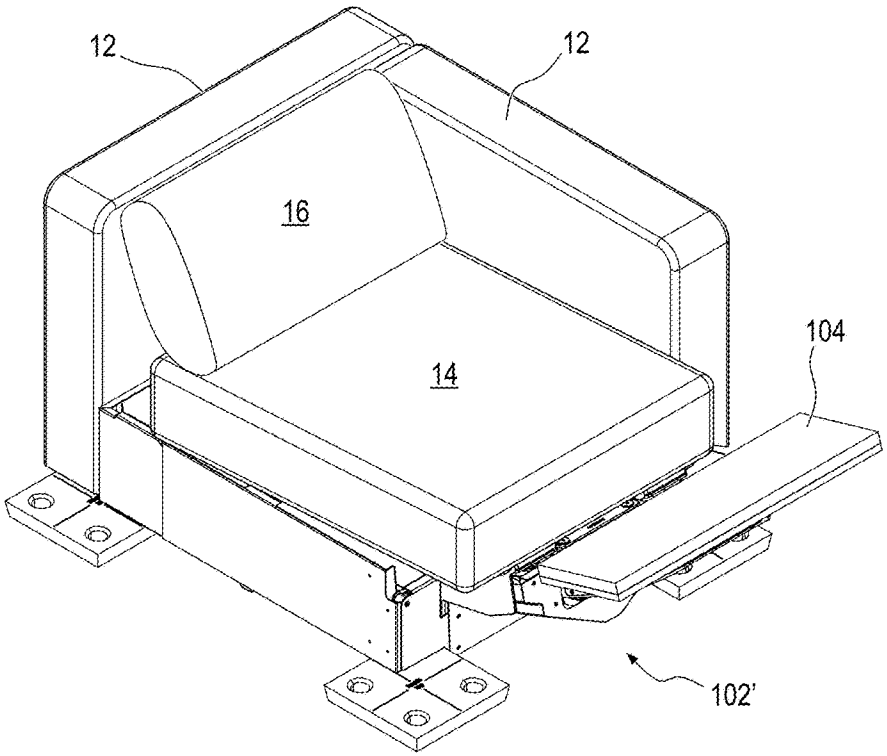
FIGS. 34A-34B show an alternative embodiment of a modular furniture system of the present invention in a deep mode with an alternative reclining assembly in respective non-reclined and reclined positions.
Figure 34A:
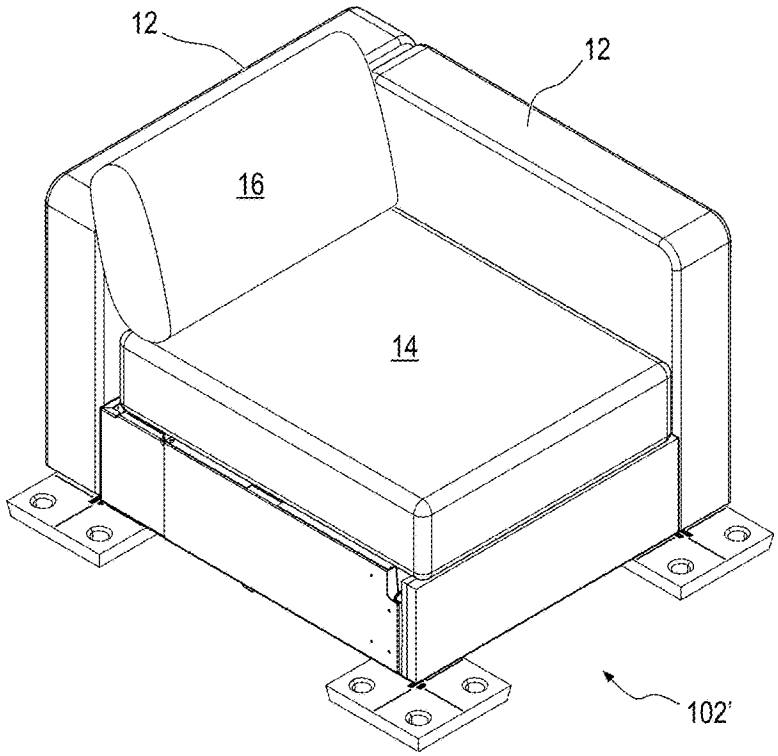
Figure 35A:
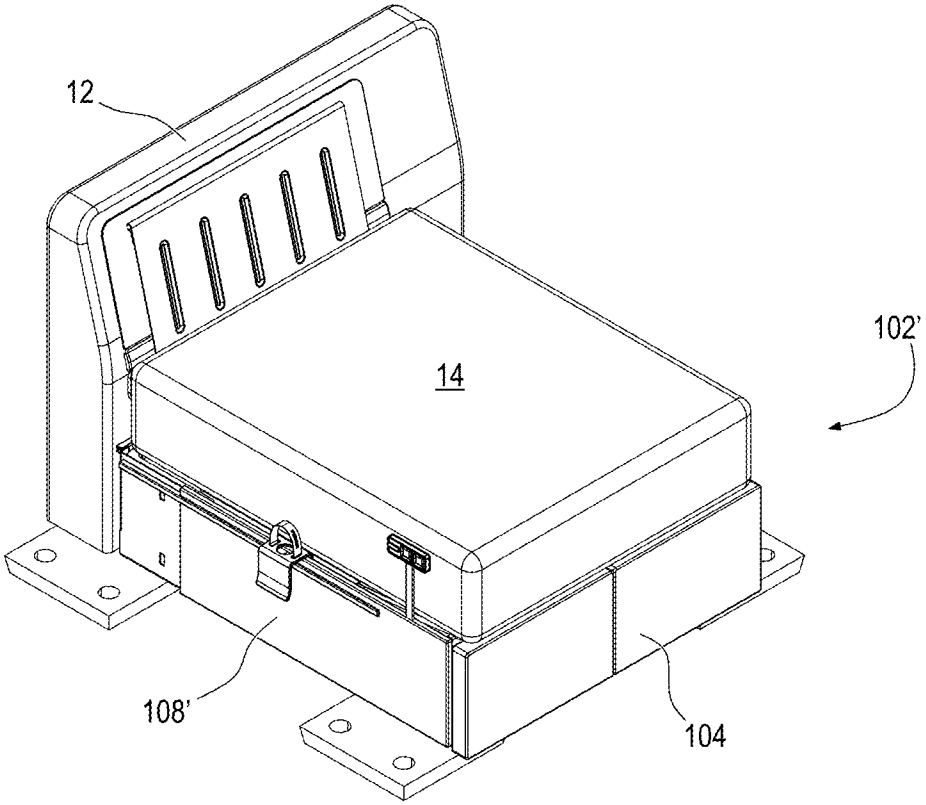
FIG. 35A-35B show the reclining assembly of FIGS. 34A-34B in a deep mode in respective non-reclined and reclined positions.
Figure 35B:
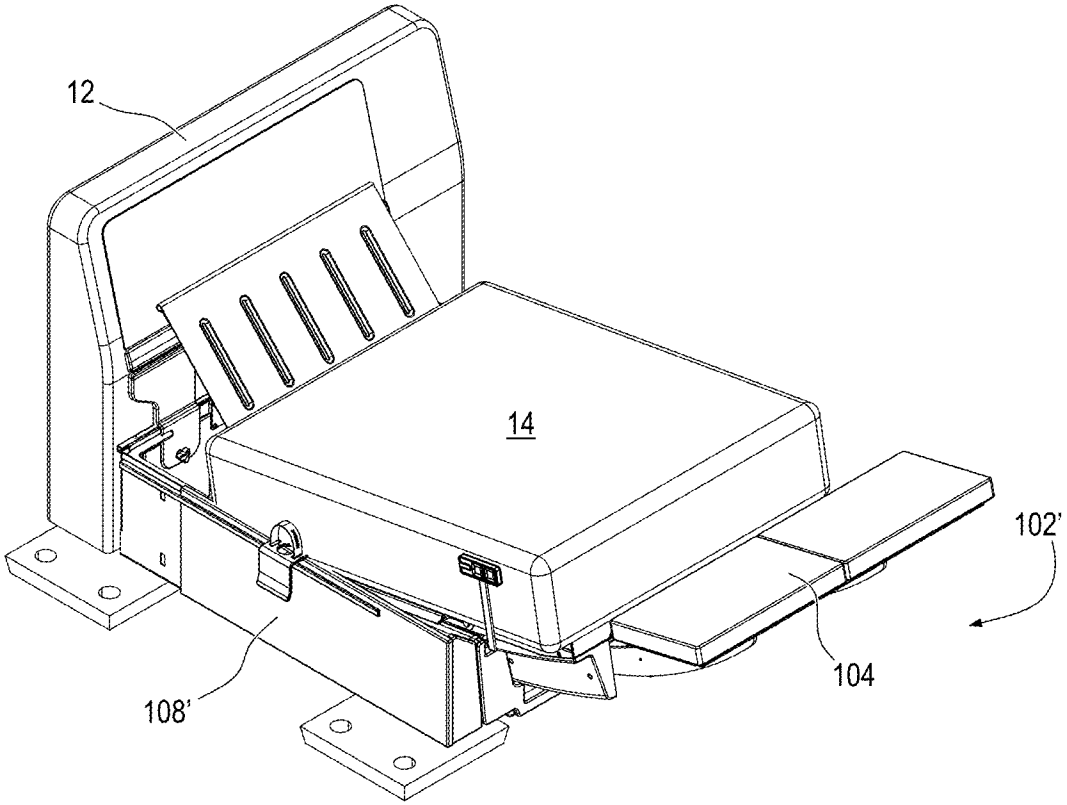
Figure 36:
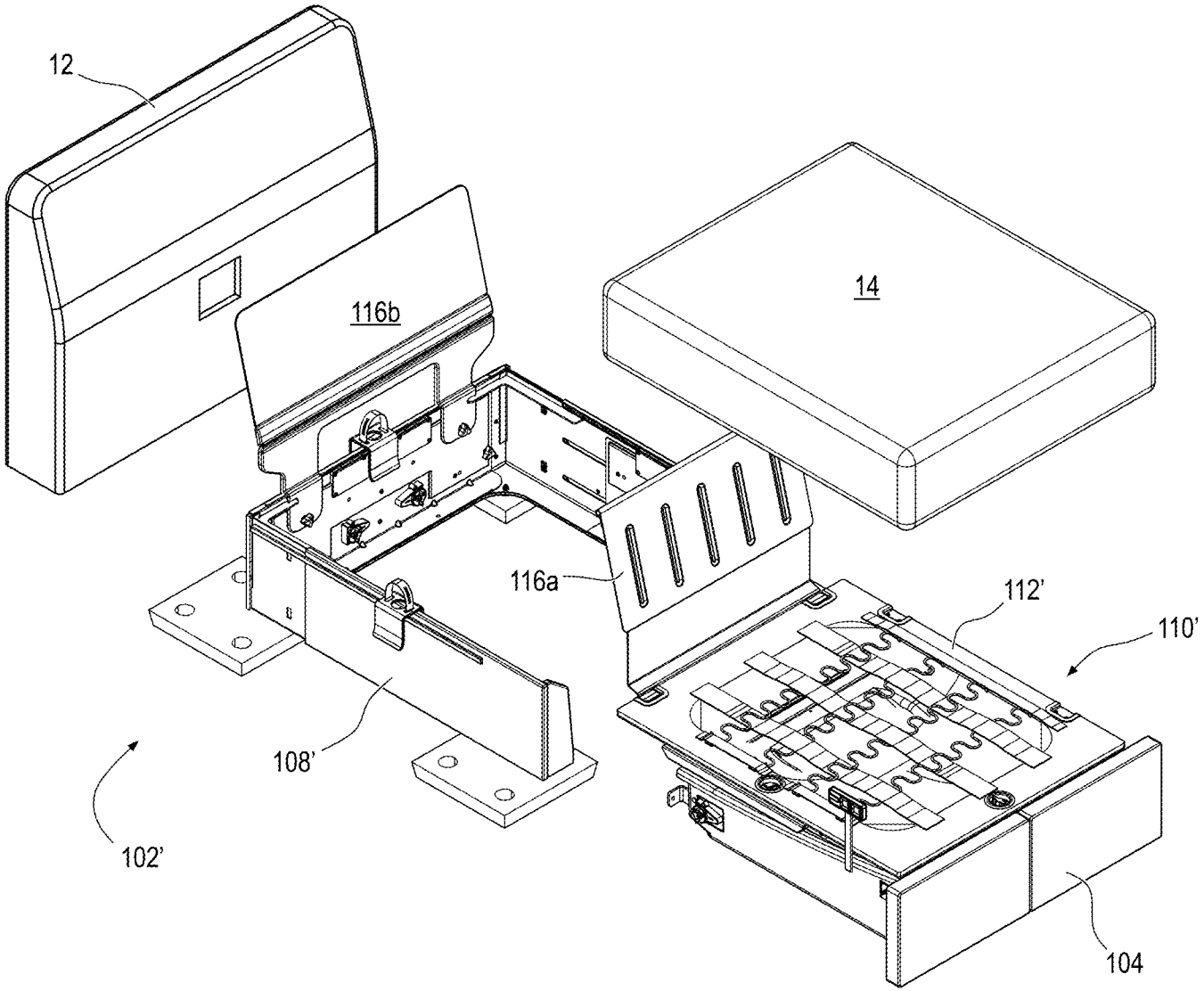
FIG. 36 shows components of the reclining assembly of FIGS. 34-35 in an exploded view.

FIGS. 34A-34B show an alternative embodiment of a modular furniture system of the present invention in a deep mode with an alternative reclining assembly 102' in respective non-reclined and reclined positions. FIG. 35A-35B show the reclining assembly 102' of FIGS. 34A-34B in a deep mode in respective non-reclined and reclined positions, with one adjoining upright member 12 removed. FIG. 36 shows components of the reclining assembly 102' of FIGS. 34-35 in an exploded view, in the deep orientation. Similar to the previously described embodiment, reclining assembly includes an adjustable frame 108', a reclining mechanism 110', and a seat lid 112'. One difference is that the illustrated reclining assembly 102' includes a two-part backrest member 116*a*, 116*b*. A first part of the backrest member 116*a* attaches to reclining mechanism 110', with a second part of the backrest member 116*b* also provided, attached to the adjustable frame 108'.

Figure 37B:
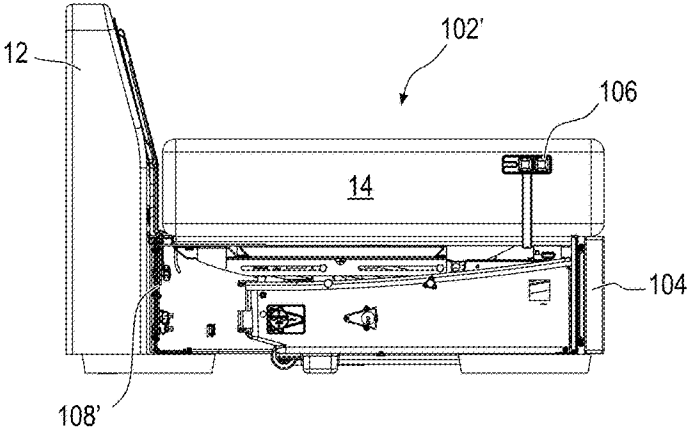
FIGS. 37A-37D show the reclining assembly of FIGS. 34-36 in a deep mode in non-reclined and reclined positions with portions of the adjustable frame shown and not shown.
Figure 37A:
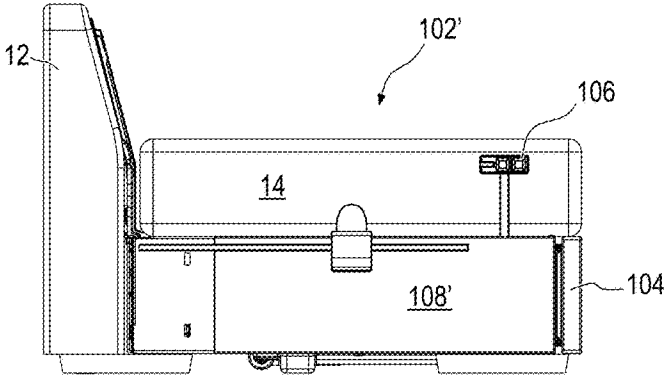
Figure 37D:
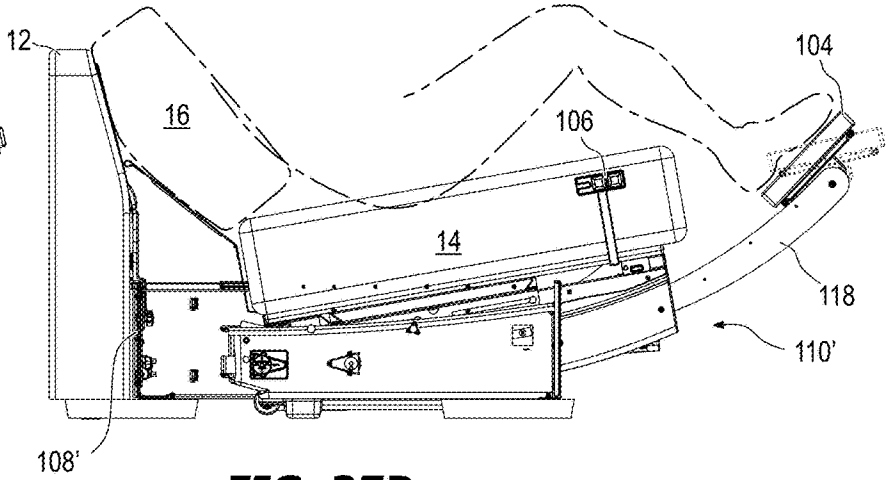
Figure 37C:
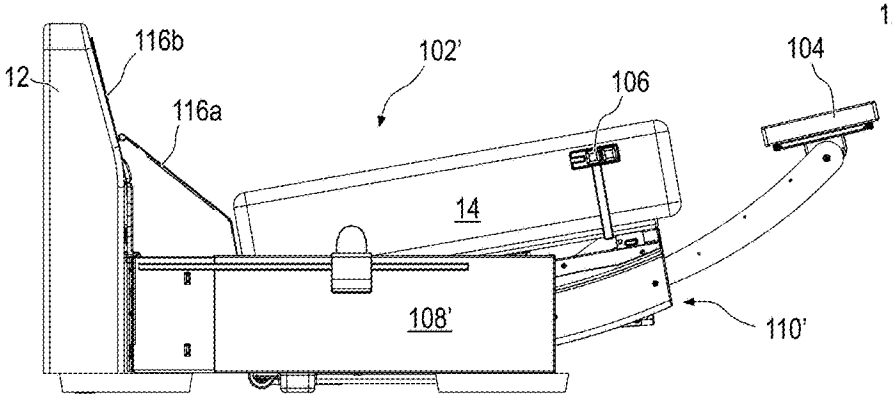

FIGS. 37A-37D show the reclining assembly of FIGS. 34-36 in a deep mode in non-reclined and reclined positions with portions of the adjustable frame shown (FIGS. 37A and 37C) and not shown (FIGS. 37B and 37D).

Figure 38A:
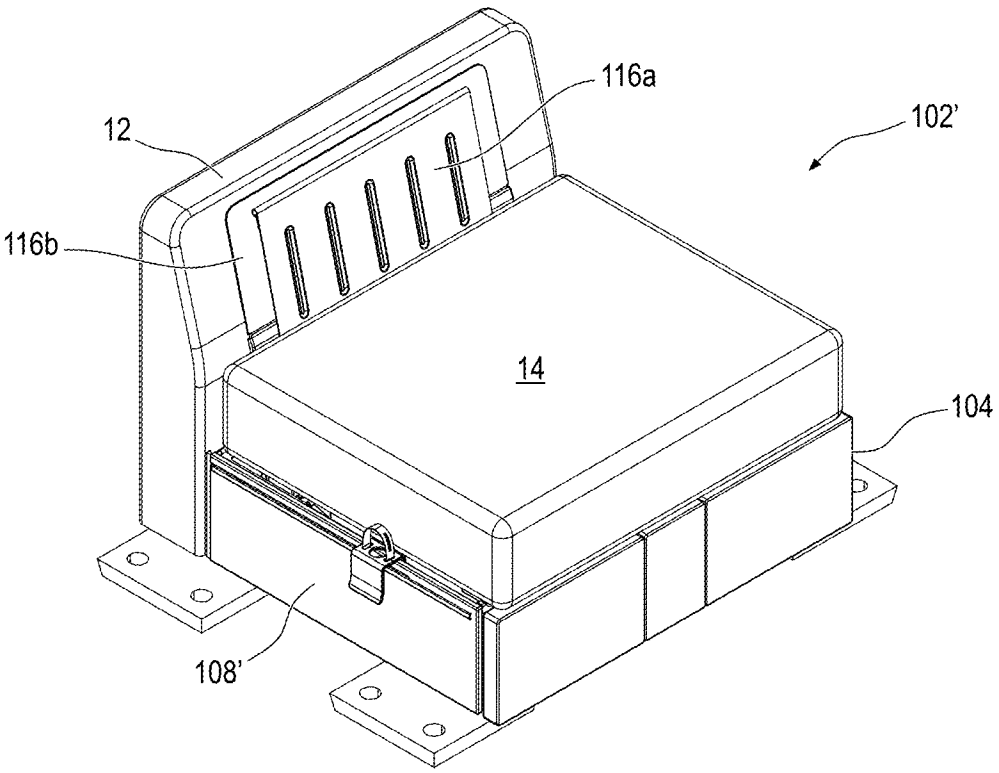
FIGS. 38A-38B show the reclining assembly of FIGS. 34-37 having been converted into a wide mode.
Figure 38B:
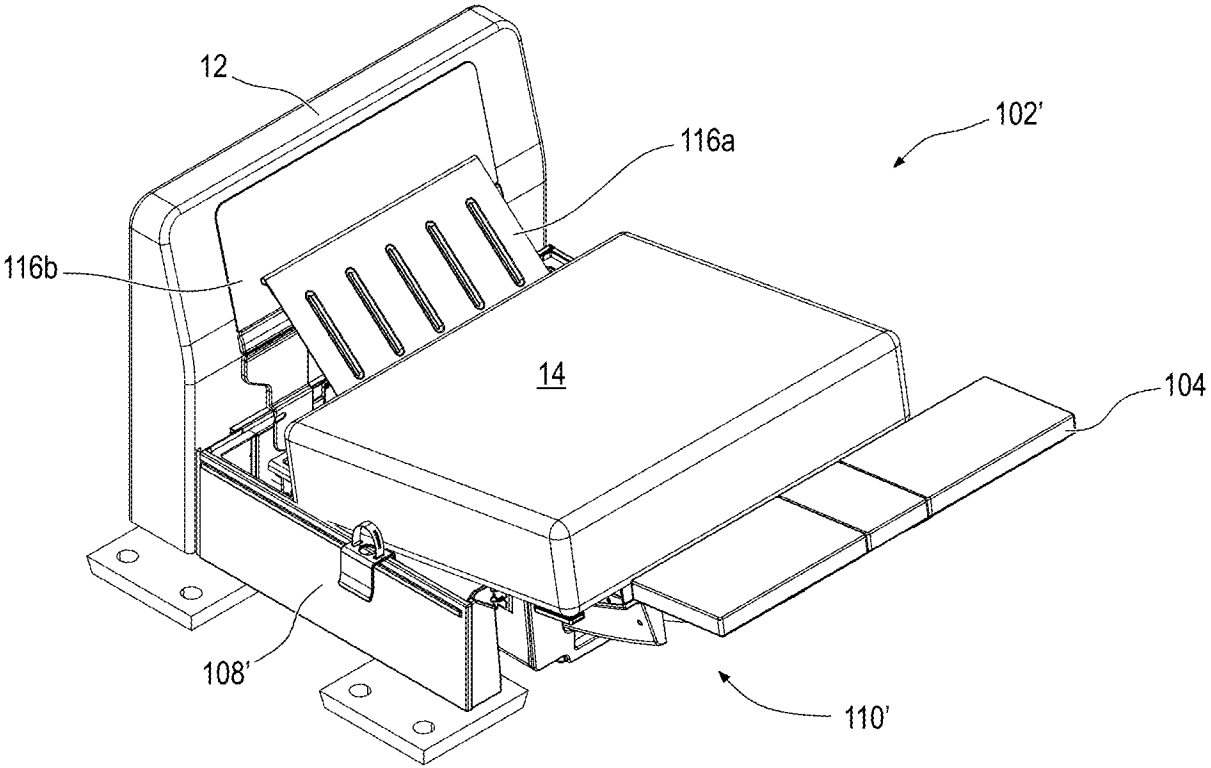
Figure 39:
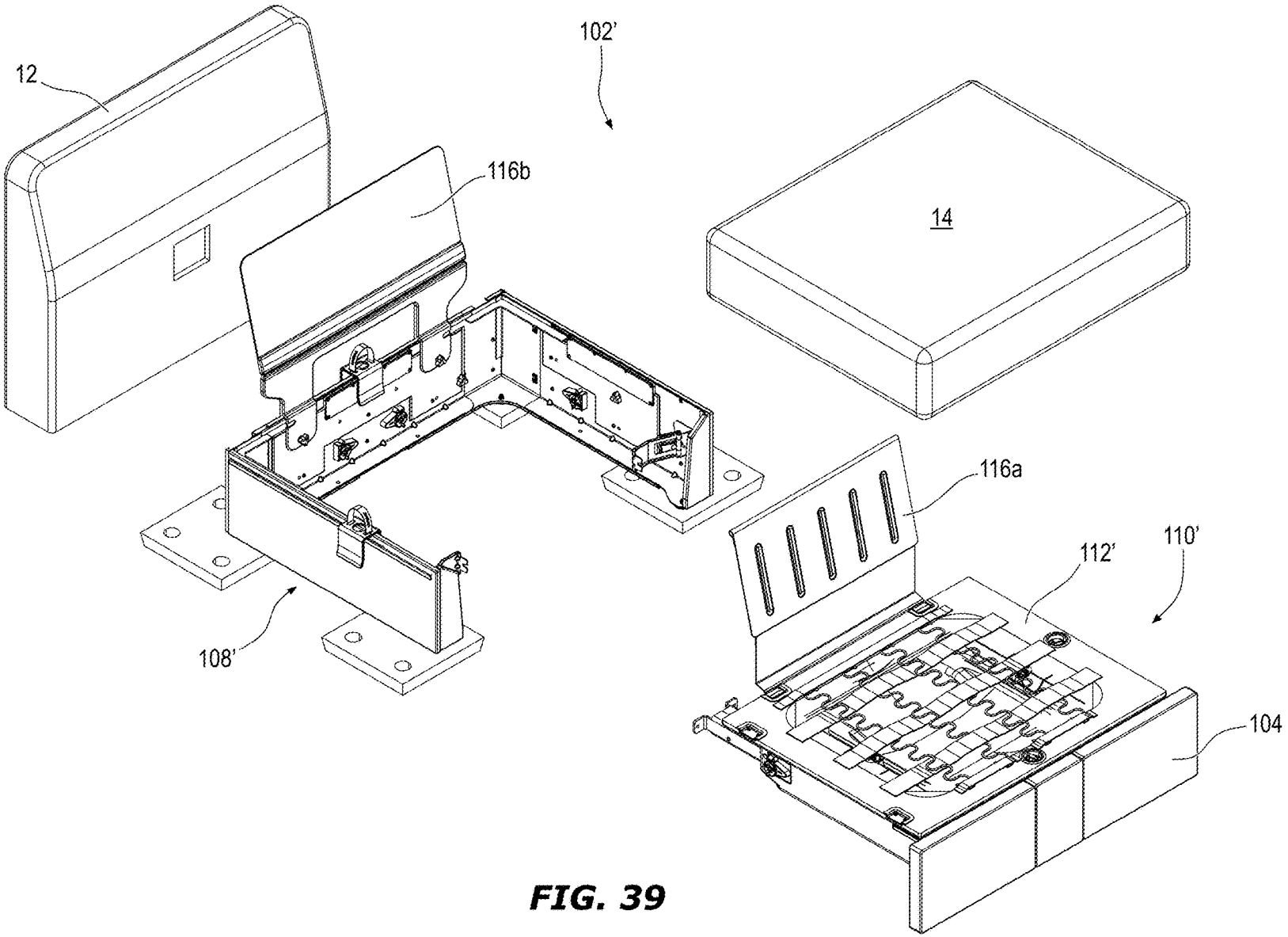
FIG. 39 shows components of the reclining assembly of FIGS. 34-38 in an exploded view, wide mode.

FIGS. 38A-38B show the reclining assembly 102' of FIGS. 34-37 having been converted into a wide mode. FIG. 39 shows components of the reclining assembly 102' of FIGS. 34-38 in an exploded view, in the wide mode. As shown, reclining mechanism 110' is dockable into adjustable outer frame 108'. Frame 108' is adjustable from a wide to deep mode, and vice versa, depending on the desire of the user. Various thumb screws, latches, brackets, or the like may be used to secure the members of the frame 108' in the desired mode. Similar securing mechanisms of a wide variety can be used to hold the reclining mechanism 110' within the adjustable frame 108', as will be apparent.

Figure 40:
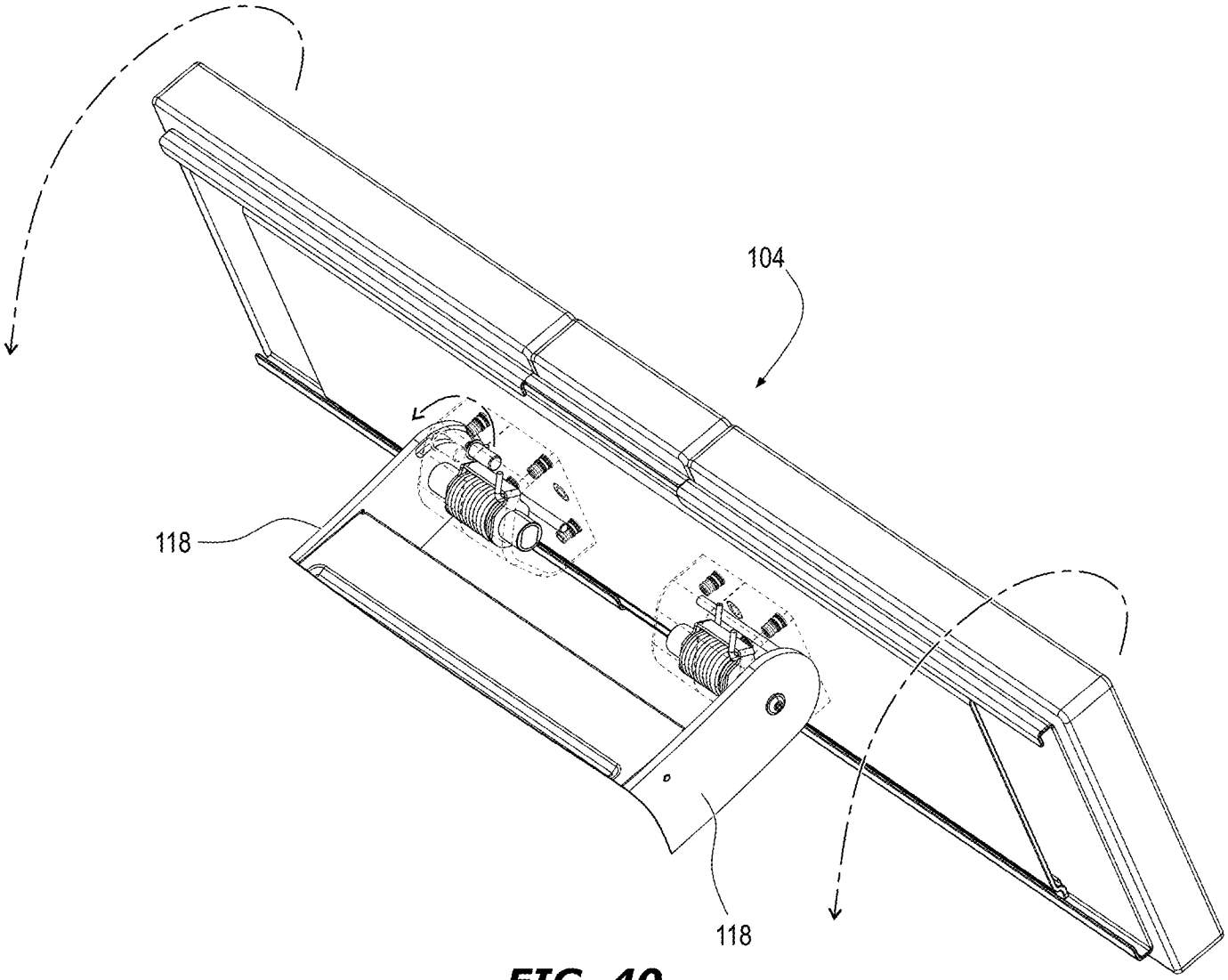
FIG. 40 shows a view of the footplate of the reclining assembly of FIGS. 34-39.

FIG. 40 shows a view of the footplate 104 of the reclining assembly of FIGS. 34-39. Similar to the previously described embodiment, footplate 104 may provide a default orientation that is substantially horizontal, e.g., substantially parallel to a seat cushion 14, but can be spring biased to allow a user to rotate the footplate 104 counterclockwise or clockwise, as desired. In an embodiment, a home default position for the footplate may include no spring tension (e.g., tension is applied by the spring as one applies a force to go out of such default position).

Figure 41:
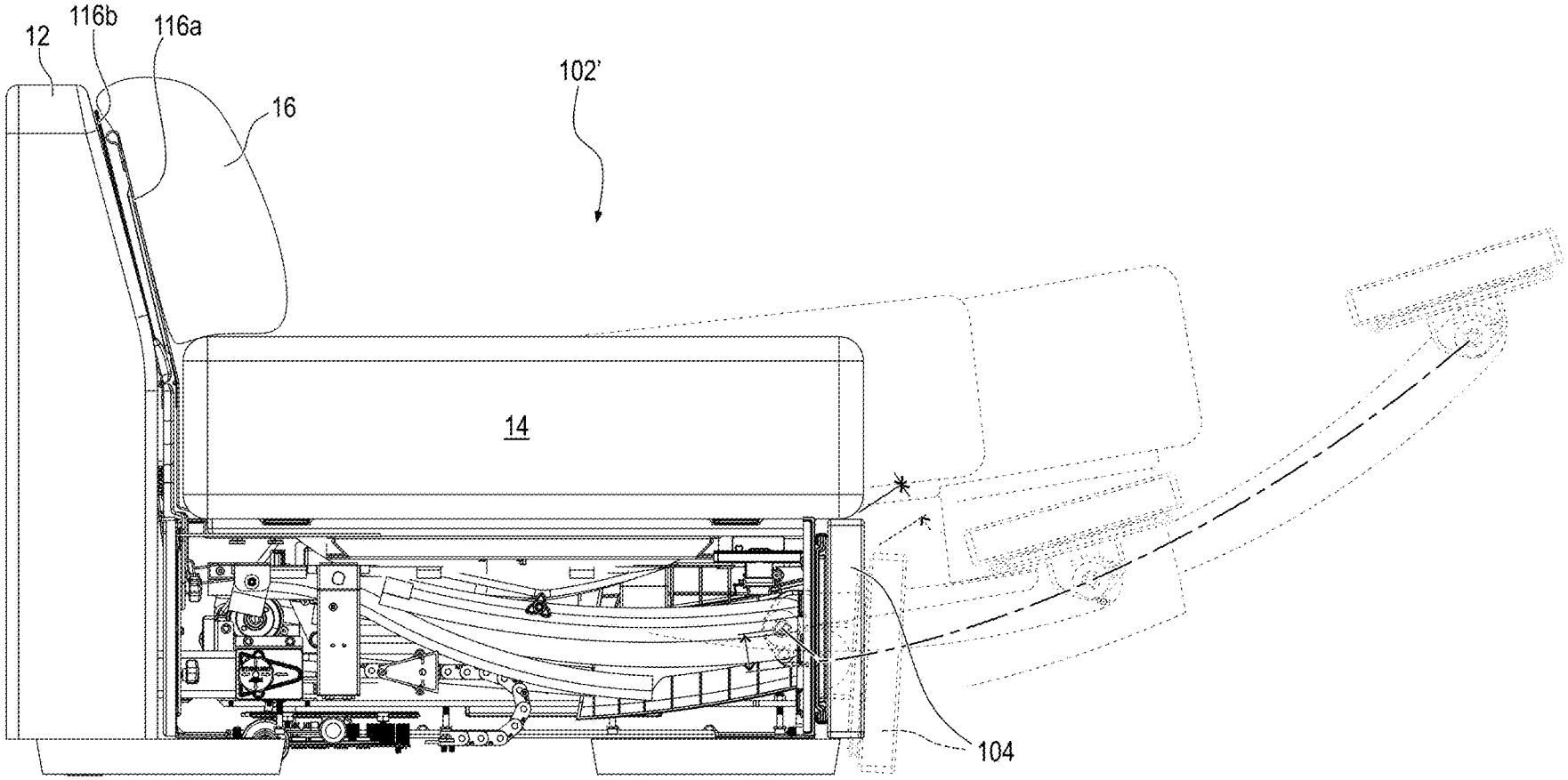
FIGS. 41-43 show a progression of the reclining mechanism of the reclining assembly of FIGS. 34-40, showing a progression of the reclining assembly from non-reclined position (FIG. 41), to preparing to recline by lowering the footplate (FIG. 42) to fully reclined (FIG. 43).
Figure 42:
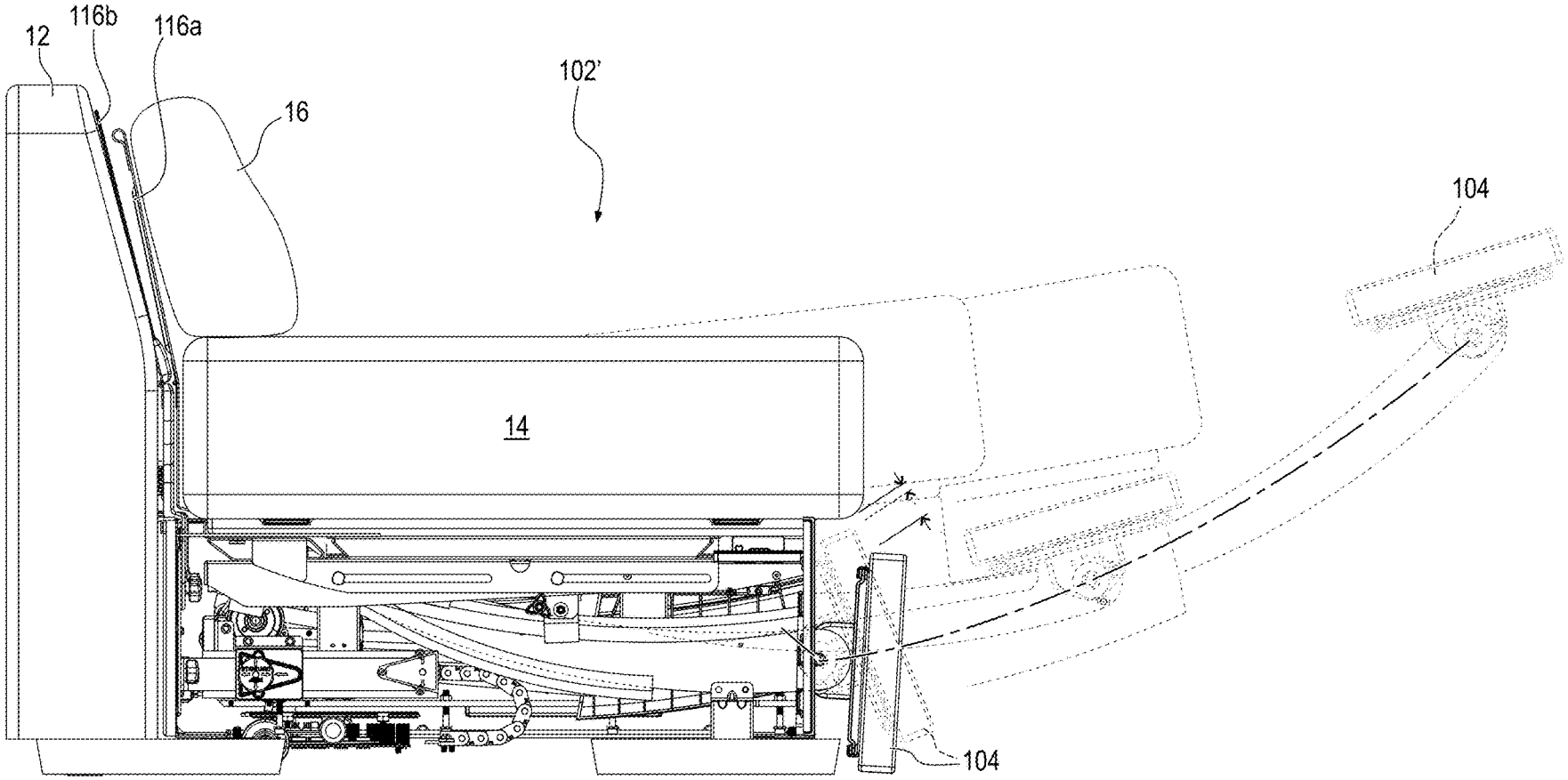
Figure 43:
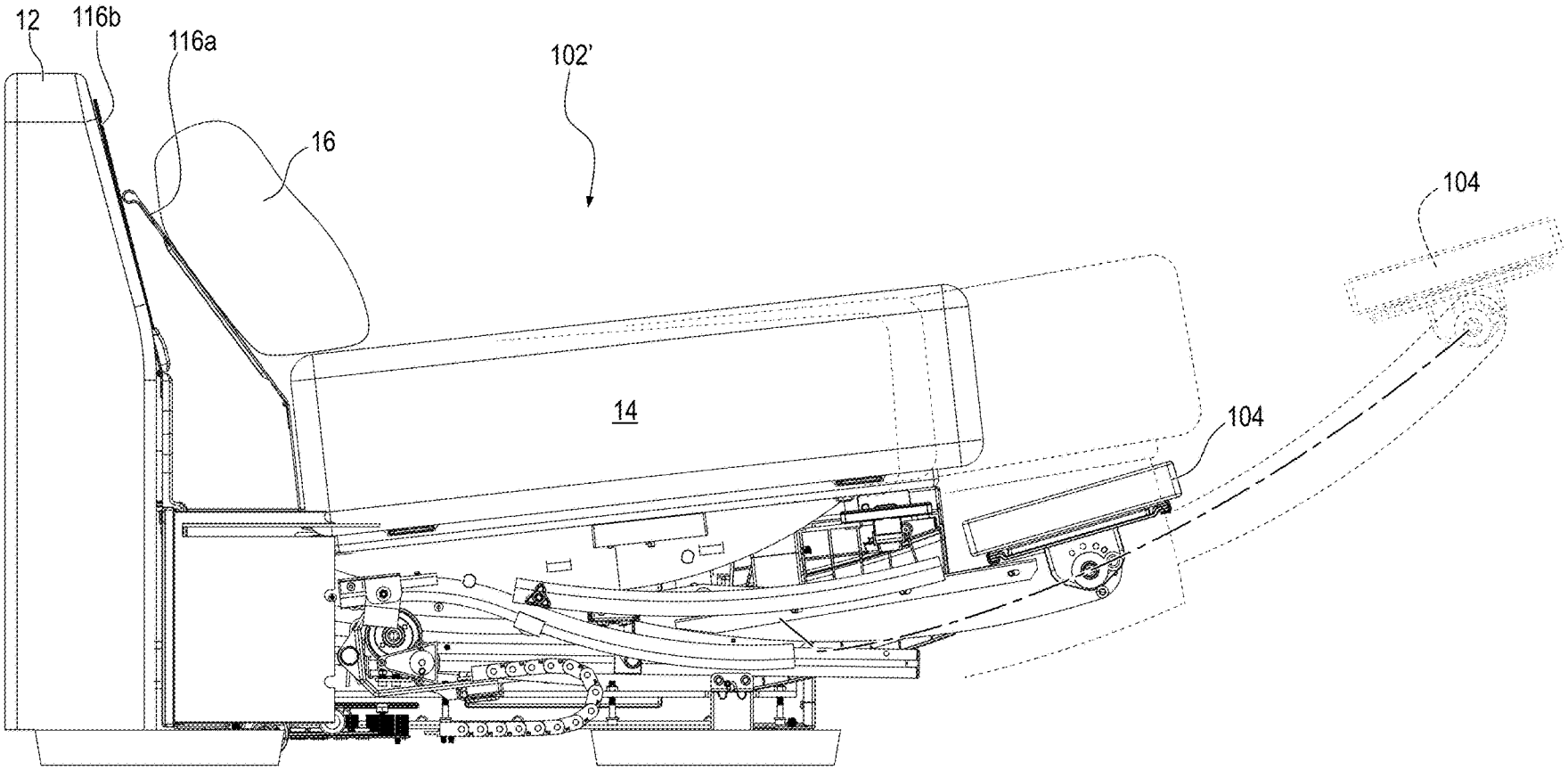

FIGS. 41-43 show a progression of the reclining mechanism 110' of the reclining assembly of FIGS. 34-40, showing a progression of the reclining assembly from non-reclined position (FIG. 41), to preparing to recline by lowering the footplate (FIG. 42) to fully reclined (FIG. 43). As shown, this embodiment addresses the issue of interference between the cushion 14 and the top of the footplate 104 in a different manner. As shown in FIG. 42, in order to avoid contact interference between such structures, the reclining mechanism 110' is configured to first provide a downward movement to footplate 104 (towards the floor), after which the movement of the reclining arms 118 and footplate 104 assumes an upward arcuate pathway, similar to that of the previously described embodiment. Here the interference is addressed by dropping the footplate, rather than raising the seat lid 112. It will be apparent that a variety of configurations are possible for addressing such an issue of interference, and the described embodiments are merely exemplary. Others are of course also possible.

Figure 44:
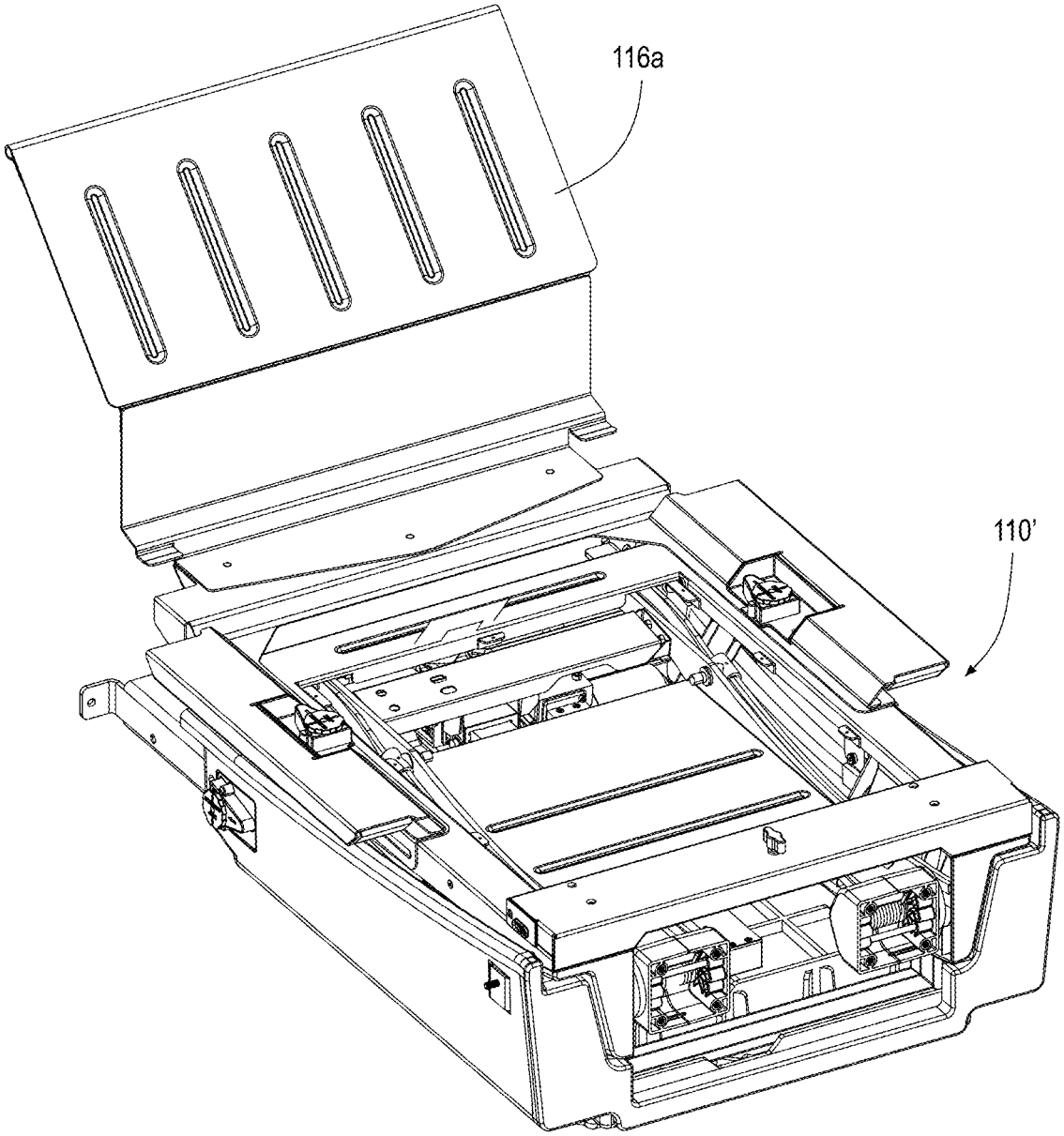
FIG. 44 shows the reclining mechanism of the invention of FIGS. 34-43.
Figure 45:
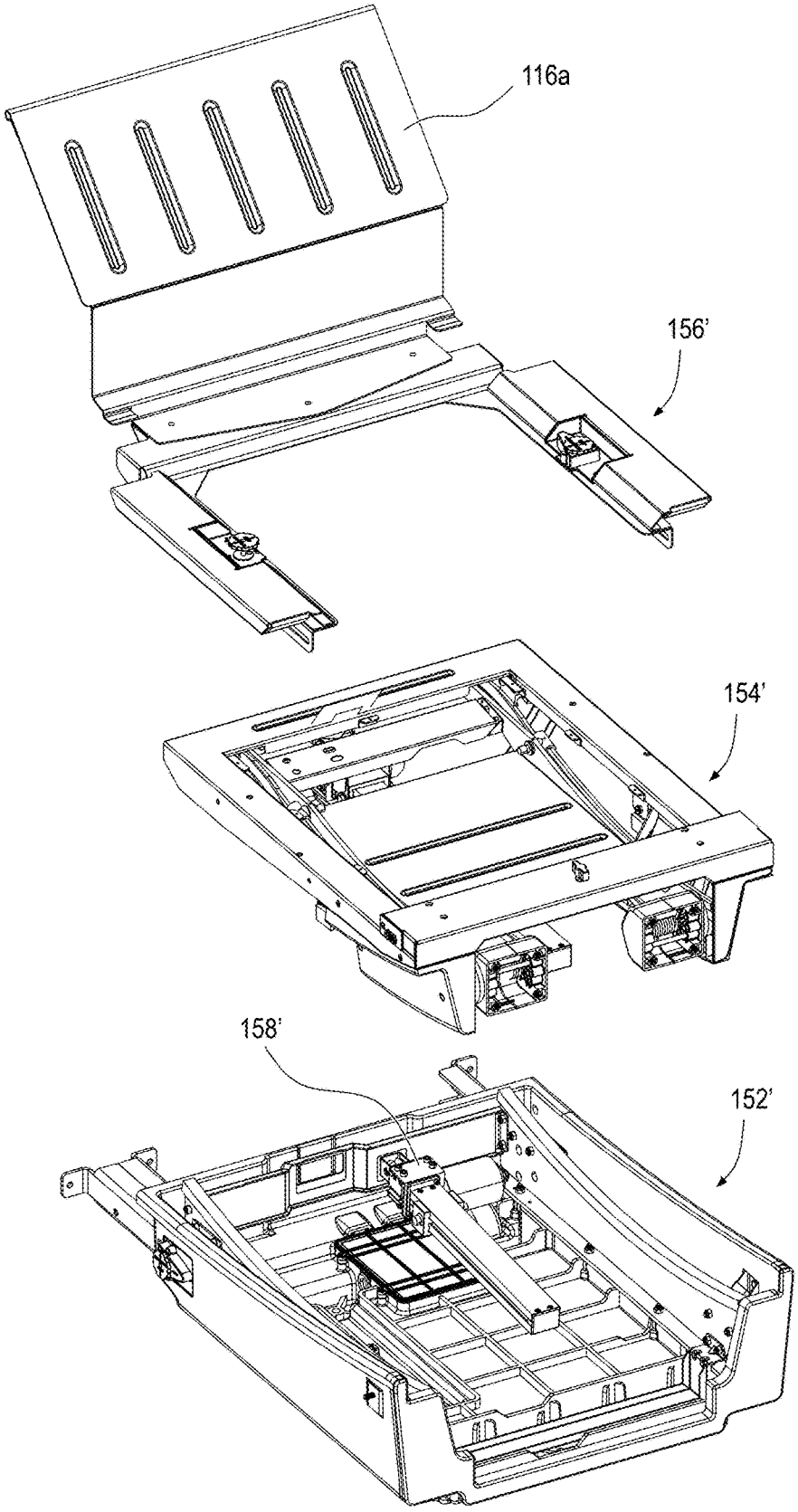
FIG. 45 shows the reclining mechanism of the invention of FIGS. 34-44 in an exploded view.

FIG. 44 shows the reclining mechanism 110' of the invention of FIGS. 34-43. FIG. 45 shows the reclining mechanism of the invention of FIGS. 34-44 in an exploded view. The reclining mechanism 110' includes a fixed lower carriage portion 152', an upper carriage portion 154' that is movable relative to the fixed lower carriage portion 152', and a movable member 156' is attached over upper carriage portion 154'. Movable member 156' is slidably attached to upper carriage portion 154', e.g., to be slid forward or backward depending on whether the wide mode or deep mode is selected (e.g., so as to position backrest member 116*a* in the proper position).

Figure 46:
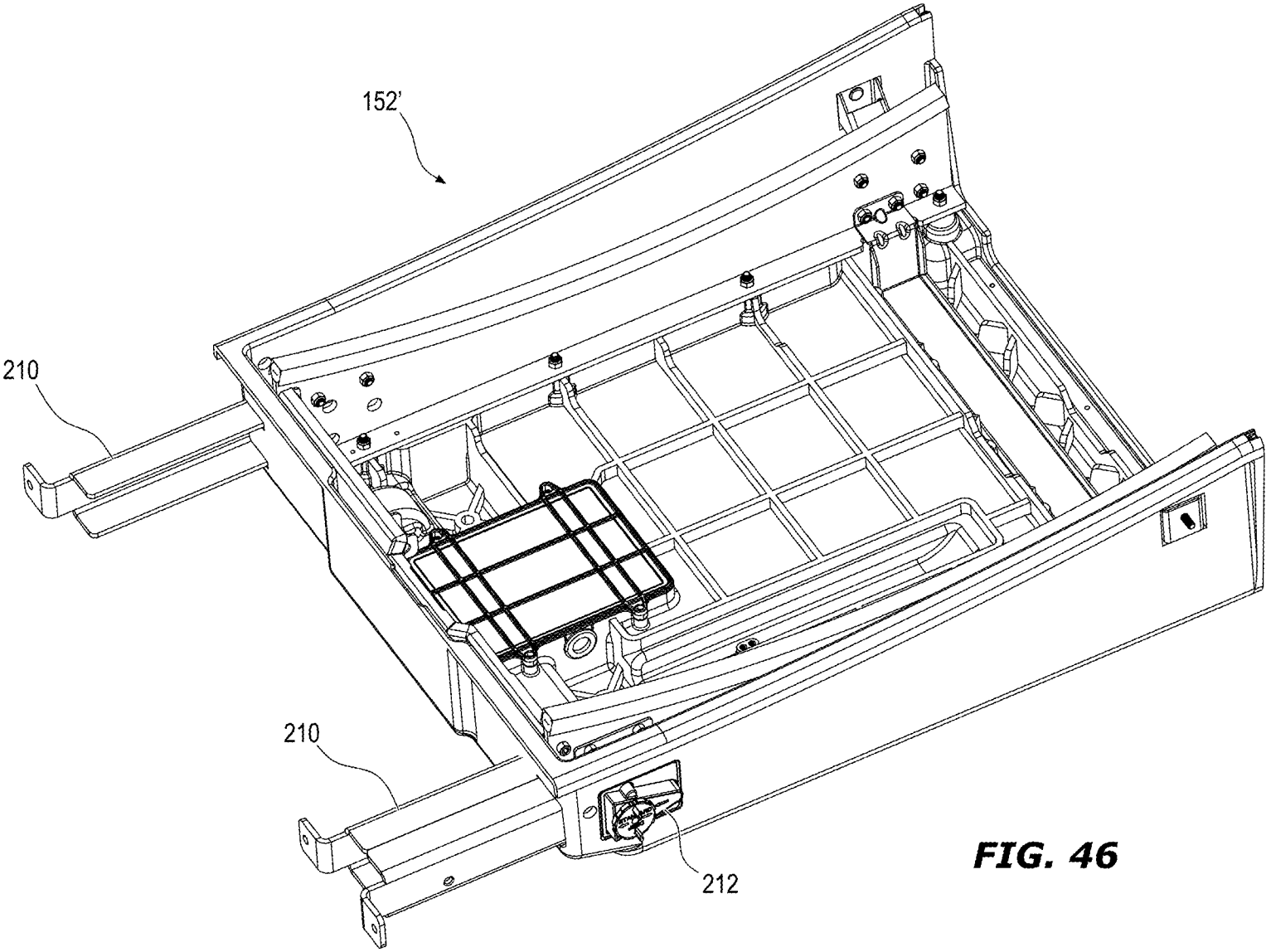
FIG. 46 shows the lower carriage portion of the reclining mechanism of FIGS. 34-45.

FIG. 46 shows the lower carriage portion 152' of the reclining mechanism 110' of FIGS. 34-45. Lower carriage portion 152' includes an actuator 158', attached to lower carriage portion 152', while the driving end of actuator 158' is attached to, and drives upper carriage portion 154', similar to the arrangement of the previously described embodiment. Lower carriage portion 152' also includes extension rails 210 which are adjusted in length, e.g., using lever 212, depending on whether the wide or deep mode is to be selected.

Figure 47A:
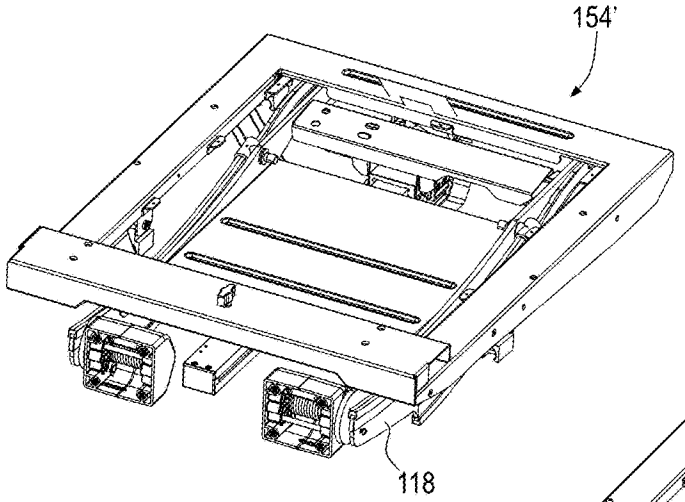
FIGS. 47A-47C shows the upper carriage portion of the reclining mechanism of FIGS. 34-46, showing a progression of the reclining mechanism from non-reclined position (47A), to preparing to recline by lowering the footplate (FIG. 47B) to fully reclined (FIG. 47C).
Figure 47B:
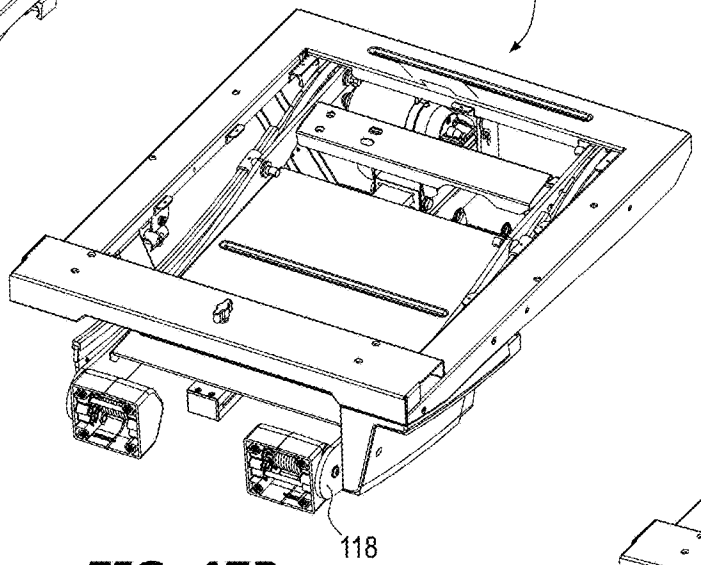
Figure 47C:
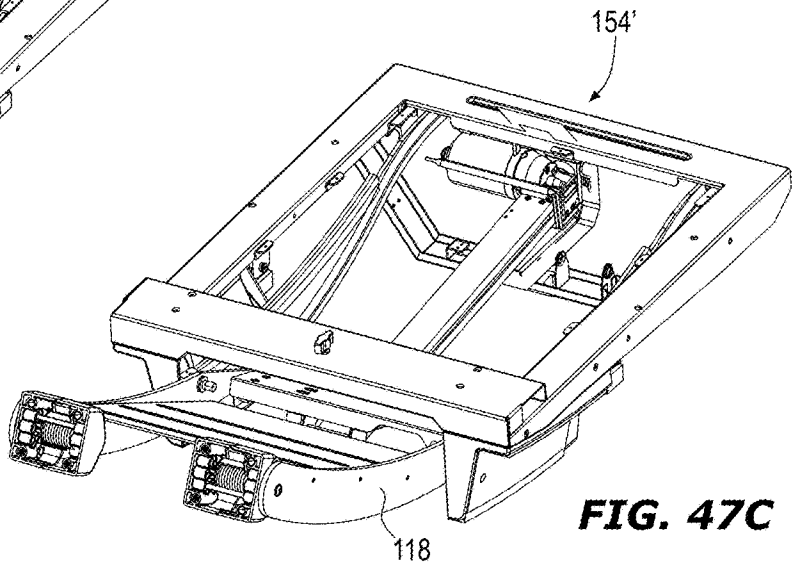
Figure 48A:
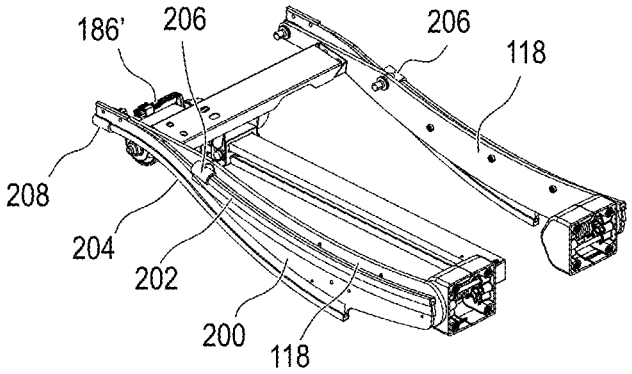
FIGS. 48A-48C show right and left reclining arms moveably mounted on respective right and left ramps of the upper carriage portion of the reclining mechanism of FIGS. 34-47, showing a progression of the reclining assembly from non-reclined position (48A), to preparing to recline by lowering the footplate (FIG. 48B) to fully reclined (FIG. 48C).
Figure 48B:
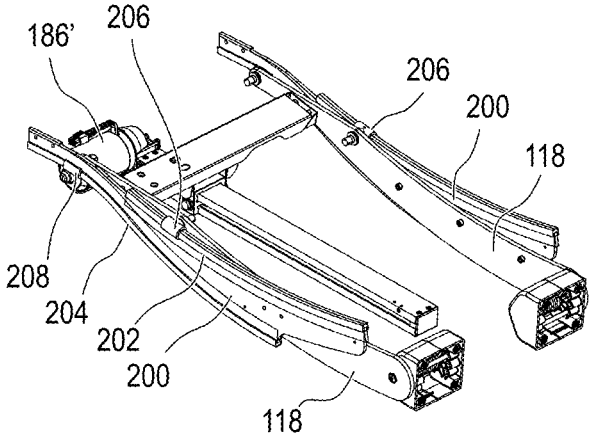
Figure 48C:
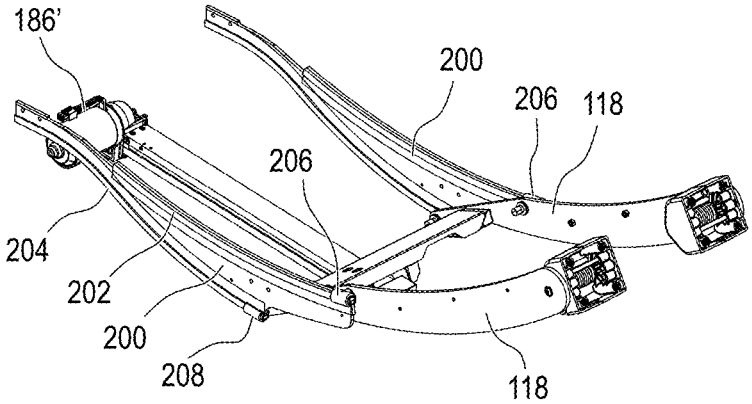
Figure 49B:
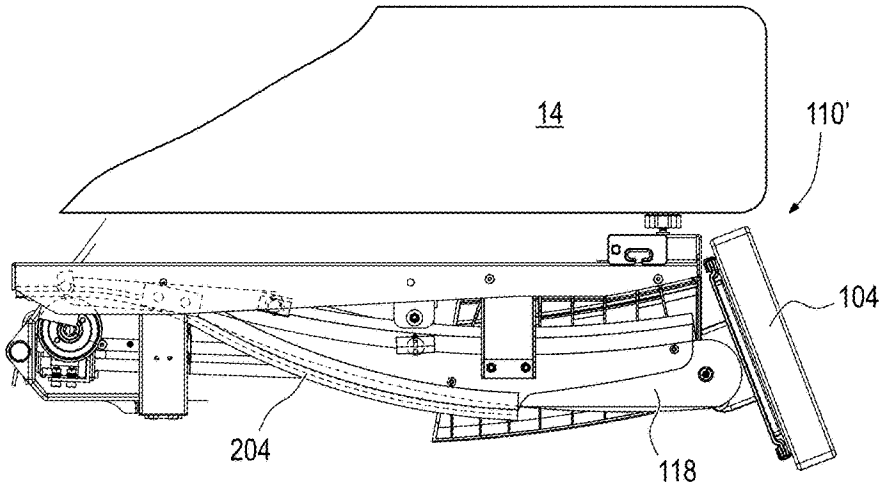
FIGS. 49A-49C show a further progression of the reclining mechanism of FIGS. 34-48 from a non-reclined position (49A), to preparing to recline by lowering the footplate (FIG. 49B) to partially and fully reclined (FIG. 49C).
Figure 49A:
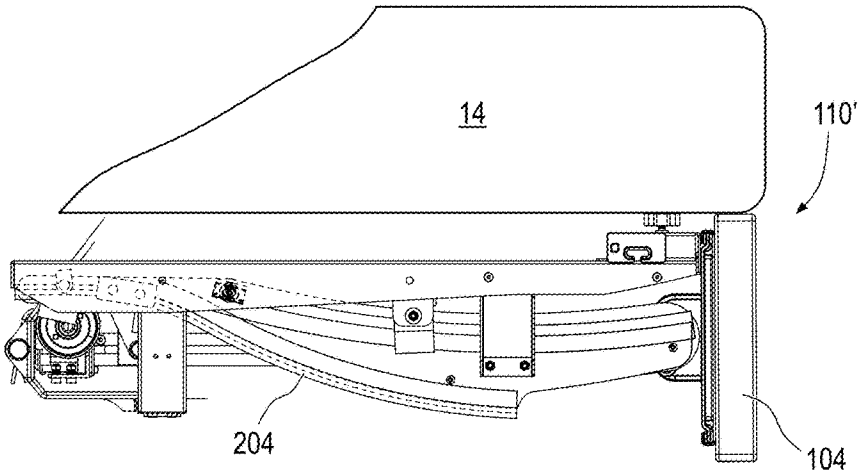
Figure 49C:
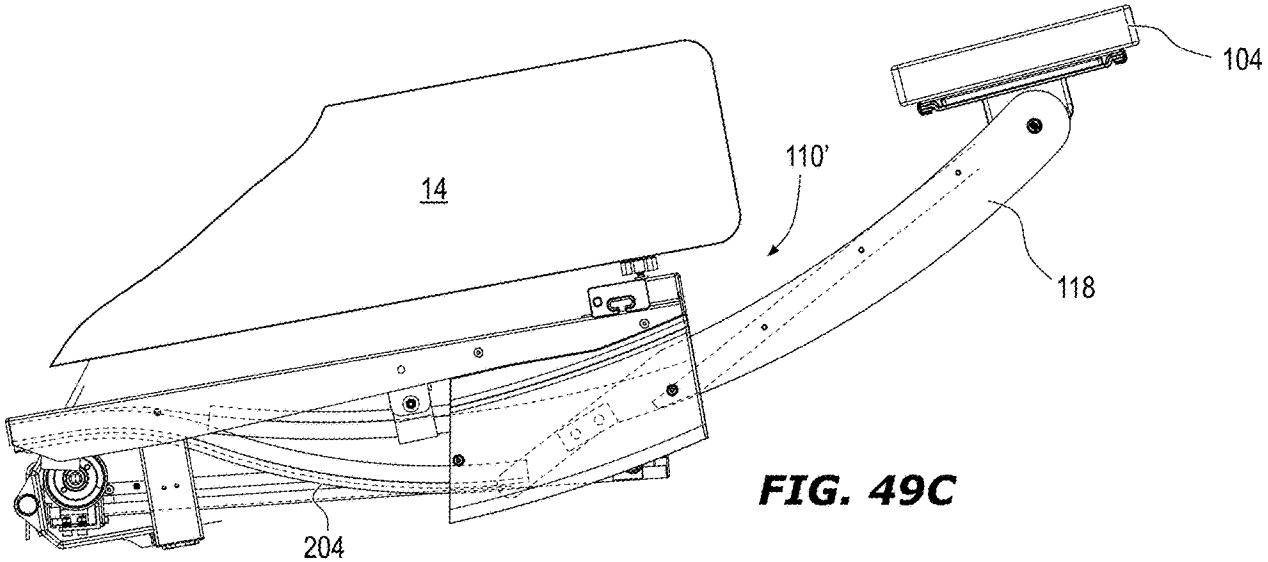

FIGS. 47A-47C shows the upper carriage portion 154' of the reclining mechanism 110' of FIGS. 34-46, showing a progression of the reclining mechanism from a non-reclined position (47A), to preparing to recline by lowering the footplate (FIG. 47B) to fully reclined (FIG. 47C). FIGS. 48A-48C show right and left reclining arms moveably mounted on respective right and left ramps 200 of the upper carriage portion 154' of the reclining mechanism of FIGS. 34-47, showing a progression of the reclining assembly from non-reclined position (48A), to preparing to recline by lowering the footplate (FIG. 48B) to fully reclined (FIG. 48C). Such movement of the footplate and reclining arms 118 is achieved through the actuator 186', attached to upper carriage portion 154'. FIGS. 49A-49C show a further progression of the reclining mechanism of FIGS. 34-48 from a non-reclined position (49A), to preparing to recline by lowering the footplate (FIG. 49B) to partially and fully reclined (FIG. 49C). As shown, the ramps 200 include upper and lower guide rods 202, 204. Upper and lower slides 206 and 208 ride on guide rods 202, 204, in a defined, spaced apart relationship. Slides 206 and 208 are pivotable relative to the reclining arms 118, to which they are pivotally attached.

As shown in FIGS. 48A-48C, a first upper sliding member 206 is rotatably connected to a first reclining arm and slides on an upper surface of the first ramp, while a first lower sliding member 208 is rotatably connected to the first reclining arm and slides on a lower surface of the first ramp. In addition, a second upper sliding member 206 is rotatably connected to the second reclining arm and slides on an upper surface of the second ramp, while a second lower sliding member 208 is rotatably connected to the second reclining arm and slides on a lower surface of the second ramp. As a result, movement of the first and second reclining arms along the first and second ramps causes each of the first and second reclining arms to rotate with respect to the first and second ramps, such that the footplate connected to the first and second reclining arms (i) first moves downwardly, then (ii) later moves upwardly.

The illustrated configuration of upper and lower guide rods, with upper and lower slides that ride on the guide rods, and are pivotally connected to the reclining arms 118, where such pathways are non-parallel, allow for the footplate to exhibit an initial downward movement, towards the floor, followed by an arcuate upward movement, as shown.

Figure 50:
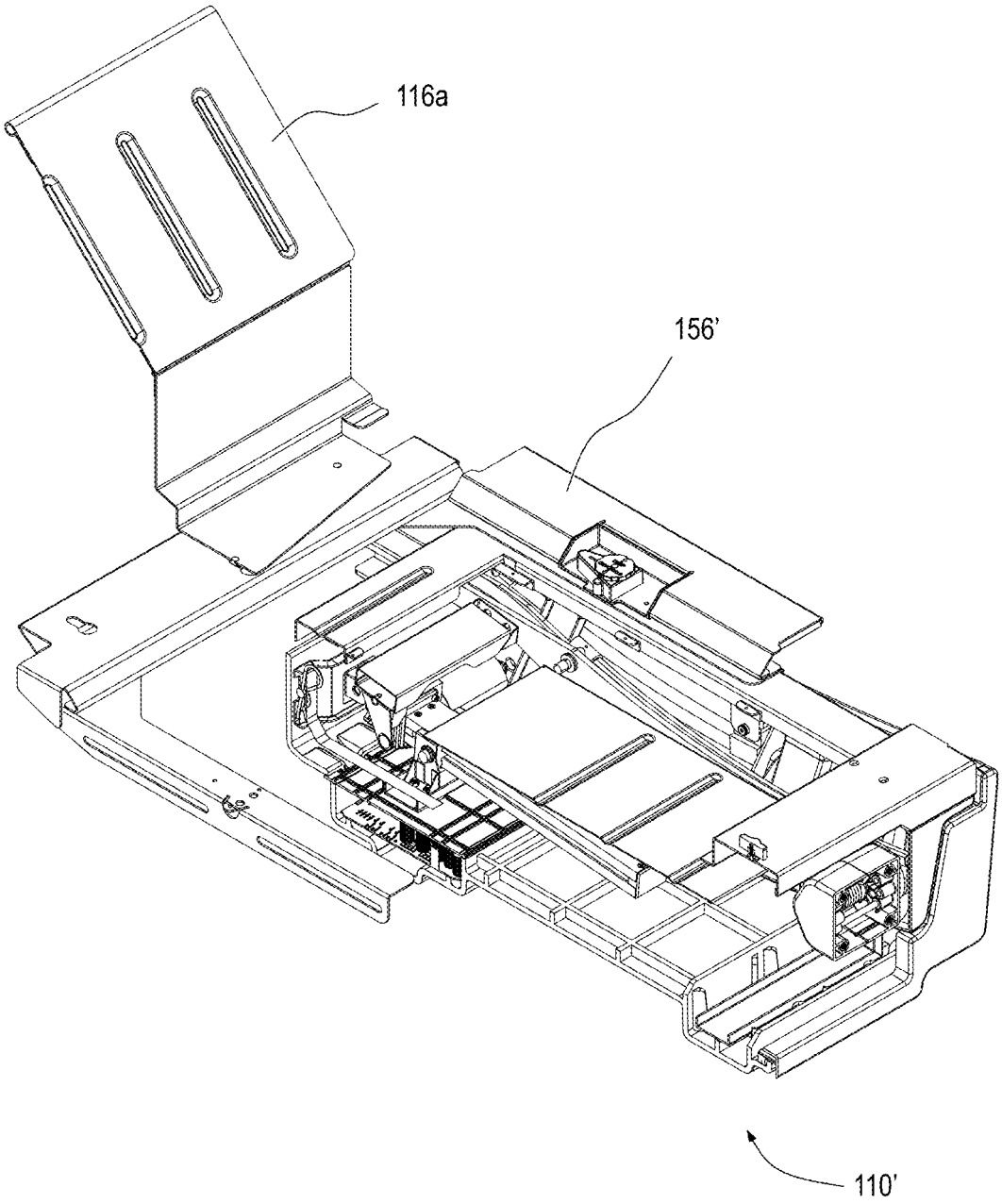
FIG. 50 shows a cutaway view of the reclining assembly of FIGS. 34-49 in a non-reclined position.
Figure 51A:
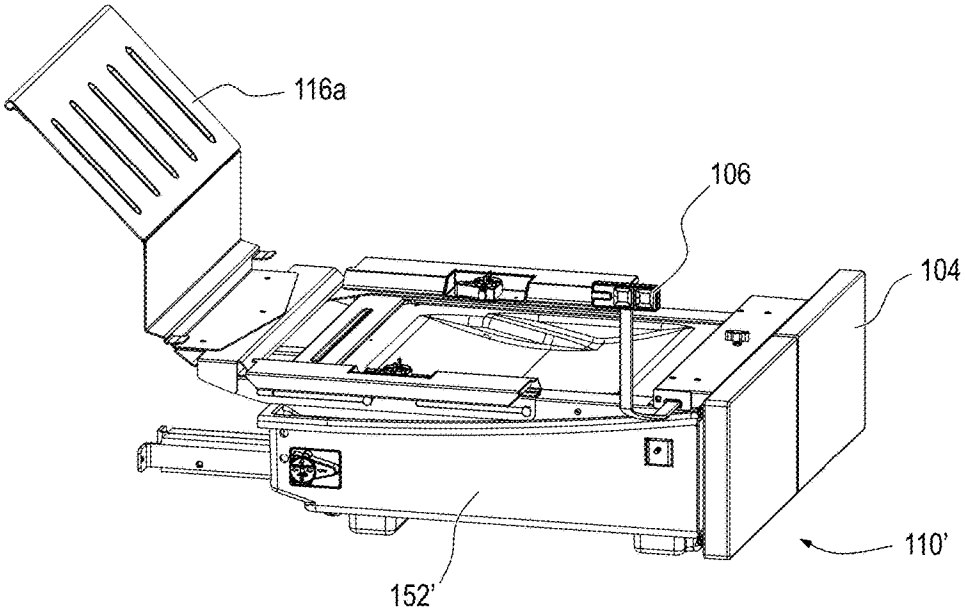
FIGS. 51A-51B show a progression of the reclining mechanism of FIGS. 34-50 from a non-reclined position to a reclined position.
Figure 51B:
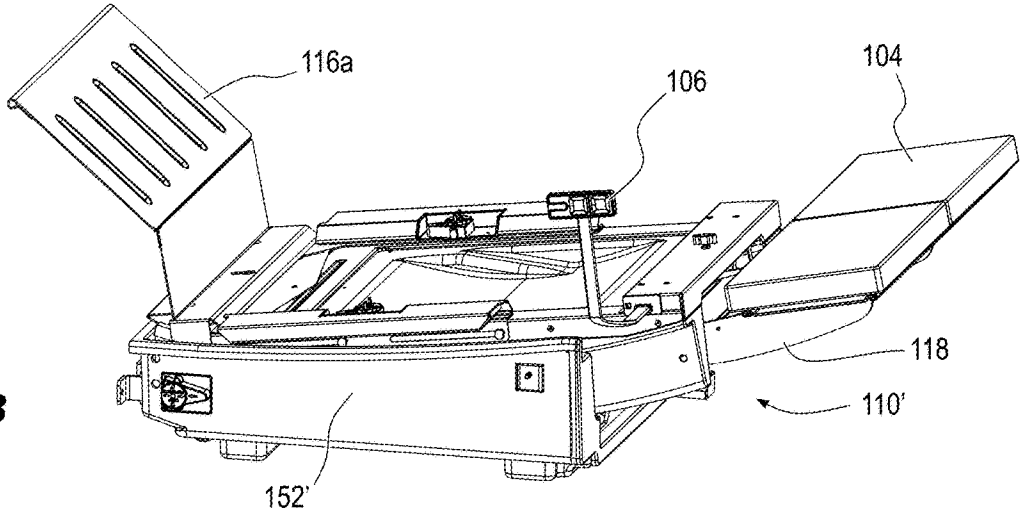

FIG. 50 shows a cutaway view of the reclining assembly of FIGS. 34-49 in a non-reclined position. FIGS. 51A-51B show a progression of the reclining mechanism of FIGS. 34-50 from a non-reclined position to a reclined position.

Figure 52A:
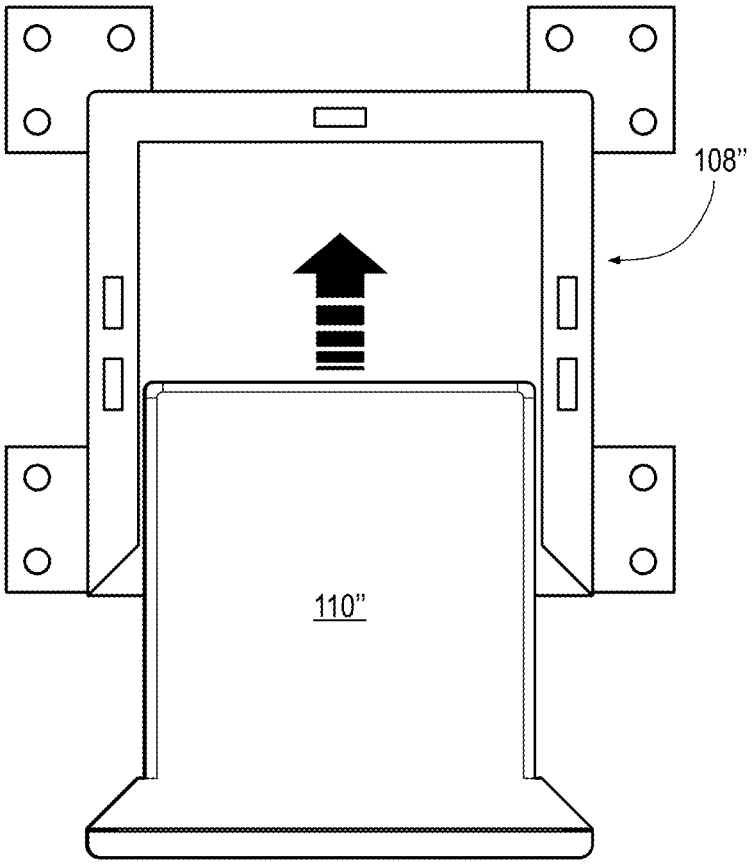
FIGS. 52A and 52B show another embodiment of a reclining assembly of the present invention in which the outer frame is a fixed outer frame in a substantially U-shape, and is not adjustable. Such a configuration may be less complex, require less parts, and be less expensive to manufacture.
Figure 52B:
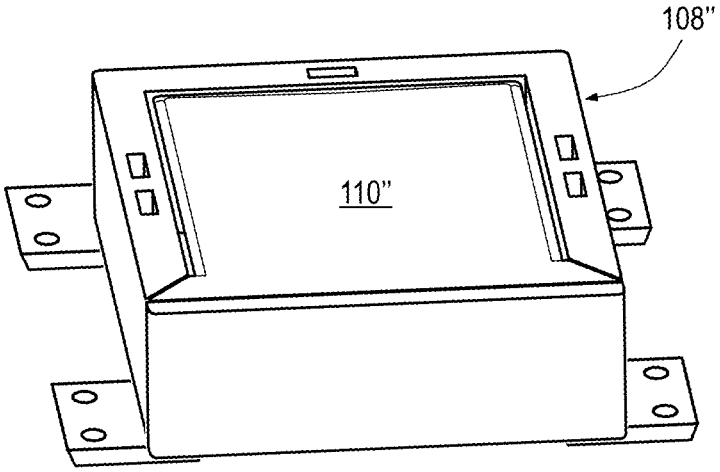

FIGS. 52A and 52B show another embodiment of a reclining assembly of the present invention, for use in a modular furniture system, in which the outer frame is a fixed outer frame 108" in a substantially U-shape, and is not adjustable. The modular reclining mechanism 110" (e.g., having features of any of the reclining assemblies or frames described herein) may be dockable into such frame. Such a configuration may be less complex, require less parts, and be less expensive to manufacture.

Figure 53A:
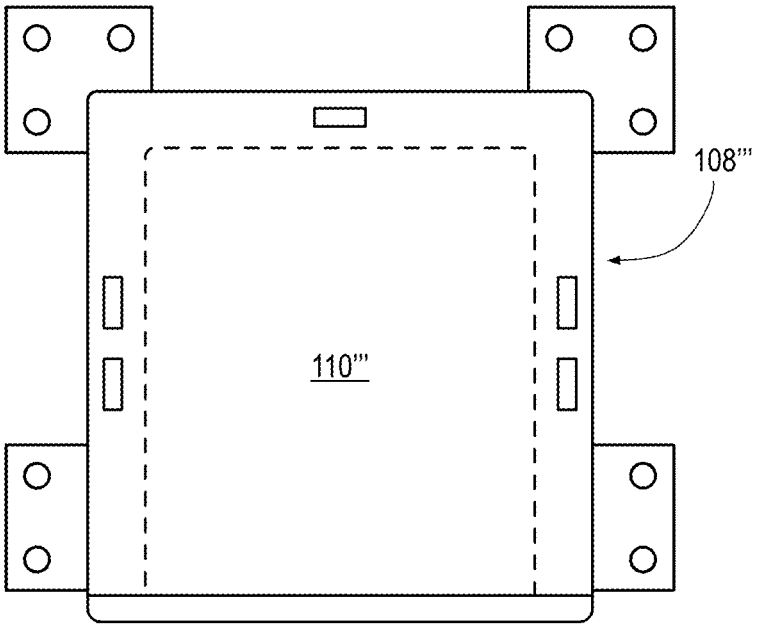
FIGS. 53A-53B show another embodiment of a reclining assembly of the present invention in which the outer frame is similarly fixed, so as to not be adjustable, and which is integrated with the reclining mechanism. In other words, the reclining mechanism is not removable from the outer frame. The upper and lower carriage portions may be housed within a fixed outer frame, where the carriage portions are not removable. Such a configuration may be less complex, require less parts, and be less expensive to manufacture.
Figure 53B:
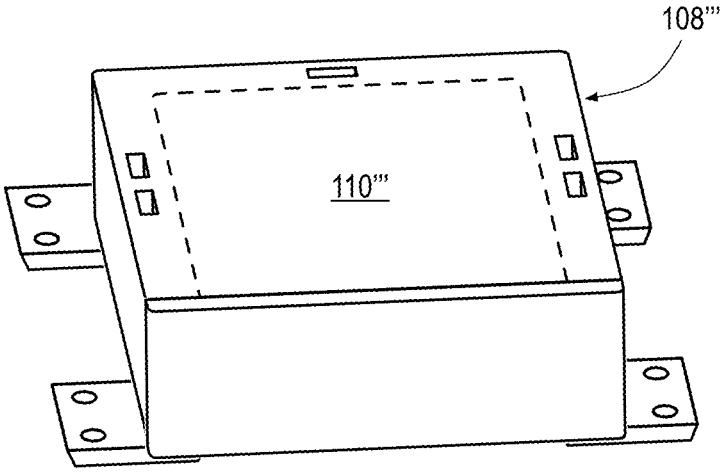

FIGS. 53A-53B show another embodiment of a reclining assembly of the present invention, for use in a modular furniture system, in which the outer frame 108'" is similarly fixed, so as to not be adjustable, and which is integrated with the reclining mechanism 110'". In other words, the reclining mechanism 110'" is not removable from the outer frame 108'''. The upper and lower carriage portions may be housed within a fixed outer frame, where the carriage portions are not removable. Such a configuration may be less complex, require less parts, and be less expensive to manufacture. Similar to the embodiment described above, any of the features described with respect to the other embodiments can be included within such an embodiment.

While, shown square in FIGS. 52A-53B, in another embodiment, the frame may have a rectangular shape, that is not square, with two longer sides and two shorter sides.

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component can generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it can be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

As used herein, the term "between" includes any referenced endpoints. For example, "between 2 and 10" includes both 2 and 10.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") can also include two or more such referents.

Following are some further example embodiments of the invention. These are presented only by way of example and are not intended to limit the scope of the invention in any way. Further, any example embodiment can be combined with one or more of the example embodiments.

Embodiment 1. A modular reclining assembly for use in a modular furniture assembly the modular reclining assembly comprising:

an adjustable outer frame having a wide mode and a deep mode; and a reclining mechanism configured to selectively move a footplate with respect to the adjustable outer frame, whether the adjustable outer frame is in the wide mode or the deep mode, wherein the reclining mechanism is configured to be selectively orientable and docked within the adjustable outer frame when the adjustable outer frame is in the wide mode or the deep mode.

Embodiment 2. A modular reclining assembly as recited in embodiment 1, wherein the reclining mechanism also moves a seat to a reclined position.

Embodiment 3. A modular reclining assembly as recited in embodiment 1, wherein (A) the modular reclining assembly is selectively coupleable to: (i) one or more non-reclining seat base members of a modular furniture system, either in a deep mode or a wide mode; (ii) one or more armrests or backrests of a modular furniture assembly; or (iii) both one or more non-reclining seat base members of a modular furniture system and one or more armrests or backrests of the modular furniture assembly, and wherein (B) the modular reclining assembly occupies substantially the same amount of footprint space as the one or more non-reclining seat base members of a modular furniture system to which the modular reclining assembly is coupled.

Embodiment 4. A reclining assembly for use in a furniture assembly, the reclining assembly comprising:

an outer frame;

a reclining mechanism configured to selectively move a footplate with respect to the outer frame, wherein the reclining mechanism is configured to be selectively docked within the outer frame.

Embodiment 5. A reclining assembly as recited in embodiment 4, wherein the outer frame is a substantially U-shaped frame.

Embodiment 6. A reclining assembly as recited in embodiment 4, wherein the outer frame is an adjustable frame that can have different shapes and configurations to thereby occupy substantially the same amount of footprint space as a furniture member to which the frame is selectively coupled.

Embodiment 7. A reclining assembly as recited in embodiment 6, wherein the furniture member is a seat base member of a modular furniture system.

Embodiment 8. The reclining assembly of embodiment 4, further comprising (i) a clamp configured to connect the outer frame to a furniture member; and (ii) a securing member extending through a portion of the clamp to further secure the clamp to the adjustable outer frame.

Embodiment 9. The reclining assembly of embodiment 8, wherein the clamp has a first leg and a second leg connected by a clamp body, and wherein the securing member is a threaded thumb screw having a threaded portion that threadably extends through one of the first or second legs of the clamp into the adjustable frame.

Embodiment 10. The reclining assembly of embodiment 8, wherein the furniture member connected by the clamp to the adjustable frame is an upright backrest member of a modular furniture system.

Embodiment 11. A modular reclining assembly for use in a modular sofa system, the modular reclining assembly comprising:

an adjustable outer frame, the adjustable outer frame having a wide mode and a deep mode; and a reclining mechanism, the reclining mechanism having (a) a lower carriage portion having a lower carriage portion framework to which a first actuator is attached; (b) an upper carriage portion linked to the first actuator, the upper carriage portion being selectively movable relative to the lower carriage portion, the upper carriage portion having an upper carriage portion framework and being configured to recline a cushion supported by the reclining mechanism and to selectively move a footplate away from the upper carriage portion framework, wherein the reclining mechanism is selectively connected to the adjustable outer frame in either the wide mode or the deep mode.

Embodiment 12. A modular reclining assembly as recited in embodiment 11, wherein the upper carriage portion has (a) one or more footplate reclining arms attached to the footplate; and (b) a second actuator attached to a framework of the upper carriage portion and to the lower carriage portion, the second actuator being configured to selectively move the one or more footplate reclining arms and the footplate with respect to the framework of the upper carriage portion.

Embodiment 13. A modular reclining assembly as recited in embodiment 11, further comprising a lifting member movably attached to the upper carriage portion at one end of the lifting member, the lifting member also having a free opposing end, the lifting member comprising a framework configured to support a seat lid mounted on the lifting member, the seat lid configured to support the cushion of the sofa.

Embodiment 14. A modular reclining assembly as recited in embodiment 13, further comprising a ramp mounted on the lower carriage portion framework, the ramp configured to movably receive a link member, extending from the framework of the lifting member, thereon such that the link member is movably mounted on the ramp.

Embodiment 15. The modular reclining assembly of embodiment 14, wherein (i) a lower portion of the link has a roller thereon that rolls on an upper surface of the ramp, and wherein (ii) the ramp includes a slot, the lower portion of the link further including a connecting member that moves within the slot of the ramp, such that the link both rolls on and is movably linked to the ramp.

Embodiment 16. A modular reclining assembly as recited in embodiment 15, wherein the configuration of the ramp causes the lifting member, upon actuation of the first actuator, to lift the free end of the lifting member.

Embodiment 17. A modular reclining assembly as recited in embodiment 13, wherein lifting the free end of the lifting member enables a cushion supported by the reclining mechanism to be moved away from the footplate.

Embodiment 18. A modular reclining assembly as recited in embodiment 13, wherein lifting the free end of the lifting member enables a cushion supported by the reclining mechanism to be moved away from the footplate at the beginning of a reclining cycle and at the end of the reclining cycle, when the reclining mechanism is moved into the non-reclined mode.

Embodiment 19. The modular reclining assembly of embodiment 13, further comprising a ramp mounted on the lower carriage portion framework, the ramp configured to movably receive a link member, extending from the framework of the lifting member, thereon such that the link member is movably mounted on the ramp, wherein the ramp of the lower carriage portion has an initial angled portion that enables the free front end of the lifting member to move away from the footplate.

Embodiment 20. The modular reclining assembly of embodiment 19, wherein the ramp member has a substantially horizontal portion adjacent the initial angled portion.

Embodiment 21. The modular reclining assembly of embodiment 20, wherein the initial angled portion of the ramp is followed by a substantially curved portion.

Embodiment 22. A modular reclining assembly as recited in embodiment 13, wherein an initial movement of the first actuator causes a free end of the lifting member, and the cushion supported by the reclining mechanism, to lift away from the foot plate, allowing the one or more footplate reclining arms to push the footplate towards an extended reclined position without interference from the cushion.

Embodiment 23. The modular reclining assembly of embodiment 13, wherein the free end of the lifting member moves away from the footplate before or simultaneous with the footplate being moved away from the framework of the upper carriage portion.

Embodiment 24. The modular reclining assembly of embodiment 11, wherein the modular reclining mechanism is selectively moveable into or out of the adjustable outer frame in either the deep mode or the wide mode of the adjustable outer frame.

Embodiment 25. The modular reclining assembly of embodiment 11, wherein one or more wheels is attached to the lower carriage portion of the modular reclining mechanism for selectively moving the modular reclining mechanism into or out of the adjustable outer frame.

Embodiment 26. A modular reclining assembly as recited in embodiment 11, wherein the footplate is spring loaded in one or more directions with respect to the one or more footplate reclining arms.

Embodiment 27. The modular reclining assembly of embodiment 26, wherein the footplate is spring loaded in two different directions with respect to the one or more footplate recliner arms.

Embodiment 28. The modular reclining assembly of embodiment 26, wherein a first spring on the footplate resists compression but is compressible in one direction and a second spring on the footplate resists compression, but is compressible in a second direction, such that the footplate can be moved, in response to a compressive force, in a first direction or a second direction, but returns to the neutral position when the compressive force is released.

Embodiment 29. The modular reclining assembly of embodiment 26, wherein the footplate is selectively movable relative to the recliner arm such that a user can sit on the modular reclining assembly, with the user's feet on the footplate, rotating the footplate from a default generally horizontal orientation, such that the user's knees move towards the user.

Embodiment 30. A modular reclining assembly as recited in embodiment 11, wherein the foot plate is comprised of a plurality of adjustable panels, such that the foot plate can be adjusted for use in deep or wide modes.

Embodiment 31. The modular reclining assembly of embodiment 11, wherein the adjustable outer frame has two sides connected by a rear portion, forming a generally U-shaped frame that is open at a front portion thereof.

Embodiment 32. A modular reclining assembly as recited in embodiment 11, wherein the adjustable outer frame has a substantial U-shape and wherein the foot plate is selectively adjustable to thereby fill the opening in the adjustable outer frame through which the reclining mechanism enters the adjustable outer frame when the reclining mechanism is pushed into the outer frame.

Embodiment 33. A modular reclining assembly as recited in embodiment 11, wherein the foot plate is adjustable and is comprised of a plurality of panels that are slidable with respect to each other, such that the foot plate can be adjusted for use in deep or wide modes.

Embodiment 34. A modular reclining assembly as recited in embodiment 11, wherein the foot plate is comprised of a plurality of panels, the panels having respective slats coupled thereto that are slidably mounted into a main body of the footplate.

Embodiment 35. The modular reclining assembly of embodiment 11, wherein the footplate is in a substantially horizontal orientation when the upper carriage portion is in an extended position, and wherein the footplate is in a substantially vertical orientation when the upper carriage portion in a non-extended position.

Embodiment 36. The modular reclining assembly of embodiment 11, wherein upon retraction of the upper carriage portion to the non-extended position, the footplate contacts a frame portion of the upper carriage portion, thereby causing the footplate to move to the substantially vertical orientation.

Embodiment 37. The modular reclining assembly of embodiment 11, wherein the outer frame comprises three sides of a substantially rectangular shape and wherein the reclining mechanism completes the fourth side of the substantially rectangular shape, wherein a plurality of different substantially rectangular shapes can be formed.

Embodiment 38. The modular reclining assembly of embodiment 11, wherein each of the sides and the rear portion of the outer adjustable frame are comprised of a wall, each wall comprised of first and second frame members that are selectively movable with respect to one another.

Embodiment 39. The modular reclining assembly of embodiment 11, wherein the reclining mechanism selectively moves into or out of the adjustable outer frame without requiring lifting of both ends of the reclining mechanism off a supporting surface.

Embodiment 40. A modular reclining assembly as recited in embodiment 11, wherein one or more of the outer frame walls are comprised of movable panels that overlap each other so as to be selectively compactible or extendible with respect to each other.

Embodiment 41. A modular reclining assembly as recited in embodiment 11, wherein the adjustable outer frame of the reclining assembly is comprised of adjustable walls, and wherein one or more of the adjustable walls is comprised of (i) an upper U-shaped panel slidably mounted on (ii) a respective lower panel.

Embodiment 42. A modular reclining assembly as recited in embodiment 11, wherein, in the wide mode, the length of each of the left and right panels of the adjustable outer frame is less than the length of the back panel of the adjustable outer frame, and wherein, in the deep mode, the length of each of the left and right panels of the adjustable outer frame is greater than the length of the back panel of the adjustable outer frame.

Embodiment 43. A modular reclining assembly as recited in embodiment 11, wherein the design of the adjustable outer frame is configured to guide the reclining mechanism into a desired location for docking the reclining mechanism in the adjustable outer frame, in either the wide mode or the deep mode.

Embodiment 44. A modular reclining assembly as recited in embodiment 11, wherein the adjustable outer frame has indicia indicating whether the adjustable outer frame is in the wide mode or the deep mode.

Embodiment 45. A modular reclining assembly as recited in embodiment 11, further comprising one or more egress blockers in one or more of the walls of the adjustable outer frame.

Embodiment 46. modular reclining assembly as recited in embodiment 11, wherein the adjustable outer frame has a middle support leg configured to be mounted on the support surface to provide weight stability.

Embodiment 47. The modular reclining assembly of embodiment 11, wherein a seat lid is configured to be supported by the reclining mechanism, and wherein the reclining assembly further comprises a backrest that is selectively mountable into the seat lid, the backrest being selectively mounted onto the lid at a short end of the lid in the deep mode, or a wide end of the lid in the wide mode, depending on whether a user desires to use the reclining mechanism in the deep mode or the wide mode.

Embodiment 48. A modular reclining assembly as recited in embodiment 11, wherein each of the first and second actuators is an extension motor.

Embodiment 49. A modular reclining assembly as recited in embodiment 11, further comprises one or more housing portions covering portions of the upper carriage that are selectively extended.

Embodiment 50. A modular reclining assembly as recited in embodiment 11, wherein the reclining mechanism has one or more cord tunnels for routing cords at the bottom of the reclining mechanism.

Embodiment 51. A modular reclining assembly as recited in embodiment 50, wherein the one or more cord tunnel(s) allow one or more cords to pass therethrough to be connected to one or more electronic devices, lamps, extension cords, or speakers.

Embodiment 52. A modular reclining assembly as recited in embodiment 11, wherein the reclining mechanism has a recess area for movement of a seat lid comprising springs, the seat lid being mounted on the reclining mechanism, into the recess area.

Embodiment 53. The modular reclining assembly of embodiment 11, wherein a seat lid configured to be supported by the reclining mechanism has springs for compressible support.

Embodiment 54. The modular reclining assembly of embodiment 11, wherein the modular reclining assembly is selectively coupleable to a non-reclining base member of a modular furniture system, either in a deep mode or a wide mode.

Embodiment 55. The modular reclining assembly of embodiment 11, further comprising (i) a lifting member movably attached to the upper carriage portion, (ii) a housing mounted on the lifting member, and (iii) a seat lid selectively coupled to the housing, wherein the seat lid comprises one or guides for selectively positioning the lid on the housing.

Embodiment 56. A modular reclining assembly comprising:

an adjustable outer frame, the adjustable outer frame having a wide mode and a deep mode;

a reclining mechanism, configured to selectively recline a cushion supported by the reclining mechanism, having (a) a lower carriage portion having a lower carriage portion framework to which a first actuator is attached; (b) an upper carriage portion linked to the first actuator, the upper carriage portion being selectively movable relative to the lower carriage portion, and (c) a lifting member pivotally attached to the upper carriage portion, the reclining mechanism being selectively connected to the adjustable outer frame in either the wide mode or the deep mode, wherein:

the upper carriage portion has (a) one or more footplate reclining arms attached to a footplate; (b) a framework; and (c) a second actuator attached to the framework of the upper carriage portion, the second actuator being configured to selectively move the one or more footplate reclining arms and footplate with respect to the framework of the upper carriage portion;

the lower carriage portion having a ramp on which the lifting member moves when the upper carriage portion is moved by the first actuator; and a seat lid mounted on the lifting member of the reclining mechanism;

such that the first actuator moves the upper carriage portion with respect to the lower carriage portion and such that the second actuator moves the one or more footplate reclining arms and footplate with respect to the framework of the upper carriage portion, and such that an initial movement of the first actuator causes a free end of the lifting member and a cushion supported by the reclining mechanism to lift away from the footplate, allowing the one or more footplate reclining arms to push the footplate towards an extended, reclined position without interference from the cushion supported by the reclining mechanism.

Embodiment 57. he modular reclining assembly of embodiment 56, wherein the seat lid is configured to be supported by the reclining mechanism, and wherein the reclining assembly further comprises a backrest that is selectively mountable into the seat lid, the backrest being selectively mounted onto the lid at a short end of the lid in the deep mode, or a wide end of the lid in the wide mode, depending on whether a user desires to use the reclining mechanism in the deep mode or the wide mode.

Embodiment 58. A modular reclining assembly as recited in embodiment 56, wherein the adjustable outer frame has a substantial U-shape and wherein foot plate is selectively adjustable to thereby fill the opening in the adjustable outer frame through which the reclining mechanism enters the adjustable outer frame when the reclining mechanism is pushed into the outer frame.

Embodiment 59. A modular reclining assembly comprising:

an adjustable outer frame, the adjustable outer frame having a wide mode and a deep mode;

a reclining mechanism having (a) a lower carriage portion to which a first actuator is attached, (b) an upper carriage portion linked to the first actuator, the upper carriage portion being selectively movable relative to the lower carriage portion, the reclining mechanism being selectively connected to the adjustable outer frame in either the wide mode or the deep mode, wherein:

the upper carriage portion has (a) one or more footplate reclining arms attached to a footplate; (b) a second actuator attached to a framework of the upper carriage portion, the second actuator being configured to selectively move the one or more footplate reclining arms and footplate with respect to the framework of the upper carriage portion; and a seat lid mounted on the reclining mechanism;

such that the first actuator moves the upper carriage portion with respect to the lower carriage portion and such that the second actuator moves the one or more footplate reclining arms and footplate with respect to the framework of the upper carriage portion, wherein:

upon actuation of the second actuator, the one or more footplate reclining arms initially push the footplate downwardly and outwardly, then afterwards push the footplate upwardly towards an extended reclined position without interference from the seat lid or a cushion supported by the reclining mechanism.

Embodiment 60. A modular reclining assembly as recited in embodiment 59, wherein the upper carriage portion comprises: (i) an upper carriage portion framework; (ii) one or more ramps mounted on the upper carriage portion framework, the one or more reclining arms movably linked to the one or more ramps, the one or more ramps having a serpentine configuration with a downward slope followed by an upward slope.

Embodiment 61. A modular reclining assembly as recited in embodiment 59, wherein the upper carriage portion comprises: (i) an upper carriage portion framework; (ii) one or more ramps mounted on the upper carriage portion framework, the one or more reclining arms movably linked to the one or more ramps, the one or more ramps having a serpentine configuration with a downward slope followed by an upward slope, such that the one or more reclining arms initially moves downwardly, then upwardly on the one or more ramps, causing the footplate to initially move downwardly, then upwardly without interference from the seat lid or a cushion supporting by the reclining mechanism.

Embodiment 62. A modular reclining assembly as recited in embodiment 61, wherein each of the one or more reclining arms is movably linked to a respective ramp by a plurality of sliding members sliding on opposing surfaces of the ramp, each of the reclining arms being pivotally coupled to two sliding members.

Embodiment 63. A modular reclining assembly as recited in embodiment 61, wherein: (i) a first upper sliding member rotatably connected to a first reclining arm slides on an upper surface of a first ramp, while a first lower sliding member rotatably connected to the first reclining arm slides on a lower surface of the first ramp; and wherein (ii) a second upper sliding member rotatably connected to a second reclining arm slides on an upper surface of a second ramp, while a second lower sliding member rotatably connected to the second reclining arm slides on a lower surface of the second ramp.

Embodiment 64. A modular reclining assembly as recited in embodiment 63, wherein movement of the first and second reclining arms along the first and second ramps causes each of the first and second reclining arms to rotate with respect to the first and second ramps, such that the footplate connected to the first and second reclining arms (i) first moves downwardly, then (ii) later moves upwardly.

Embodiment 65. A modular reclining assembly as recited in embodiment 61, wherein each of the one or more ramps has a smaller dimension in the vertical plane towards the rear of the ramp and a larger dimension in the vertical plane towards the front of the ramp.

Embodiment 66. A modular reclining assembly as recited in embodiment 65, wherein the one or more reclining arms movably linked to the one or more ramps is connected to the top and bottom surfaces of the one or more ramps, and wherein the one or more ramps are shaped and oriented such that movement of the one or more reclining arms from the back to the front of the one or more ramps (i) initially moves a front of the one or more reclining arms downwardly, causing the footplate to move downwardly, then (ii) later moves the a front of the one or more reclining arms upwardly, causing the footplate to move upwardly.

Embodiment 67. A modular reclining assembly as recited in embodiment 59, wherein the upper carriage portion comprises: (i) an upper carriage portion framework; (ii) one or more ramps mounted on the upper carriage portion framework, the one or more reclining arms movably linked to the one or more ramps, the one or more ramps having a serpentine configuration with a downward slope followed by an upward slope, such that the one or more reclining arms initially moves downwardly, then upwardly on the one or more ramps, causing the footplate to initially move downwardly, then upwardly without interference from the seat lid or a cushion supporting by the reclining mechanism, wherein each of the one or more reclining arms is movably linked to a respective ramp by a plurality of sliding members sliding on opposing surfaces of the ramp, each of the reclining arms being pivotally coupled to the sliding members and wherein each of the one or more ramps has a smaller dimension in the vertical plane towards the rear of the ramp and a larger dimension in the vertical plane towards the front of the ramp.

It will also be appreciated that embodiments described herein can also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

A user having ordinary skill in the art should realize in view of the present disclosure that equivalent constructions do not depart from the spirit and scope of the present disclosure, and that various changes, substitutions, and alterations can be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The invention claimed is:

1. A modular reclining assembly for use in a modular furniture assembly the modular reclining assembly comprising:

an adjustable outer frame having a wide mode and a deep mode; and a reclining mechanism configured to selectively move a foot plate with respect to the adjustable outer frame, whether the adjustable outer frame is in the wide mode or the deep mode, wherein the reclining mechanism is configured to be selectively orientable and docked within the adjustable outer frame when the adjustable outer frame is in the wide mode or the deep mode.

2. A modular reclining assembly as recited in claim 1, wherein the reclining mechanism also moves a seat to a reclined position.

3. A modular reclining assembly as recited in claim 1, wherein (A) the modular reclining assembly is selectively coupleable to: (i) one or more non-reclining seat base members of a modular furniture system, either in a deep mode or a wide mode; (ii) one or more armrests or backrests of a modular furniture assembly; or (iii) both one or more non-reclining seat base members of a modular furniture system and one or more armrests or backrests of the modular furniture assembly, and wherein (B) the modular reclining assembly occupies substantially the same amount of footprint space as the one or more non-reclining seat base members of a modular furniture system to which the modular reclining assembly is coupled.

4. A reclining assembly for use in a furniture assembly, the reclining assembly comprising:

an outer frame;

a reclining mechanism configured to selectively move a footplate with respect to the outer frame, the reclining mechanism having (a) a lower carriage portion having a lower carriage portion framework to which a first actuator is attached; (b) an upper carriage portion linked to the first actuator, the upper carriage portion being selectively movable relative to the lower carriage portion, the upper carriage portion having an upper carriage portion framework and being configured to recline a cushion supported by the reclining mechanism and to selectively move a footplate away from the upper carriage portion framework, wherein wherein the reclining mechanism is configured to be selectively docked within the outer frame.

5. A reclining assembly as recited in claim 4, wherein the outer frame is a substantially U-shaped frame.

6. A reclining assembly as recited in claim 4, wherein the outer frame is an adjustable frame that can have different shapes and configurations to thereby occupy substantially the same amount of footprint space as a furniture member to which the frame is selectively coupled.

7. A reclining assembly as recited in claim 6, wherein the furniture member is a seat base member of a modular furniture system.

8. The reclining assembly of claim 4, further comprising (i) a clamp configured to connect the outer frame to a furniture member; and (ii) a securing member extending through a portion of the clamp to further secure the clamp to the adjustable outer frame.

9. The reclining assembly of claim 8, wherein the clamp has a first leg and a second leg connected by a clamp body, and wherein the securing member is a threaded thumb screw having a threaded portion that threadably extends through one of the first or second legs of the clamp into the adjustable frame.

10. The reclining assembly of claim 8, wherein the furniture member connected by the clamp to the adjustable frame is an upright backrest member of a modular furniture system.

11. A modular reclining assembly for use in a modular sofa system, the modular reclining assembly comprising:

an adjustable outer frame, the adjustable outer frame having a wide mode and a deep mode; and a reclining mechanism, the reclining mechanism having (a) a lower carriage portion having a lower carriage portion framework to which a first actuator is attached; (b) an upper carriage portion linked to the first actuator, the upper carriage portion being selectively movable relative to the lower carriage portion, the upper carriage portion having an upper carriage portion framework and being configured to recline a cushion supported by the reclining mechanism and to selectively move a footplate away from the upper carriage portion framework, wherein the reclining mechanism is selectively connected to the adjustable outer frame in either the wide mode or the deep mode.

12. A modular reclining assembly as recited in claim 11, wherein the upper carriage portion has (a) one or more footplate reclining arms attached to the footplate; and (b) a second actuator attached to a framework of the upper carriage portion and to the lower carriage portion, the second actuator being configured to selectively move the one or more footplate reclining arms and the footplate with respect to the framework of the upper carriage portion.

13. A modular reclining assembly as recited in claim 11, further comprising a lifting member movably attached to the upper carriage portion at one end of the lifting member, the lifting member also having a free opposing end, the lifting member comprising a framework configured to support a seat lid mounted on the lifting member, the seat lid configured to support the cushion of the sofa.

14. A modular reclining assembly as recited in claim 13, wherein lifting the free end of the lifting member enables a cushion supported by the reclining mechanism to be moved away from the footplate at the beginning of a reclining cycle and at the end of the reclining cycle, when the reclining mechanism is moved into the non-reclined mode.

15. A modular reclining assembly as recited in claim 13, wherein an initial movement of the first actuator causes a free end of the lifting member, and the cushion supported by the reclining mechanism, to lift away from the foot plate, allowing the one or more footplate reclining arms to push the footplate towards an extended reclined position without interference from the cushion.

16. The modular reclining assembly of claim 13, wherein the free end of the lifting member moves away from the footplate before or simultaneous with the footplate being moved away from the framework of the upper carriage portion.

17. The modular reclining assembly of claim 11, wherein the modular reclining mechanism is selectively moveable into or out of the adjustable outer frame in either the deep mode or the wide mode of the adjustable outer frame.

18. A modular reclining assembly as recited in claim 11, wherein the footplate is spring loaded in one or more directions with respect to the one or more footplate reclining arms.

19. The modular reclining assembly of claim 18, wherein the footplate is selectively movable relative to the recliner arm such that a user can sit on the modular reclining assembly, with the user's feet on the footplate, rotating the footplate from a default generally horizontal orientation, such that the user's knees move towards the user.

20. A modular reclining assembly as recited in claim 11, wherein the foot plate is adjustable.

21. The modular reclining assembly of claim 11, wherein the reclining mechanism selectively moves into or out of the adjustable outer frame without requiring lifting of both ends of the reclining mechanism off a supporting surface.

22. A modular reclining assembly comprising:

an adjustable outer frame, the adjustable outer frame having a wide mode and a deep mode;

a reclining mechanism, configured to selectively recline a cushion supported by the reclining mechanism, having (a) a lower carriage portion having a lower carriage portion framework to which a first actuator is attached; (b) an upper carriage portion linked to the first actuator, the upper carriage portion being selectively movable relative to the lower carriage portion, and (c) a lifting member pivotally attached to the upper carriage portion, the reclining mechanism being selectively connected to the adjustable outer frame in either the wide mode or the deep mode, wherein:

the upper carriage portion has (a) one or more footplate reclining arms attached to a footplate; (b) a framework; and (c) a second actuator attached to the framework of the upper carriage portion, the second actuator being configured to selectively move the one or more footplate reclining arms and footplate with respect to the framework of the upper carriage portion;

the lower carriage portion having a ramp on which the lifting member moves when the upper carriage portion is moved by the first actuator; and a seat lid mounted on the lifting member of the reclining mechanism;

such that the first actuator moves the upper carriage portion with respect to the lower carriage portion and such that the second actuator moves the one or more footplate reclining arms and footplate with respect to the framework of the upper carriage portion, and such that an initial movement of the first actuator causes a free end of the lifting member and a cushion supported by the reclining mechanism to lift away from the footplate, allowing the one or more footplate reclining arms to push the footplate towards an extended, reclined position without interference from the cushion supported by the reclining mechanism.

23. The modular reclining assembly of claim 22, wherein the seat lid is configured to be supported by the reclining mechanism, and wherein the reclining assembly further comprises a backrest that is selectively mountable into the seat lid, the backrest being selectively mounted onto the lid at a short end of the lid in the deep mode, or a wide end of the lid in the wide mode, depending on whether a user desires to use the reclining mechanism in the deep mode or the wide mode.

24. A modular reclining assembly as recited in claim 22, wherein the adjustable outer frame has a substantial U-shape and wherein foot plate is selectively adjustable to thereby fill the opening in the adjustable outer frame through which the reclining mechanism enters the adjustable outer frame when the reclining mechanism is pushed into the outer frame.

* * * * *